US012760447B2

(12) United States Patent
Gopinadhan et al.

(10) Patent No.: US 12,760,447 B2
(45) Date of Patent: Oct. 13, 2026

(54) METHODS FOR ENHANCING THE FORMATION OF MESOPHASE IN PITCH COMPOSITIONS DERIVED FROM HYDROCARBON FEEDSTOCKS

(71) Applicant: ExxonMobil Technology and Engineering Company, Annandale, NJ (US)

(72) Inventors: Manesh Gopinadhan, Basking Ridge, NJ (US); Stuart E. Smith, Easton, PA (US); Nicole M. Callen, Denville, NJ (US); Clarence E. Chase, Bensalem, PA (US); Kazem V. Edmond, Lebanon, NJ (US); Srinivasan Rajagopalan, Easton, PA (US); Eric B. Sirota, Flemington, NJ (US); Daniel J. Ryan, Easton, PA (US)

(73) Assignee: Exxon Mobil Technology and Engineering Company, Spring, TX (US)

( * ) Notice: Subject to any disclaimer, the term of this patent is extended or adjusted under 35 U.S.C. 154(b) by 566 days.

(21) Appl. No.: 18/269,882

(22) PCT Filed: Nov. 10, 2021

(86) PCT No.: PCT/US2021/072320
§ 371 (c)(1),
(2) Date: Jun. 27, 2023

(87) PCT Pub. No.: WO2022/154984
PCT Pub. Date: Jul. 21, 2022

(65) Prior Publication Data

US 2024/0068132 A1 Feb. 29, 2024

Related U.S. Application Data

(60) Provisional application No. 63/136,695, filed on Jan. 13, 2021.

(51) Int. Cl.
*D01F 9/145* (2006.01)
*C10C 3/02* (2006.01)

(52) U.S. Cl.
CPC ..... *D01F 9/145* (2013.01); *C10C 3/023* (2013.01)

(58) Field of Classification Search
CPC ..... D01F 9/145; C10C 3/023; C10C 3/002; C10C 3/005; C10C 3/02
See application file for complete search history.

(56) References Cited

U.S. PATENT DOCUMENTS 3,974,264 A 8/1976 McHenry
3,976,729 A 8/1976 Lewis et al.
(Continued)

FOREIGN PATENT DOCUMENTS

AU 3606197 B2 3/1999
CN 107312561 A 11/2017
(Continued)

OTHER PUBLICATIONS

Zhang et al. "Preparation of mesophase pitch from refined coal tar pitch using naphthalene-based mesophase pitch as nucleating agent" Fuel 243 (2019) 390-397 (Year: 2019).*
(Continued)

*Primary Examiner* — Anthony J Zimmer
*Assistant Examiner* — Syed T Iqbal
(74) *Attorney, Agent, or Firm* — C. Tumey Law Group PLLC

(57) ABSTRACT

Nucleation enhancement and/or growth rate improvement of mesophase in pitch compositions derived from hydrocarbon feedstocks can be achieved by: reacting in a reaction zone a blend comprising an isotropic feed and a seeding agent, to produce a reacted pitch having a mesophase content of about 10 vol % to 100 vol %, based on the total volume of the
(Continued)

reacted pitch, and a softening point ($T_{sp}$) below 400° C.; wherein the seeding agent is about 50 wt % or less, based on the total weight of the blend; wherein the seeding agent has a mesophase content of about 0.01 vol % to 100 vol %, based on the total volume of the seeding agent.

17 Claims, 15 Drawing Sheets

(56) References Cited

U.S. PATENT DOCUMENTS

| | | | | |
|---|---|---|---|---|
| 4,017,327 | A | 4/1977 | Lewis et al. | |
| 4,032,430 | A | 6/1977 | Lewis | |
| 4,208,267 | A | 6/1980 | Diefendorf et al. | |
| 4,663,021 | A * | 5/1987 | Arai | C10G 51/023 208/67 |
| 7,018,526 | B1 * | 3/2006 | Isayev | D01F 9/155 208/43 |
| 7,138,047 | B2 | 11/2006 | Stell et al. | |
| 7,820,035 | B2 | 10/2010 | McCoy et al. | |
| 8,684,384 | B2 | 4/2014 | Spicer et al. | |
| 9,206,363 | B2 | 12/2015 | Woo et al. | |
| 9,376,626 | B1 | 6/2016 | Malone et al. | |
| 10,400,184 | B2 | 9/2019 | Woo et al. | |
| 2023/0348807 | A1 | 11/2023 | Yeh et al. | |

FOREIGN PATENT DOCUMENTS

| | | | |
|---|---|---|---|
| EP | 0026647 | A1 | 4/1981 |
| EP | 0403688 | A1 | 12/1990 |
| JP | S63182417 | A | 7/1988 |
| JP | 2020041243 | A | 3/2020 |
| WO | 1995002564 | A1 | 1/1995 |
| WO | 2015/167774 | A2 | 11/2015 |
| WO | 2017217972 | A1 | 12/2017 |
| WO | 2019/014010 | A1 | 1/2019 |
| WO | 2022150232 | A1 | 7/2022 |

OTHER PUBLICATIONS

Chinese Office Action for CN Patent Application No. 202180082028.2 dated Jul. 9, 2025. English Translation with Original Untranslated Version, PDF file. 21 pages.

International Search Report for International Patent Application No. PCT/US2021/072320 dated Oct. 2, 2022. PDF file. 4 pages. .

Khandare et al. Carbon 1996, 34(5), 663-669.

Barr et al. Thermochimica Acta 1982, 52, 297-304.

J. Ilavsky et al. Journal of Applied Crystallography 2009, 42, 347-353.

J. Ilavsky Journal Of Applied Crystallography 2012, 45(2), 324-328.

International Search Report and Written Opinion for International Patent Application No. PCT/US2021/072320 dated Feb. 10, 2022.

Coombes et al., Electrophilic Aromatic Substitution. Part VIII. Isomer Ratios and Assignment of Mechanism in Aromatic Nitration. o-xylene and biphenyl, Journal of the Chemical Society B: Physical Organic, 1971, 2443-2447.

Fischer et al., Formation of Adducts in the Nitration of p-Xylene. Exchange and Rearomatization Reactions of p-Kylene Adducts, Canadian Journal of Chemistry, 1974, 3960-3970.

Dewar et al., Electrophilic Substitution. Part II. The nitration of napthalene and perylene., Journal of the Chemical Society (Resumed), 1956, 1441-1443.

Olah et al., Nitration of naphthalene and remarks on the mechanism of electrophilic aromatic nitration, Proceedings of the National Academy of Sciences 78.6 (1981): 3298-3300.

Simamura, O., & Mizuno, Y. (1957). The Competitive Nitration of Biphenyl and Benzene by Nitric Acid in Acetide Anhydride. Bulletin of the Chemical Society of Japan, 30(2), 196-197.

Billing, C. J., & Norman, R. O. C. (1961). 758. The ortho: para-ratio in aromatic substitution. Part IV. The nitration of biphenyl. Journal of the Chemical Society (Resumed), 3885-3888.

Taylor, R. (1966). The ortho: para ratio in the nitration of biphenyl. Journal of the Chemical Society B: Physical Organic, 727-733.

Brink, J. A., & Shreve, R. N. (1954). Nitration of 2-Methylnaphthalene. Industrial & Engineering Chemistry, 46(4), 694-702.

Patil, P. T., Malshe, K. M., Dagade, S. P., & Dongare, M. K. (2003). Regioselective nitration of o-xylene to 4-nitro-o-kylene using nitric acid over solid acid catalysts. Catalysis Communications, 4(8), 429-434.

Ju, K. S., & Parales, R. E. (2010). Nitroaromatic compounds, from synthesis to biodegradation. Microbiol. Mol. Biol. Rev., 74(2), 250-272.

Reglero, J. R., Trigo-López, M., García, F. C., & Garcia, J. M. (2017). Functional Aromatic Polyamides. Polymers, 9(9), 414.

García, J. M., Garcia, F. C., Serna, F., & Jose, L. D. L. P. (2010). High-performance aromatic polyamides. Progress in Polymer Science, 35(5), 623-686.

Marchildon, K. (2011). Polyamides-still strong after seventy years. Macromolecular Reaction Engineering, 5(1), 22-54.

Rozenberg, B. A. (1986). Kinetics, thermodynamics and mechanism of reactions of epoxy oligomers with amines. In Epoxy resins and composites II (pp. 113-165). Springer, Berlin, Heidelberg.

Prime, R. B. (1973). Differential scanning calorimetry of the epoxy cure reaction. Polymer Engineering & Science, 13 (5), 365-371.

Vidil, T., Tournilhac, F., Musso, S., Robisson, A., & Leibler, L. (2016). Control of reactions and network structures of epoxy thermosets. Progress in Polymer Science, 62, 126-179.

Hodgkin, J. H., Simon, G. P., & Varley, R. J. (1998). Thermoplastic toughening of epoxy resins: a critical review. Polymers for advanced technologies, 9(1), 3-10.

Mezzenga, R., Boogh, L., Manson, J. A. E., & Pettersson, B. (2000). Effects of the branching architecture on the reactivity of epoxy—amine groups. Macromolecules, 33(12), 4373-4379.

Jin, F. L., Li, X., & Park, S. J. (2015). Synthesis and application of epoxy resins: A review. Journal of Industrial and Engineering Chemistry, 29, 1-11.

Vieira, Fabiana R. et al. "Determining the anisotropic content in a petroleum pitch—Comparison of centrifugation and optical microscopy techniques." Fuel: the Science and Technology of Fuel and Energy Journal, vol. 90, Issue No. 2, Feb. 2011, pp. 908-911. PDF file. 4 pages.

Liedtke, V. et al. "Mesophase Pitches as Matrix Precursor of Carbon Fiber Reinforced Carbon: I. Mesophase Pitch Preparation and Characterization." Carbon Journal, vol. 34, Issue No. 9, Jan. 1996, pp. 1057-1066. PDF file. 10 pages.

Canadian Office Action for CA Patent Application No. 3, 197,617 dated Jun. 26, 2024. PDF file. 3 pages.

International Preliminary Report on Patentability for International Patent Application No. PCT/US2021/072320 dated Jul. 4, 2023. PDF file. 7 pages.

* cited by examiner

METHODS FOR ENHANCING THE FORMATION OF MESOPHASE IN PITCH COMPOSITIONS DERIVED FROM HYDROCARBON FEEDSTOCKS

FIELD

The present disclosure relates to methods for enhancing the nucleation and/or the growth rate of mesophase in pitch compositions derived from hydrocarbon feedstocks.

BACKGROUND

Mesophase pitch is a complex aromatic hydrocarbon comprising a liquid crystalline phase. The molecular ordering owed to its liquid crystallinity imbues these materials with useful properties such as improved stiffness and remarkable thermal and electrical conductivity. Some of these non-limiting materials are: mesophase pitch-based carbon fiber, binder pitch, graphitizable carbon microbeads, solid lubricants, activated carbon fiber, battery anodes, and carbon foams. However, the production of mesophase pitch for these applications is slow, frequently a batch process, and costly. Thus, new methods are desired to enable the rapid and continuous production of mesophase pitch for new carbon materials.

Carbon fiber is viewed by many industries as one of the most desirable structural materials in the world. Its lightweight and superior mechanical properties make it an ideal material for many structural applications. Carbon fibers are used primarily as reinforcing agents in high-performance composites with synthetic resin matrices such as epoxies, polymides, vinyl esters, phenolics, and certain thermoplastics. The carbon fiber provides the strength and stiffness to the composite, while the matrix material maintains fiber alignment and transfers structural load among the fibers.

Carbon fiber production requires the use of increasingly sophisticated technologies and ever greater attention to the related environmental impacts. As numerous carbon fiber producing countries are experiencing substantial domestic growth in wind energy, aerospace, national defense, automotive, sporting goods, and pressure vessels demand, significant interest in pitch-based carbon fiber to improve the fiber and fiber composite's quality and performance (e.g., mechanical properties) has been undertaken. Typically, precursor materials for carbon fiber production include rayon, pitch, and polyacrylonitrile (PAN). Carbon fibers produced from mesophase pitch show higher carbon yield, graphitization, crystal size and orientation of domains leading to increases in stiffness, electrical and thermal conductivities and lower coefficient of thermal expansion in comparison to PAN-based carbon fibers.

Conventional methods for mesophase pitch production involve a semi-batch pyrolysis of isotropic pitch, using elevated temperatures with vigorous stirring and long residence times. The fibers are produced by melt spinning the mesophase pitch, which then goes through several additional stages including stabilization (oxidation), carbonization and finally graphitization. The production of the precursor petroleum-based mesophase pitch material is typically accomplished through a series of reaction and separation stages, where the first stage is the conversion of the feedstock to isotropic (amorphous) pitch, a viscous aromatic hydrocarbon. The isotropic pitch is then transformed to an ordered (anisotropic), liquid crystalline material (discotic) called "mesophase pitch" through thermal and/or catalytic processes. Pyrolysis is the dominant commercial process and it is an energy intensive high-temperature (about 400° C. or greater) process that leads to cracking off of side chains, removal of volatiles, condensation, cyclization and dehydrogenation reactions that ultimately yield aromatic molecules capable of forming a discotic liquid crystal phase. Such a process typically requires long residence times at high temperatures, and is ill-suited for commodity-scale production. Typically, the rate of mesophase formation can be accelerated by vigorous sparging during the pyrolysis reaction, or by the addition of large aromatic species such as quinoline insolubles (QI) or catalyst particles.

Processes commonly used for accelerating the rate of mesophase formation have involved vigorous sparging of gases through the hot pitch, vigorous stirring, addition of reactive gases such as oxygen, and turbulent flow through a tubular reactor with short residence times. Hence, there is still a substantial need for a rapid, cost-effective, and energy efficient mesophase production process.

SUMMARY

In at least one embodiment, the present disclosure provides processes for enhancing the nucleation and/or the growth rate of mesophase in pitch compositions derived from hydrocarbon feedstocks. The processes comprise: reacting in a reaction zone a blend comprising an isotropic feed and a seeding agent, to produce a reacted pitch having a mesophase content of about 10 vol % to 100 vol %, based on the total volume of the reacted pitch, and a softening point ($T_{sp}$) below 400° C.; wherein the seeding agent is about 50 wt % or less, based on the total weight of the blend; wherein the seeding agent has a mesophase content of about 0.01 vol % to 100 vol %, based on the total volume of the seeding agent; separating the reacted pitch in a separation zone to produce: a first effluent comprising a mixture of gaseous products and liquid products; and a second effluent comprising a separated pitch having a mesophase content of about 10 vol % or greater, based on the total volume of the separated pitch, and a softening point $T_{sp}$ below 400° C.

In at least one embodiment, the present disclosure provides processes for enhancing the nucleation and/or the growth rate of mesophase in pitch compositions derived from hydrocarbon feedstocks. The processes comprise: reacting in a reaction zone, in a batch, semi-batch or continuous mode, a blend comprising an isotropic feed and a seeding agent, to produce a reacted pitch having a mesophase content of about 10 vol % to 100 vol %, based on the total volume of the reacted pitch, and a softening point $T_{sp}$ below 400° C.; wherein the seeding agent is about 50 wt % or less, based on the total weight of the blend; wherein the seeding agent has a mesophase content of about 0.01 vol % to 100 vol %, based on the total volume of the seeding agent; separating the reacted pitch in a separation zone to produce: a first effluent comprising a mixture of gaseous products and liquid products; and a second effluent comprising a separated pitch having a mesophase content of about 10 vol % or greater, based on the total volume of the separated pitch, a softening point $T_{sp}$ below 400° C., wherein the reacted pitch and/or the separated pitch are/is suitable for spinning into carbon fiber; and recycling at least a portion of the second effluent back to the reaction zone, wherein the separated pitch is used as the seeding agent.

In at least one embodiment, the present disclosure provides carbon fibers produced from a mesophase pitch having a softening point ($T_{sp}$) below 400° C.; wherein the mesophase pitch is produced in a reaction zone from a reaction blend comprising an isotropic feed and a seeding agent having a mesophase content of about 0.01 vol % to 100 vol %, based on the total volume of the seeding agent; and wherein the reaction blend comprises a seeding agent content of about 50 wt % or less, based on the total weight of the blend.

In at least one embodiment, the present disclosure provides carbon fiber composites comprised of a matrix produced from a mesophase pitch having a softening point ($T_{sp}$) below 400° C.; wherein the mesophase pitch is produced in a reaction zone from a reaction blend comprising an isotropic feed and a seeding agent having a mesophase content of about 0.01 vol % to 100 vol %, based on the total volume of the seeding agent; and wherein the reaction blend comprises a seeding agent content of about 50 wt % or less, based on the total weight of the blend.

In at least one embodiment, the present disclosure provides processes for 2-dimensional molecular characterization of mesophase pitches and tracking the distributions of single molecules within the mesophase pitches. The processes comprise: depositing a mesophase pitch onto a sample holder suitable for optical microscopy, wherein the mesophase pitch is produced by reacting in a reaction zone a blend comprising an isotropic feed and about 50 wt % or less of a seeding agent, based on the total weight of the blend, wherein the seeding agent has a mesophase content of about 0.01 vol % to 100 vol %, based on the total volume of the seeding agent, to produce the mesophase pitch at a mesophase content of about 0.01 vol % to 100 vol %, based on the total volume of the mesophase pitch, and a softening point $T_{sp}$ below 400° C.; heating the sample holder to a temperature above the softening point of the mesophase pitch; obtaining a 2-dimensional molecular characterization of the mesophase pitch; and tracking the distributions of single molecules within the mesophase pitch.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and having the benefit of this disclosure.

FIG. 5D (top) compares the change in $L_a$ (Å) as a function of pyrolysis time, and FIG. 5D (bottom) compares the "π-π stacking" or interlayer distance between the molecules $d_{\pi-\pi}$ (Å) as a function of the time (hours).

DETAILED DESCRIPTION

Figure 1:
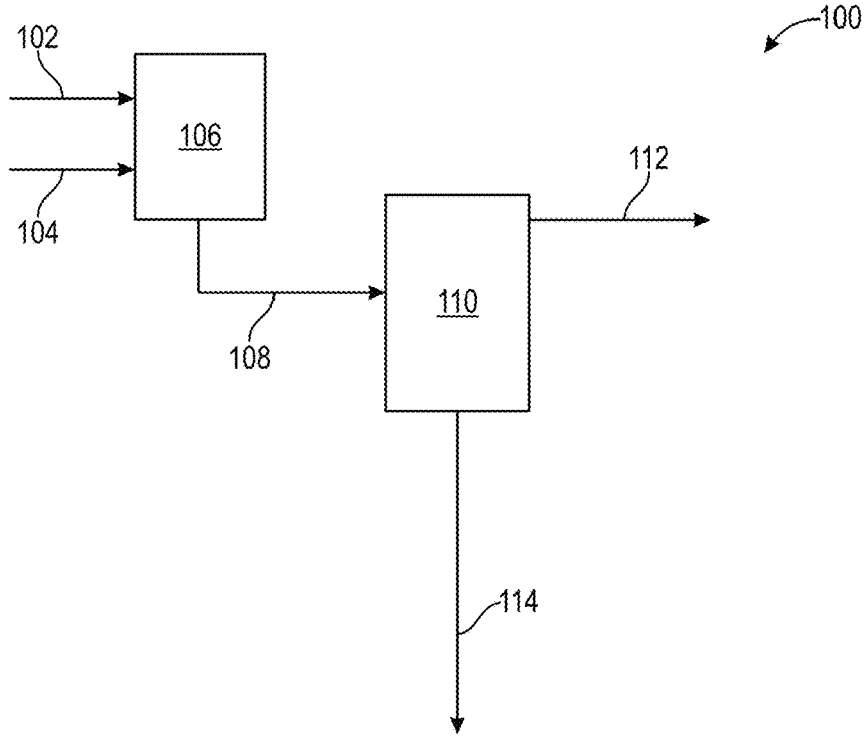
FIG. 1 is a non-limiting example flow diagram of a method 100 for enhancing mesophase growth rate to produce spinnable mesophase pitches of the present disclosure.

The present disclosure relates to methods for enhancing the nucleation and/or the growth rate of mesophase formation in pitch compositions derived from hydrocarbon feedstocks. Advantageously, the methods described herein include a seeding agent which enables the acceleration of the mesophase transformation during heat treatment (e.g., pyrolysis) of an isotropic feed (e.g., isotropic pitch) in a reaction zone. Hence, greater rates of mesophase formation can occur by the addition of mesophase pitch to an isotropic feed prior to pyrolysis. This addition, also referred to as "seeding", of the mesophase to the isotropic mixture can result in accelerated mesophase formation, potentially decreased costs for mesophase pitch production, decreased residence times, potentially decreased fouling and coking, and the potential to incorporate recycle streams into the process. Consequently, methods of the present disclosure enable cost-effective development of carbon products with improved properties (e.g., stiffness, strength, corrosion resistance, density, thermal and/or electrical conductivities) from mesophase pitch. The seeding agent can be formed from an unseeded isotropic pitch, and used to produce a blend comprising the same or a different unseeded isotropic pitch. The seeding agent can be added to an already formed mesophase pitch having a mesophase content of about 0.01 vol % to 100 vol %, based on the total volume of the mesophase pitch.

The seeding agent is a pre-made mesophase pitch, optionally produced from its corresponding unseeded isotropic feed (e.g., isotropic pitch), and the seeding agent may have a mesophase content of at least 0.01 vol %, based on the total volume of the seeding agent. The seeding agent has a mesophase content of about 0.01 vol % to 100 vol %, based on the total volume of the seeding agent, such as the seeding agent may have a mesophase content of about 60 vol % to 100 vol %, based on the total volume of the seeding agent.

The isotropic feed may comprise a nucleating agent that comprises heat treated isotropic pitch that has a mesophase content of 0 vol %, based on the total volume of the heat treated isotropic pitch. Advantageously, the nucleating agent may enhance the nucleation and/or the growth rate of the mesophase formation of a pitch derived from hydrocarbon feedstocks.

Having a seeding agent, and optionally a nucleating agent, readily available may advantageously allow a significant reduction of the pyrolysis time, thus minimizing/eliminating the onset of coke formation during pyrolysis of the hydrocarbon feedstock. Methods for enhancing the growth rate of mesophase formation do not require any removal of the seeding agent after the conversion process, thus enabling the direct spinning of the mesophase pitch produced herein into a pitch fiber, or the direct use in other carbon-based product applications requiring mesophase pitch. Additionally or alternatively, the mesophase pitch formed therein can be directly recycled back to the reaction zone and used as seeding agent, thus providing energy efficient process configurations to enable continuous mesophase production.

Without being bond by any theory, it is believed that, along with the seeding agent, the presence of free radicals formed during the heat treatment contributed to the conversion process into mesophase, thus by initiating faster reactivity of the pitch, enabling more chemical reactions (e.g., formation of aromatic molecules) within the pitch, and contributing to the acceleration of the rate of the reaction. Consequently, upon heat treatment the molecular weight and size distributions, as well as the aromaticity, of the seeded pitch samples rapidly increased as a function of time, when compared to the non-seeded pitch samples, remarkably at the early stage of the heat treatment.

Definitions and Test Methods

The new notation for the Periodic Table Groups is used as described in Chemical and Engineering News, 63(5), 27 (1985).

The following abbreviations are used herein: MCB is main column bottoms; HDT-SCT is hydrotreated steam cracker tar; HDT-MCB is hydrotreated main column bottoms; SCT is steam cracker tar; VR is vacuum residue; DSC is differential scanning calorimetry; SAXS is small angle X-ray scattering; WAXS is wide-angle X-ray scattering; $T_g$ is glass transition temperature, $T_{sp}$ is softening point temperature; MCRT is microcarbon residue test; Pa·s is Pascal-second; wt % is weight percent; vol % is volume percent; MPa is megapascal; WHSV is weight hourly space velocity; arb. units is arbitrary units; N/A is not applicable; N/D is not determined.

All numerical values within the detailed description and the claims herein are modified by "about" or "approximately" with respect to the indicated value, and take into account experimental error and variations that would be expected by a person having ordinary skill in the art. Unless otherwise indicated, ambient temperature (room temperature) is from about 18° C. to about 20° C.

As used in the present disclosure and claims, the singular forms "a," "an," and "the" include plural forms unless the context clearly dictates otherwise.

The term "and/or" as used in a phrase such as "A and/or B" herein is intended to include "A and B," "A or B," "A," and "B."

Where the term "between" is used herein to refer to ranges, the term encompasses the endpoints of the range. That is, "between 2% and 10%" refers to 2%, 10% and all percentages between those terms.

The term "independently," when referenced to selection of multiple items from within a given Markush group, means that the selected choice for a first item does not necessarily influence the choice of any second or subsequent item. That is, independent selection of multiple items within a given Markush group means that the individual items may be the same or different from one another.

As used herein, the term "pitch" refers to a high-boiling complex mixture of mainly aromatic and alkyl-substituted aromatic compounds that are glassy materials at ambient temperature and have a softening point above 50° C. These aromatic compounds are primarily hydrocarbons, but heteroatoms and metals can be present within these materials. When cooled from a melt, a pitch solidifies into amorphous phase due to compositional heterogeneity. Pitches may include petroleum pitches, coal tar pitches, natural asphalts, pitches contained as by-products in the naphtha cracking industry, pitches of high carbon content obtained from petroleum asphalt and other substances having properties of pitches produced as products in various industrial production processes. Pitches exhibit a broad softening temperature range and are typically derived from petroleum, coal tar, plants, or catalytic oligomerization of small molecules (e.g., acid-catalyzed oligomerization). A pitch can also be referred to as tar, bitumen, or asphalt. When a pitch is produced from plants, it is also referred to as resin. Various pitches may be obtained as products in the gas oil or naphtha cracking industry as a carbonaceous residue consisting of a complex mixture of primarily aromatic organic compounds, which are solid at room temperature, and exhibit a relatively broad softening temperature range. Hence, a pitch can be obtained from heat treatment and distillation of petroleum fractions. A "petroleum pitch" refers to the residuum carbonaceous material obtained from distillation of crude oils and from the catalytic cracking of petroleum distillates. A "coal tar pitch" refers to the material obtained by distillation of coal.

As used herein, the term "mesophase" refers to a liquid crystalline material consisting of planar disc-like aromatic molecules (e.g., discotic liquid crystal) of broader molecular weight and size distributions. A "mesophase pitch" refers to a biphasic material (both isotropic and anisotropic) with mesophase content reaching up to 100 vol %, based on the total volume of the pitch. The mesophase exhibits optical anisotropy when examined using a polarized light microscope. The optical anisotropy of the mesophase can be used to measure its volumetric concentration within the pitch via direct observation using reflected polarized light microscopy, once the pitch has been embedded in epoxy and polished until mirror-smooth.

As used herein, the term "seeding agent" refers to a mesophase pitch able to enhance the nucleation and/or the growth rate of the mesophase formation of a pitch derived from hydrocarbon feedstocks. The mesophase pitch may have a mesophase content of about 0.01 vol % to 100 vol %, based on the total volume of the mesophase pitch.

As used herein, the term "nucleating agent" refers to an isotropic pitch that has been heat treated (e.g., pyrolysis), yet hasn't converted into a mesophase pitch. Of note, in some cases mesophase pitch with an isotropic contribution can also act as a nucleating agent; in that case it is believed that the mesophase contribution assists with growth rate (growth enhancement) while the isotropic contribution tends to assist with nucleation (nucleating agent). Purely isotropic pitch only acts as nucleating agent. The nucleating agent can be used to enhance the nucleation and/or the growth rate of the mesophase formation of a pitch derived from hydrocarbon feedstocks.

As used herein, "heat treated isotropic pitch" refers to a pitch that has begun to grow in terms of molecular weight and to rearrange into a pitch that is organized but has not yet become mesophase.

The term "blend" as used herein refers to a mixture of two or more pitches. Blends may be produced by, for example, solution blending, melt mixing in a heated mixer, physically blending a pitch in its liquid state and a different pitch in its solid state, or physically blending the pitches in their solid forms. Suitable solvents for solution blending can include benzene, toluene, naphthalene, xylenes, pyridine, quinoline, aromatic cuts from refining, or chemicals processes such as decant oil, reformate, tar distillation cuts, and so on. Solution blending, solid state blending, and/or melt blending may occur at a temperature of from about 20° C. to about 400° C.

As used herein, "hydroprocessing" refers to a process that uses a hydrogen-containing gas with suitable catalyst(s) for a particular application. All hydroprocessing technologies consume hydrogen and typically convert heavy oil fractions into lighter and more valuable products. In many instances, hydroprocessing is generally accomplished by contacting the selected feedstock in a reaction vessel or zone with the suitable catalyst under conditions of elevated temperature and pressure in the presence of hydrogen. It includes hydrotreating and hydrocracking.

As used herein, "hydrotreating" refers to a process in which hydrogen gas is contacted with a hydrocarbon stream in the presence of suitable catalysts which are primarily active for the removal of heteroatoms, such as sulfur (i.e, hydrodesulfurization), nitrogen (i.e., hydrodenitrification), and metals (i.e., hydrodemetallization) from the hydrocarbon feedstock. In hydrotreating, hydrocarbons with double and triple bonds may be saturated.

As used herein, "thermoset matrix", or "thermoset polymer", refers to a synthetic polymer reinforcement typically transformed from a liquid state to a solid state through a non-reversible chemical change. A thermoset matrix may also include cement, concrete, ceramic, glasses, pitch, metal, or metal alloys. A thermoset matrix can be incorporated with resins such as polyesters, vinyl esters, epoxies, bismaleimides, cyanate esters, polyimides or phenolics. When cured by thermal and/or chemical (catalyst or promoter) or other means, the thermoset matrix become substantially infusible and insoluble. After cure, a thermoset matrix cannot be returned to its uncured state. Composites made with thermoset matrices are strong and have very good fatigue strength. Such composites can be extremely brittle and may have low impact-toughness. For example, thermoset matrix can be used for high-heat applications and/or chemical resistance is needed.

As used herein, "thermoplastic matrix", or "thermoplastic polymer", refers to polymers that can be molded, melted, and remolded without altering its chemical structure. In some cases, a thermoplastic matrix can be tougher and less brittle than thermosets, with very good impact resistance and damage tolerance. In some other cases, a thermoplastic matrix may be held below its glass transition temperature, thus may be glassy and very brittle. Since the matrix can be melted, the composite materials can be easier to repair and can be remolded and recycled easily. Thermoplastic matrix can be less dense than thermoset matrix, making them a viable alternative for weight critical applications.

As used herein, a "discotic nematic phase" refers to the thermodynamic phase that describes the carbonaceous mesophase in the discotic nematic liquid-crystal state. The carbonaceous mesophase is a complex multicomponent system composed of large disc-like polyaromatic molecules having a wide range of molecular weights rather than well-defined organic molecules. The mesophase domains formed in the pitches may only have a long-range orientational order with long range no translational order. Due to the disc-like shape of the molecules, the mesophase domains can order (or stack) through π-molecular (and electrostatic) interactions to form a discotic nematic phase, where the short molecular axis of the mesogens has an angle (θ) relative to the director orientation, n (preferred direction of a volume of the mesophase) at a given time.

Numerical ranges used herein include the numbers recited in the range. For example, the numerical range "from 1 wt % to 10 wt %" includes 1 wt % and 10 wt % within the recited range and all points within the range.

As used herein, a "glass transition temperature" ($T_g$) refers to a mid-point of the temperature at which a continuous step change in heat capacity (or peak at the first derivative of heat flow) is recorded on the second heating scan of a differential scanning calorimeter (DSC) experiment at 10° C./min heating and cooling rate. For purposes of the disclosure herein, $T_g$ may be measured using thermal analysis TA Instruments Q2000, as indicated.

The "softening point" ($T_{sp}$) refers to a temperature or a range of temperatures at which a substance softens. Herein, the softening point is measured using a Mettler Toledo dropping point instrument, such as Mettler Toledo DP70, according to a procedure analogous to ASTM D3104.

The "microcarbon residue test", also referred to as "MCRT", is a standard test method for the determination of carbon residue (micro method). The carbon residue value of the various petroleum materials serves as an approximation of the tendency of the material to form carbonaceous type deposits under degradation conditions similar to those used in the test method, and can be useful as a guide in manufacture of certain stocks. However, care needs to be exercised in interpreting the results. This test method covers the determination of the amount of carbon residue formed after evaporation and pyrolysis of petroleum materials under certain conditions and is intended to provide some indication of the relative coke forming tendency of such materials. Herein, the MCRT is measured according to the ASTM D4530-15 standard test method.

Two-dimensional X-ray scattering measurements can be performed in-house using a custom made X-ray scattering instrument equipped with a Rigaku Cu Kα (λ=1.542 Å) rotating anode X-ray generator (ultraX-18) and a 2D image plate detector (MAR345, marXperts GmbH). A 12-BM beamline at Advanced Photon source at Argonne National lab to run X-ray scattering measurements (λ=0.93 Å) can be used. The calibration of all the resultant 2-D SAXS and WAXS patterns can be achieved by using a silver behenate standard (d-spacing of 58.38 Å) and $LaB_6$ standard (a=4.156 Å) respectively. The data can be subsequently integrated into 1-D plots of scattered intensity (I) versus the scattering vector, q, where $q=4\pi \sin(\theta)/\lambda$. For X-ray data processing, Irena-Nika package can be used (e.g., described by J. Ilavsky and P. R. Jemian in *Journal of Applied Crystallography* (2009), volume 42, pages 347-353; and by J. Ilavsky in *Journal Of Applied Crystallography* (2012), volume 45(2), pages 324-328, which are incorporated herein by reference). The birefringence and the texture of the mesophase can be visualized by cross-polarized light microscopy (Leica DMLP microscope equipped with a full wave plate), where the macroscopic molecular ordering (spatial orientation of the mesogens) of the mesophase regions produce interference colors from the reflected polarized light components (o-rays and e-rays) that can be connected back to the path deference or retardation (Δ=thickness×birefrigence). Depending on the angular orientation of the cross-polars relative to the macro-molecular orientation (director orientation), transmitted intensity through the analyzer may vary and brilliant color patterns can be observed. Exploiting this, reflected polarized light microscopy can be a reliable means of directly observing and qualitatively accounting for the amount of mesophase present in a sample. Using a standard machine learning-based image segmentation workflow, the amount of mesophase observed in the optical micrographs can be quantified, using the two-dimensional area fraction as a proportionality of the material's volumetric concentration. The samples can be prepared for visualization by embedding the pitch in epoxy and polishing until mirror-smooth, increasing the reflectivity of the pitch.

Herein, the mesophase pitch compositions may comprise polyaromatic sheets which tend to form locally ordered associations with more or less parallel and/or equidistant sheets (stacks). The high angle scattering profile can be deconvoluted into two peak functions: a Lorenzian peak profile that captures mesophase domains and the isotropic fraction by a Gaussian profile (two isotropic contributions can provide a better fit for higher mesophase content of the mesophase pitch compositions). The small angle region may need multiple peaks (three Gaussian functions) to obtain a good match with the experimental data. From the mesophase Lorentz peak width (Δq), stack height ($L_C$) can be estimated by the formula;

$$L_C = K\frac{2\pi}{\Delta q};$$

the shape factor K is chosen to be unity. The number of molecules (N) in the stack can be estimated by, $$N = \frac{L_C}{d(002)} + 1.$$

The interplanar spacing, $$d(002) \text{ or } d_{\pi-\pi} = \frac{2\pi}{q(002)};$$

where q is the peak maximum.

The mesophase pitch composition of the present disclosure may have a stack height ($L_C$) of about 3 nm or greater (or about 3.25 nm or greater, or about 3.5 nm or greater, or about 3.75 nm or greater, or about 4 nm or greater, or about 4.25 nm or greater, or about 4.5 nm or greater). In some cases, The mesophase pitch composition of the present disclosure may have a stack height ($L_C$) of about 3 nm to about 9 nm, such as from about 3.5 nm to about 8.5 nm, such as from about 4 nm to about 8 nm, such as from about 4.5 nom to about 7.5 nm, such as from about 5 nom to about 7 nm.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the present disclosure embodiments disclosed herein are presented herein. Not all features of a physical implementation are described or shown in this application for the sake of clarity. It is understood that in the development of a physical embodiment incorporating the embodiments of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" or "having" various components or steps, the compositions and methods can also "consist essentially of" or "consist of" the various components and steps.

The seeding agent may have a mesophase content of about 0.01 vol % to 100 vol %, such as the seeding agent may have a mesophase content of about 60 vol % to 100 vol % (or about 65 vol % to about 95 vol %, or about 70 vol % to about 90 vol %, or about 75 vol % to about 85 vol %) based on the total volume of the seeding agent.

The seeding agent may be combined with an isotropic feed (e.g., isotropic pitch) to form a blend, wherein the blend may have a content of seeding agent of about 75 vol % or less (or 70 vol % or less, or 65 vol % or less, or 60 vol % or less, or 55 vol % or less, or 50 vol % or less, or 45 vol % or less, or 40 vol % or less, or 35 vol % or less, or 30 vol % or less, or 25 vol % or less, or 20 vol % or less, or 15 vol % or less, or 12 vol % or less, or 10 vol % or less, or 8 vol % or less, or 6 vol % or less, or 4 vol % or less, or 2 vol % or less, or 1 vol % or less, or 0.5 vol % or less), based on the total volume of the blend.

The isotropic feed may be selected from the group consisting of: main-column-bottom (MCB), hydrotreated main column bottom, steam cracker tar, hydrotreated steam cracker tar (HDT-SCT), crude oils, hydrotreated crude oils, coal tar pitch, petroleum pitch, vacuum residue (VR), atmospheric residue, asphalt, asphaltenes, bitumen, reformate, coker gas oil, heavy coker gas oil, thermal tar, thermal distillation cuts, and any combination thereof.

The seeding agent may have a mesophase content of 100 vol % or less (or 95 vol % or less, or 90 vol % or less, or 85 vol % or less, or 80 vol % or less, or 75 vol % or less, or 70 vol % or less, or 65 vol % or less, or 60 vol % or less, or 55 vol % or less, or 50 vol % or less, or 45 vol % or less, or 40 vol % or less, or 35 vol % or less, or 30 vol % or less, or 25 vol % or less, or 20 vol % or less, or 15 vol % or less, or 10 vol % or less, or 5 vol % or less), based on the total volume of the seeding agent. For example, the seeding agent may have a mesophase content of about 0.01 vol % to 100 vol % (or about 0.1 vol % to 100 vol %, or about 0.25 vol % to about 95 vol %, or about 0.5 vol % to about 90 vol %, or about 0.75 vol % to about 85 vol %, or about 1 vol % to about 80 vol %, or about 1.5 vol % to about 75 vol %, or about 2 vol % to about 70 vol %, or about 2.5 vol % to about 65 vol %, or about 3 vol % to about 60 vol %, or about 3.5 vol % to about 55 vol %, or about 4 vol % to about 50 vol %, or about 4.5 vol % to about 45 vol %, or about 5 vol % to about 40 vol %), based on the total volume of the mesophase pitch. In at least one embodiment, the seeding agent has a mesophase content of about 60 vol % to 100 vol %, based on the total volume of the seeding agent.

The nucleating agent may be present in the isotropic feed at a volume ratio isotropic feed/nucleating agent of about 50:50 to about 99.9:0.1 (or about 55:45 to about 99.9:0.1, or about 60:40 to about 99.9:0.1, or about 65:35 to about 99.9:0.1, to about 70:30 to about 99.9:0.1, or about 75:25 to about 99.9:0.1, or about 80:20 to about 99.9:0.1, or about 85:15 to about 99.9:0.1, or about 86:14 to about 99.5:0.5, or about 87:13 to about 99:1, or about 88:12 to about 98:2, or about 89:11 to about 97:3, or about 90:10 to about 95:5, or about 90:10 to about 99.9:0.1, or about 95:5 to about 99.9:0.1, or about 98:2 to about 99.9:0.1, or about 99:1 to about 99.5:0.5). The nucleating agent (heat-treated portion of the isotropic pitch) may be present in the isotropic feed at a volume content of from about 0.1 vol % (nearly mesophase only) to about 99.9 vol % (nearly isotropic phase only).

In some cases, the seeding agent may be formed from an isotropic feed different than its corresponding unseeded isotropic feed. In some other cases, the seeding agent may be blended with a mesophase pitch having a mesophase content of about 0.1 vol % or greater, based on the total volume of the mesophase pitch. Seeding agent with low mesophase content (e.g., mesophase content of about 1 vol % or less, based on the total volume of the seeding agent) can enable nucleation rate enhancement, can increase the pace of mesophase formation due to the growth of already added mesophase in the seeding agent.

Generally, the present disclosure relates to the methods for efficiently producing mesophase pitch with enhanced nucleation and/or growth rate of mesophase formation, the methods comprising: reacting (e.g., heat treating; slurry hydrocracking; acid-catalyzed treatment such as hydrotreating or acid-catalyzed oligomerization (e.g., superacid, aluminum trichloride, acidic ionic liquids, solid acid, and the like); pyrolyzing) a blend comprising an isotropic feed (e.g., isotropic pitch) and a seeding agent having a mesophase content of at least 0.01 vol % or greater, based on the total volume of the seeding agent, in a reaction zone to produce a mesophase pitch; separating the mesophase pitch in a separation zone to produce: an effluent comprising a mixture of solvent, gaseous products, and liquid products; and a bottoms product stream comprising a mesophase pitch product having a mesophase content of about 10 vol % or greater, based on the total volume of the mesophase pitch product, and a softening point $T_{sp}$ below 400° C., wherein the mesophase pitches can be suitable for spinning into carbon fiber.

Particularly, the present disclosure provides a process comprising: reacting (e.g., pyrolizing; heat treating; hydrotreating; etc.) in a reaction zone a blend comprising an isotropic feed and a seeding agent, to produce a reacted pitch having a mesophase content of about 10 vol % to 100 vol %, based on the total volume of the reacted pitch, and a softening point ($T_{sp}$) below 400° C.; wherein the seeding agent is about 50 wt % or less, based on the total weight of the blend; wherein the seeding agent has a mesophase content of about 0.01 vol % to 100 vol %, such as about 60 vol % to 100 vol %, based on the total volume of the seeding agent; separating the reacted pitch in a separation zone to produce: a first effluent comprising a mixture of gaseous products and liquid products; and a second effluent comprising a separated pitch having a mesophase content of about 10 vol % or greater, based on the total volume of the separated pitch, and a softening point $T_{sp}$ below 400° C. The isotropic feed may further comprise a nucleating agent that comprises heat treated isotropic pitch that has a mesophase content of 0 vol %, based on the total volume of the heat treated isotropic pitch.

The seeding agent is a mesophase pitch produced from at least a portion of an isotropic pitch that is the same or different than the isotropic feed. In some cases, the first mesophase pitch can be used as the seeding agent. In some other cases, the second mesophase pitch can be used as the seeding agent. The blend may have a volume ratio isotropic feed/seeding agent of about 50:50 to about 99.9:0.1. The blend may have a seeding agent content of about 0.5 wt % to about 40 wt %, based on the total weight of the blend. Herein, separating the first mesophase pitch may be one or more of: distillation, deasphaltenation, chromatographic separation, centrifugation, membrane-filtration, or a combination thereof. Methods of the present disclosure may further comprise: recycling at least a portion of the bottoms product stream, which comprises the second mesophase pitch, upstream of the reaction zone, wherein the bottoms product stream is used as the seeding agent.

The reaction zone may consist of running a batch, semi-batch, continuous stirred-tank reactor, tubular, fixed-bed reactor, bubble column reactor, or a slurry reactor. Further, the reaction zone may be selected from a group consisting of: a slurry-phase hydrocracking, a steam pyrolysis process, pyrolysis process, slurry-phase dealkylation process or a combination thereof.

X-ray scattering and polarized light microscopy (PLM) measurements can capture the enhanced mesophase growth rate due to the additive, the structural transformations, and nucleation kinetics occurring during pyrolysis, and the growth of mesophase domains. The increased mesophase conversion rate can be confirmed by X-ray scattering contrast resulting from the π-π stacking of disc-like molecules in the mesophase domains. Further, optical anisotropy (i.e., birefringence) displayed by the mesophase domains can be observed and confirmed by PLM. The mesophase content can be quantified from the PLM images. Temperature, pressure, and viscosity can have significant effects on the mesophase production rate. Additionally, solubility aspects can also be critical for the phase separation process. For instance, higher molecular weight aromatic molecules may become less miscible with lower molecular weight fractions during pyrolysis. Thus, the ordering of more flat or disc-like aromatic molecular fractions can lead to mesophase formation, while less flat or smaller molecular weight fractions may be associated with the isotropic phase. Without being bound by any theory, the presence of the seeding agent may lead to faster intermolecular interactions between the larger molecular weight aromatic molecules and the seeding agent in the system such that the growth process initiates at earlier stages and proceeds at a much faster rate than processes that do not incorporate the seeding agent. Thus, incorporating a seeding agent into an isotropic feed (e.g., isotropic pitch) can enhance mesophase ordering. Herein, the mesophase pitch of the present disclosure can have a "π-π stacking" or interlayer distance between molecules $d_{\pi-\pi}$ (Å) of about 3.3 Å to about 5 Å, and/or scattering peak location at a scattering vector q ($Å^{-1}$) of about 1.25 $Å^{-1}$ to about 1.9 $Å^{-1}$.

In accordance with the present disclosure, methods described herein may be applicable to other process/product streams beyond carbon fiber manufacturing.

Various uses for the carbon fiber composites formed from the pitch compositions of the present disclosure are also discussed herein. Such a carbon fiber composite may be useful in numerous applications where weight reductions paired with strength and stiffness enhancements are desired. Said carbon fiber composite may also be useful in offshore drilling (e.g., offshore drilling for oil and gas production) to improve corrosion resistance, fatigue and heat resistance, production components including, but not limited to platforms, risers, tethers, anchors, drill stems or related equipment and systems. Additional product applications can include automotive (e.g., body parts such as deck lids, hoods, front end, bumpers, doors, chassis, suspension systems such as leaf springs, drive shafts), aerospace (aircraft and space systems), sports equipment (e.g., golf club, tennis racket, bikes, ski boards, snowboards, helmets, rowing or water skiing equipment), construction (non-structural and structural systems), military (e.g., flying drones, armor, armored vehicles, military aircraft), wind energy industries, energy storage applications, fireproof materials, carbon-carbon composites, carbon fibers, in many insulating and sealing materials used in construction and road building (e.g., concrete), turbine blades, light weight cylinders and pressure vessels, off-shore tethers and drilling risers, medical equipment, for example.

Methods for Enhancing Nucleation and/or Mesophase Growth Rate of a Pitch

As discussed above, the present disclosure relates to methods for enhancing the rate of mesophase formation (e.g., nucleation rate; growth rate) in pitch compositions derived from hydrocarbon feedstocks.

FIG. 1 is a non-limiting example flow diagram of a method 100 for enhancing the growth rate of mesophase formation in pitch compositions derived from hydrocarbon feedstocks of the present disclosure. Generally, the methods according to the present disclosure may comprise: reacting (e.g., heat treating; pyrolyzing; acid catalyzed treatments) in reaction zone 106 a blend comprising an isotropic feed 102 (e.g., isotropic pitch) and about 50 wt % or less of a seeding agent 104, based on the total weight of the blend, wherein the seeding agent has a mesophase content of about 60 vol % to 100 vol %, based on the total volume of the seeding agent, to produce a first mesophase pitch 108, also referred to as "a reacted pitch), at a mesophase content of about 10 vol % to 100 vol %, based on the total volume of the first mesophase pitch 108, and a softening point $T_{sp}$ below 400° C., at a mesophase growth rate enhancement of about 1% or greater (or about 5% or great, or about 10% or greater, or about 12% or greater, or about 14% or greater, or about 16% or greater, or about 18% or greater, or about 20% or greater, or about 22% or greater, or about 24% or greater, or about 26% or greater, or about 28% or greater, or about 30% or greater). Isotropic feed 102 may further comprise a nucleating agent (not shown) that comprises a heat treated isotropic pitch that has a mesophase content of 0 vol %, based on the total volume of the heat treated isotropic pitch.

For example, seeding agent 104 may have a mesophase content of about 0.01 vol % to about 100 vol % (or about 0.1 vol % to about 95 vol %, or about 0.1 vol % to about 90 vol %, or about 0.1 vol % to about 85 vol %, or about 0.1 vol % to about 80 vol %, or about 0.1 vol % to about 75 vol %, or about 0.1 vol % to about 70 vol %, or about 0.1 vol % to about 65 vol %, or about 0.1 vol % to about 60 vol %, or about 0.1 vol % to about 55 vol %, or about 0.1 vol % to about 50 vol %, or about 0.1 vol % to about 45 vol %, or about 0.1 vol % to about 40 vol %, or about 0.1 vol % to about 35 vol %, or about 0.1 vol % to about 30 vol %, or about 0.1 vol % to about 25 vol %, or about 0.1 vol % to about 20 vol %, or about 0.1 vol % to about 18 vol %, or about 0.5 vol % to about 16 vol %, or about 1 vol % to about 14 vol %, or about 1.5 vol % to about 12 vol %, or about 2 vol % to about 10 vol %, or about 2.5 vol % to about 8 vol %, or about 3 vol % to about 6 vol %, such as seeding agent 104 may have a mesophase content of about 60 vol % to 100 vol %), based on the total volume of the seeding agent 104; separating first mesophase pitch 108 in a separation zone 110 to produce: an effluent of distillate products 112 comprising a mixture of gaseous products and liquid products; and a second mesophase pitch 114 having a mesophase content of about 10 vol % or greater, based on the total volume of the second mesophase pitch, and a softening point $T_{sp}$ below 400° C., wherein the second mesophase pitch is suitable for spinning into carbon fiber.

More specifically, seeding agent 104 is a mesophase pitch produce from at least a portion of the isotropic feed 102. Seeding agent 104 is produced separately from isotropic feed 102 by heat treating at 400° C. for a period of time sufficient to form mesophase. The independently synthesized seeding agent 104 is added to isotropic feed 102 at a given ratio as needed, and rigorously blended together by melt blending or solution blending. The combined seeding agent 104 and isotropic feed 102 are then heat treated under similar conditions as the unseeded isotropic feed 102 to produce mesophase in shorter periods of time than otherwise possible.

Isotropic feed 102 may be selected from the group consisting of: main-column-bottom (MCB), hydrotreated main column bottom, steam cracker tar, hydrotreated steam cracker tar (HDT-SCT), crude oils, hydrotreated crude oils, coal tar pitch, petroleum pitch, vacuum residue (VR), atmospheric residue, asphalt, asphaltenes, bitumen, reformate, coker gas oil, heavy coker gas oil, thermal tar, thermal distillation cuts, and any combination thereof. Thus, isotropic feed 102 may be formed from a variety of heavy oil and/or heavy hydrocarbonaceous fractions that include a substantial portion of aromatics. The aromatic carbons content may vary, depending on the feed. For example, the aromatic carbons content can be from about 20% to about 40% when the feed is composed of vacuum residues, or from about 50% to 70% when the feed is composed of isotropic pitch, or from about 45% to about 55% when the feed comprises main column bottoms (MCB). Some heavy oil fractions can be suitable without further processing (e.g., fractions that can be solvent extracted to produce a mesophase pitch), while other fractions can be at least partially converted to mesophase pitch feeds by heat treatment and/or performing a limited oligomerization. Suitable fractions for use as pitch and/or for forming mesophase pitch can include, but are not limited to, heavy oils, coal tar fractions formed during conversion of coal to coke; bottoms fractions from fluid catalytic cracking; steam cracker tar; pitch formed from acid-catalyzed oligomerization reactions (e.g., superacid, aluminum trichloride, acidic ionic liquids, solid acids, etc.); pitch formed from air-blowing reactions; pitch formed during slurry hydroconversion and/or fixed bed hydroconversion (such as hydroconversion of heavy oils); and/or "rock" fractions generated during solvent deasphalting of a heavy oil. Hydroprocessing and hydrotreating any of the above streams can be also envisioned. More generally, pitch fractions for formation of carbon fiber can be formed from any of the above sources.

The blend may have a volume ratio isotropic feed 102/seeding agent 104 of about 50:50 to about 99.9:0.1 (or about 55:45 to about 99.9:0.1, or about 60:40 to about 99.9:0.1, or about 65:35 to about 99.9:0.1, to about 70:30 to about 99.9:0.1, or about 75:25 to about 99.9:0.1, or about 80:20 to about 99.9:0.1, or about 85:15 to about 99.9:0.1, or about 86:14 to about 99.5:0.5, or about 87:13 to about 99:1, or about 88:12 to about 98:2, or about 89:11 to about 97:3, or about 90:10 to about 95:5, or about 90:10 to about 99.9:0.1, or about 95:5 to about 99.9:0.1, or about 98:2 to about 99.9:0.1, or about 99:1 to about 99.5:0.5). The blend may comprise a seeding agent 104 content of about 15 vol % or less (or about 12 vol % or less, about 10 vol % or less, about 8 vol % or less, about 6 vol % or less, about 4 vol % or less, about 2 vol % or less, about 1 vol % or less, about 0.5 vol % or less), based on the total volume of the blend.

The nucleating agent (not shown) may be present in isotropic feed 102 at a volume ratio isotropic feed 102/nucleating agent of about 50:50 to about 99.9:0.1 (or about 55:45 to about 99.9:0.1, or about 60:40 to about 99.9:0.1, or about 65:35 to about 99.9:0.1, to about 70:30 to about 99.9:0.1, or about 75:25 to about 99.9:0.1, or about 80:20 to about 99.9:0.1, or about 85:15 to about 99.9:0.1, or about 86:14 to about 99.5:0.5, or about 87:13 to about 99:1, or about 88:12 to about 98:2, or about 89:11 to about 97:3, or about 90:10 to about 95:5, or about 90:10 to about 99.9:0.1, or about 95:5 to about 99.9:0.1, or about 98:2 to about 99.9:0.1, or about 99:1 to about 99.5:0.5). The nucleating agent (heat-treated portion of the isotropic pitch) may be present in the isotropic feed at a volume content of from about 0.1 vol % (nearly mesophase only) to about 99.9 vol % (nearly isotropic phase only).

The blends described above may be produced by mixing isotropic feed 102 with seeding agent 104 (as described above), by connecting reactors together in series to make reactor blends, for example, or by mixing streams of the separator with feed streams either in a separate zone, or in line. The isotropic feed 102 and seeding agent 104 can be mixed together prior to being put into reaction zone 106 or may be mixed in reaction zone 106. Reaction zone 106 can be a fixed-bed reactor, a continuous stirred tank reactor, a tubular reactor, an autoclave, a semi-batch reactor, a slurry reactor. Reaction zone 106 may contain hydrogen, nitrogen, air, steam, and any combination of any number of these or other inert gases.

The heat treatment (e.g., pyrolysis) can be run in a batch, semi-batch, or continuous mode. Further, reaction zone 106 may be selected from the group consisting of: a slurry-phase hydrocracking, pyrolysis, hydrotreating, a steam pyrolysis process, and any combination thereof. The reaction zone may be controlled catalytically, thermally, and any combination thereof. Thus, reaction zone 106 may contain only one catalyst, or several catalysts in combination.

Reaction zone 106 may be use under the following conditions: a partial pressure of hydrogen of about 20 MPa or less (or 18 MPa or less, or 16 MPa or less, or 14 MPa or less, or 12 MPa or less, or 10 MPa or less, or 9 MPa or less, or 8 MPa or less, or 7 MPa or less, or 6 MPa or less, or 5 MPa or less, or 4 MPa or less, or 3 MPa or less, or 2 MPa or less, or 1 MPa or less), a temperature in the range of about 100° C. to about 600° C. (or about 125° C. to about 575° C., or about 150° C. to about 550° C., or about 175° C. to about 525° C., or about 200° C. to about 500° C., or about 220° C. to about 480° C., or about 240° C. to about 460° C., or about 260° C. to about 440° C., or about 280° C. to about 420° C., or about 300° C. to about 400° C.), a pressure in the range of about 0.0005 MPa to about 25 MPa (or about 0.005 MPa to about 22.5 MPa, or about 0.005 MPa to about 20 MPa, or about 0.05 MPa to about 17.5 MPa, or about 0.1 MPa to about 15 MPa, or about 0.5 MPa to about 12.5 MPa, or about 1 MPa to about 10 MPa, or about 2 MPa to about 8 MPa, or about 0.1 MPa to about 20 MPa, or about 0.5 MPa to about 15 MPa, or about 1 MPa to about 15 MPa), a residence time of 0.25 minutes or greater (or 1 minutes or greater, or 2 minutes or greater, or 5 minutes or greater, or 10 minutes or greater, or 20 minutes or greater, or 30 minutes or greater, or 1 hour or greater, or 2 hours or greater, or 3 hours or greater, or 4 hours or greater, or 5 hours or greater, or 6 hours or greater, or 12 hours or greater, or 24 hours or greater, or 32 hours or greater), or a WHSV in the range of 0.1 $hr^{-1}$ to 4 $hr^{-1}$ (or 0.2 $hr^{-1}$ to 3.8 $hr^{-1}$, or 0.4 $hr^{-1}$ to 3.6 $hr^{-1}$, or 0.6 $hr^{-1}$ to 3.4 $hr^{-1}$, or 0.8 $hr^{-1}$ to 3.2 $hr^{-1}$, or 1 $hr^{-1}$ to 3 $hr^{-1}$). For example, the pyrolysis in reaction zone 106 can be carried out at a residence time of about 2 hours to 24 hours.

Further, reaction zone 106 may employ catalysts to accelerate the growth of aromatic compounds. The acid catalyst may be selected from the group consisting of: HF, $HF/BF_3$, $H_2SO_4$, acidic ionic liquids, sulfated zirconia, chlorided alumina, or zeolites. Additionally or alternately, reaction zone 106 can use a catalyst system to hydrotreat and/or hydrogenate the hydrocarbons comprising: one or more transition metal catalysts comprising a group 5, 6, 9, 10 transition metal; and one or more supports. The one or more transition metal catalysts may be selected from the group consisting of: Pt, Pd, W, V, Co, Ni, or Mo. The catalyst systems suitable for use in the disclosure herein may include a catalyst comprising one or more transition metal catalysts and one or more solid supports. The solid supports may allow a catalytic reaction, such as hydrotreatement of a pitch feedstock, to be conducted under heterogeneous conditions. In more specific embodiments, the solid support may be silica. Other suitable solid supports may include, but are not limited to, alumina, silica-alumina, porous carbons, zeolites, zirconia, titania, and refractory oxide.

Reaction zone 106 may use a hydrogen-donor solvent, which may contain at least one single-ring aromatic compound.

First mesophase pitch 108 may have a mesophase content greater than 5 vol % (or 10 vol % or greater, or 15 vol % or greater, or 20 vol % or greater, or 25 vol % or greater, or 30 vol % or greater, or 35 vol % or greater, or 40 vol % or greater, or 45 vol % or greater, or 50 vol % or greater, or 55 vol % or greater, or 60 vol % or greater, or 65 vol % or greater, or 70 vol % or greater, or 75 vol % or greater, or 80 vol %, or 85 vol % or greater, or 90 vol % or greater, or 95 vol % or greater, or 98 vol % or greater), based on the total volume of the first mesophase pitch 108.

First mesophase pitch 108 may have a carbon residue content of from about 20 wt % to about 99 wt %, such as from 30 wt % to 99 wt %, such as from 40 wt % to 99 wt %, such as from 50 wt % to 99 wt %, such as from 50 wt % to 95 wt %, such as from 50 wt % to 90 wt %, such as from 50 wt % to 85 wt %, and such as from 50 wt % to 80 wt %, based on the total weight of the first mesophase pitch 108.

First mesophase pitch 108 may have a hydrogen content of from about 3 wt % to about 12 wt % (or about 3.5 wt % to about 11 wt %, or about 4 wt % to about 10 wt %, or about 4.5 wt % to about 9 wt %, or about 5 wt % to about 9 wt %, or about 6 wt % to about 8 wt %, or about 8 wt % to about 11 wt %, or about 8 wt % to about 10 wt %), a sulfur content of from 0 wt % to about 1 wt % (or about 0 wt % to about 0.8 wt %, or about 0 wt % to about 0.6 wt %, or about 0 wt % to about 0.4 wt %, or about 0 wt % to about 0.2 wt %, or about 0 wt % to about 0.1 wt %), based on the total weight of the first mesophase pitch 108.

First mesophase pitch 108 may have a softening point ($T_{sp}$) of less than 400° C. (or 350° C. or less, or 300° C. or less, or 250° C. or less, or 200° C. or less, or 150° C. or less, or 100° C. or less), as determined according to a procedure analogous to the ASTM D3104 test method, wherein the procedure can be carried out under nitrogen, at a 2° C./min ramp rate up to a temperature of 400° C.

First mesophase pitch 108 may have a glass transition temperature ($T_g$) of 315° C. or less (or 275° C. or less, 235° C. or less, or 195° C. or less, or 155° C. or less, or 115° C. or less, or 75° C. or less), as determined using the second heating scan of a differential scanning calorimetry (DSC) experiment at 10° C./min heating and cooling rate performed under inert atmosphere ($N_2$).

First mesophase pitch 108 may have a T10 (also referred to as the temperature at which 50 wt % of the material has been removed), in the range of 200° C. to 650° C. (or 200° C. to 625° C., or 225° C. to 600° C., or 225° C. to 575° C., or 250° C. to 550° C., or 275° C. to 525° C., or 300° C. to 500° C., or 325° C. to 475° C., or 350° C. to 450° C., or 375° C. to 425° C., or 225° C. to 375° C., or 250° C. to 350° C., or 275° C. to 325° C.).

Further, polarized light microscopy (PLM) measurements and X-ray scattering data of the blend comprising isotropic feed 102 and seeding agent 104, while undergoing reaction (e.g., pyrolysis at 400° C.), indicate mesophase domains displaying optical anisotropy (birefringence), thus revealing better ordering and larger spatial correlations in the system due to π-π stacking of the disc-like molecules in the mesophase domains. The scattering peak positions determined the interplanar spacing (π-π stacking distance) and the average spacing between the aromatic molecules ($L_a$).

First mesophase pitch 108 may have an "average spacing" between molecules $L_a$ (Å) of about 5 Å to about 50 Å (or about 5 Å to about 45 Å, or about 5 Å to about 40 Å, or about 5 Å to about 35 Å, or about 5 Å to about 30 Å, or about 5 Å to about 25 Å, or about 5 Å to about 20 Å, or about 10 Å to about 50 Å, or about 11 Å to about 49 Å, or about 11 Å to about 45 Å, or about 11 Å to about 40 Å, or about 11 Å to about 35 Å, or about 12 Å to about 34 Å, or about 13 Å to about 33 Å, or about 14 Å to about 32 Å, or about 15 Å to about 31 Å, or about 15 Å to about 30 Å, or about 15 Å to about 29 Å, or about 15 Å to about 28 Å, or about 15 Å to about 27 Å, or about 15 Å to about 26 Å, or about 15 Å to about 25 Å, or about 15 Å to about 24 Å, or about 15 Å to about 23 Å, or about 15 Å to about 22 Å, or about 15 Å to about 21 Å, or about 15 Å to about 20 Å, or about 10.2 Å to about 14.8 Å, or about 10.4 Å to about 14.6 Å, or about 10.6 Å to about 14.4 Å, or about 10.8 Å to about 14.2 Å, or about 11 Å to about 14 Å or about 11.2 Å to about 13.8 Å, or about 11.4 Å to about 13.6 Å, or about 11.6 Å to about 13.4 Å, or about 11.8 Å to about 13.2 Å, or about 12 Å to about 13 Å).

First mesophase pitch 108 may have a "π-π stacking distance" or interlayer distance between molecules $d_{\pi-\pi}$ (Å) at room temperature of about 2.5 Å to about 5 Å (or about 2.5 Å to about 4.5 Å, or about 3 Å to about 4 Å, or about 3.25 Å to about 4.5 Å, or about 3.25 Å to about 4.25 Å, or about 3.25 Å to about 4.00 Å, or about 3.25 Å to about 3.9 Å, or about 3.25 Å to about 3.8 Å, or about 3.25 Å to about 3.7 Å, or about 3.25 Å to about 3.6 Å, or about 3.25 Å to about 3.7 Å, or about 3.25 Å to about 3.5 Å). First mesophase pitch 108 may have a "π-π stacking" interlayer distance between molecules $d_{\pi-\pi}$ (Å) of about 3.3 Å to about 5 Å, such as about 3.3 Å to about 3.8 Å.

First mesophase pitch 108 may have "π-π stacking" scattering vector q ($Å^{-1}$) of about 1.2 $Å^{-1}$ to about 3 $Å^{-1}$ (or about 1.3 $Å^{-1}$ to about 2.7 $Å^{-1}$, or about 1.4 $Å^{-1}$ to about 2.5 $Å^{-1}$, or about 1.5 $Å^{-1}$ to about 2.4 $Å^{-1}$ or about 1.6 $Å^{-1}$ to about 2.3 $Å^{-1}$, about 1.7 $Å^{-1}$ to about 2.2 $Å^{-1}$). First mesophase pitch 108 may have scattering vector q ($Å^{-1}$) of about 1.25 $Å^{-1}$ to about 1.9 $Å^{-1}$.

Methods described herein comprise separating first mesophase pitch 108 in a separation zone 110. Separating first mesophase pitch 108 may be carried out in one or more separation processes. Suitable examples of separation processes may include, but are not limited to, distillation, deasphaltenation, chromatographic separation, centrifugation, membrane-filtration, and any combination thereof. First mesophase pitch 108 may be characterized as being relatively free of impurities and ash.

When separating is deasphalting, separation of first mesophase pitch 108 may be carried out in presence of a solvent to produce a first effluent comprising solvent and compounds 112, and a second effluent comprising a deasphalted bottom product 114, wherein the deasphalted bottom product 114 comprises a second mesophase pitch, also referred to as "a separated pitch".

Suitable diluents/solvents for separation by deasphalting can be selected from the group consisting of: straight and branched-chain hydrocarbons, and aromatic solvents such as isobutane, ethane, propane, butanes, pentanes, isopentane, hexanes, isohexane, heptanes, octanes, dodecanes, benzene, toluene, pyridine, quinoline and mixtures thereof, cyclic and alicyclic hydrocarbons, such as cyclohexane, cycloheptane, methylcyclohexane, methylcycloheptane, and mixtures thereof; perhalogenated hydrocarbons, such as perfluorinated $C_{4-10}$ alkanes, chlorobenzene, and aromatic and alkyl-substituted aromatic compounds, such as benzenes (e.g., dimethylbenzenes), toluene, mesitylene, and xylene; and polar solvents (e.g., acetone, N,N-dimethylformamide, acetonitrile, pyridine, quinoline, dimethyl sulfoxide, N-methylpyrolidone, and mixtures thereof), aromatic cuts from refining, or chemicals processes such as decant oil, reformate, tar distillation cuts, or any isomers therefrom, and any combination thereof.

Second mesophase pitch 114 may have a mesophase content of about 0.1 vol % or greater (or about 0.5 vol % or greater, or about 1 vol % or greater, or about 1.5 vol % or greater, or about 2 vol % or greater, or about 2.5 vol % or greater, or about 5 vol % or greater, or 10 vol % or greater, or 15 vol % or greater, or 20 vol % or greater, or 25 vol % or greater, or 30 vol % or greater, or 35 vol % or greater, or 40 vol % or greater, or 45 vol % or greater, or 50 vol % or greater, or 55 vol % or greater, or 60 vol % or greater, or 65 vol % or greater, or 70 vol % or greater, or 75 vol % or greater, or 80 vol %, or 85 vol % or greater, or 90 vol % or greater, or 95 vol % or greater, or 98 vol % or greater), based on the total volume of second mesophase pitch 114. Second mesophase pitch 114 may have a mesophase content of about 0.1 vol % to about 100 vol %, such as about 10 vol % to about 100 vol %, such as about 20 vol % to about 100 vol %, based on the total volume of second mesophase pitch 114.

Second mesophase pitch 114 may have a softening point ($T_{sp}$) of about 35° C. to about 450° C. (or about 50° C. to about 450° C., or about 100° C. to about 400° C., or about 125° C. to about 375° C., or about 150° C. to about 350° C., or about 175° C. to about 350° C., or about 200° C. to about 350° C., or about 210° C. to about 350° C., or about 220° C. to about 350° C., or about 230° C. to about 350° C., or about 240° C. to about 350° C., or about 250° C. to about 350° C., or about 260° C. to about 350° C., or about 270° C. to about 350° C., or about 280° C. to about 350° C., or about 290° C. to about 350° C., or about 300° C. to about 350° C., or about 310° C. to about 350° C., or about 320° C. to about 350° C., or about 125° C. to about 325° C., or about 150° C. to about 300° C., or about 175° C. to about 275° C., or about 200° C. to about 250° C.).

Second mesophase pitch 114 may have a glass transition temperature ($T_g$) of about 50° C. to about 315° C. (or about 75° C. to about 300° C., or about 90° C. to about 285° C., or about 105° C. to about 270° C., or about 120° C. to about 255° C., or about 135° C. to about 240° C., or about 150° C. to about 225° C., or about 165° C. to about 210° C., or about 180° C. to about 195° C., or about 65° C. to about 280° C., or about 70° C. to about 260° C., or about 75° C. to about 240° C., or about 80° C. to about 220° C., or about 100° C. to about 200° C.), as determined using the second heating scan of a differential scanning calorimetry (DSC) experiment at 10° C./min heating and cooling rate performed under inert atmosphere (e.g., $N_2$).

Second mesophase pitch 114 may have a T10 in the range of 200° C. to 650° C. (or 225° C. to 600° C., or 250° C. to 550° C., or 275° C. to 525° C., or 300° C. to 500° C., or 325° C. to 475° C., or 350° C. to 450° C., or 375° C. to 425° C., or 225° C. to 375° C., or 250° C. to 350° C., or 275° C. to 325° C.).

Second mesophase pitch 114 may have a carbon residue content of from 20 wt % to 99 wt %, such as from 30 wt % to 99 wt %, such as from 40 wt % to 99 wt %, such as from 50 wt % to 99 wt %, such as from 50 wt % to 95 wt %, such as from 50 wt % to 90 wt %, such as from 50 wt % to 85 wt %, and such as from 50 wt % to 80 wt %, based on the total weight of the second mesophase pitch 114.

Second mesophase pitch 114 may have a hydrogen content of from about 3 wt % to about 12 wt % (or about 3.5 wt % to about 11 wt %, or about 4 wt % to about 10 wt %, or about 4.5 wt % to about 9 wt %, or about 5 wt % to about 9 wt %, or about 6 wt % to about 8 wt %, or about 8 wt % to about 11 wt %, or about 8 wt % to about 10 wt %), 7 wt % to about 12 wt % (or about 8 wt % to about 11 wt %, or about 8 wt % to about 10 wt %), a sulfur content of from 0 wt % to about 5 wt % (or about 0 wt % to about 4 wt %, or about 0 wt % to about 3 wt %, or about 0 wt % to about 2 wt %, or about 0 wt % to about 1 wt %, or about 0 wt % to about 0.8 wt %, or about 0 wt % to about 0.6 wt %, or about 0 wt % to about 0.4 wt %, or about 0 wt % to about 0.2 wt %, or about 0 wt % to about 0.1 wt %), based on the total weight of the second mesophase pitch 114.

Advantageously, second mesophase pitch 114 does not require any further purification process (i.e., removal of seeding agent 104 is not required). Hence, second mesophase pitch 114 may be spun directly into a fiber without any further purification process, thus enabling second mesophase pitch 114 produced herein to be spun directly (i.e., as is) into a pitch fiber. The pitch fiber resulting from second mesophase pitch 114 can be further stabilized, carbonized, or graphitized. Alternatively, the second mesophase pitch 114 can be meltblown, or spunbond, into fibrous webs for nonwoven applications. The resulting fibrous web can further be stabilized, carbonized, or graphitized. Either of these fibers, or fibrous webs, can further be used in the production of composites wherein the fibers, or fibrous webs, can be combined with a matrix element to produce a composite product. The matrix used herein can be produced from a thermoset polymer (e.g., cyclopentadiene, dicyclopentadiene, epoxy, pitch, phenolic resins, vinylester, polyimide and polyesters), a thermoplastic polymer (e.g., a thermoplastic polymer including one or more of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide), cement, concrete, ceramic, metal, metal alloy, pitch, and any combination thereof. For example, a pitch itself can be used as a matrix and/or binder for producing a carbon fiber composite, thus enabling production of carbon-carbon composites.

Further, second mesophase pitch 114 can be used as a matrix in the production of a composite. For instance, a composite filler (e.g. carbon fiber, needle coke, etc.) may be combined with the second mesophase pitch 114 acting as the binder to form a product. Once the product formed, said product may be pyrolyzed to form a carbonized and/or graphitized product. This process may be repeated one or more times. Alternatively, the second mesophase pitch 114 can be loaded into a mold, and optionally saturated with a "blowing" agent, and then pyrolyzed to produce a foamed material. This foamed material can be stabilized, carbonized, graphitized, and any combination of any of these processes to yield a carbon foam. Hence, second mesophase pitch 114 can be used directly in the production of a composite, and/or used as a matrix material in the production of a composite such as a carbon-carbon composite, or carbon foam.

The thermoplastic polymer may be selected from the group consisting of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide, and any combination thereof.

Herein, a fiber, a carbon fiber, an oxidized fiber, carbonized fiber, graphitized fiber, fiber web, oxidized fiber web, carbonized fiber web, or graphitized fiber web can be prepared using the second mesophase pitch. Methods described herein may further comprise: producing a carbon article comprising the second mesophase pitch, or carbon fiber. Carbon fiber, carbon articles, and carbon fiber composites are described further below.

Second mesophase pitch 114 may be spun at a spinning temperature of about 30° C. to about 50° C. above the softening point of the second mesophase pitch 114. Second mesophase pitch 114 may be spun at a spinning temperature of about 150° C. or greater (or about 200° C. or greater, or about 225° C. or greater, or about 250° C. or greater, or about 275° C. or greater, or about 300° C. or greater, or about 325° C. or greater, or about 350° C. or greater).

Second mesophase pitch 114 may be spun using an extensional strain rate between 0.1 $s^{-1}$ and 100 $s^{-1}$ (or between 0.5 $s^{-1}$ and 90 $s^{-1}$, or between 0.5 $s^{-1}$ and 80 $s^{-1}$, or between 0.5 $s^{-1}$ and 70 $s^{-1}$, or between 0.5 $s^{-1}$ and 60 $s^{-1}$, or between 0.5 $s^{-1}$ and 50 $s^{-1}$, or between 0.5 $s^{-1}$ and 40 $s^{-1}$, or between 0.5 $s^{-1}$ and 30 $s^{-1}$, or between 0.5 $s^{-1}$ and 20 $s^{-1}$, or between 0.5 $s^{-1}$ and 18 $s^{-1}$, or between 1 $s^{-1}$ and 16 $s^{-1}$, or between 2 $s^{-1}$ and 14 $s^{-1}$, or between 3 $s^{-1}$ and 12 $s^{-1}$, or between 4 $s^{-1}$ and 10 $s^{-1}$, or between 6 $s^{-1}$ and 8 $s^{-1}$) during spinning.

The carbon fiber may be produced by spinning the second mesophase pitch 114 with one or more pitches. The one or more pitches may each have different softening point ($T_{sp}$) and or different have different viscosities.

Methods described herein provide carbon fibers with high-modulus, and high-strength.

Figure 2:
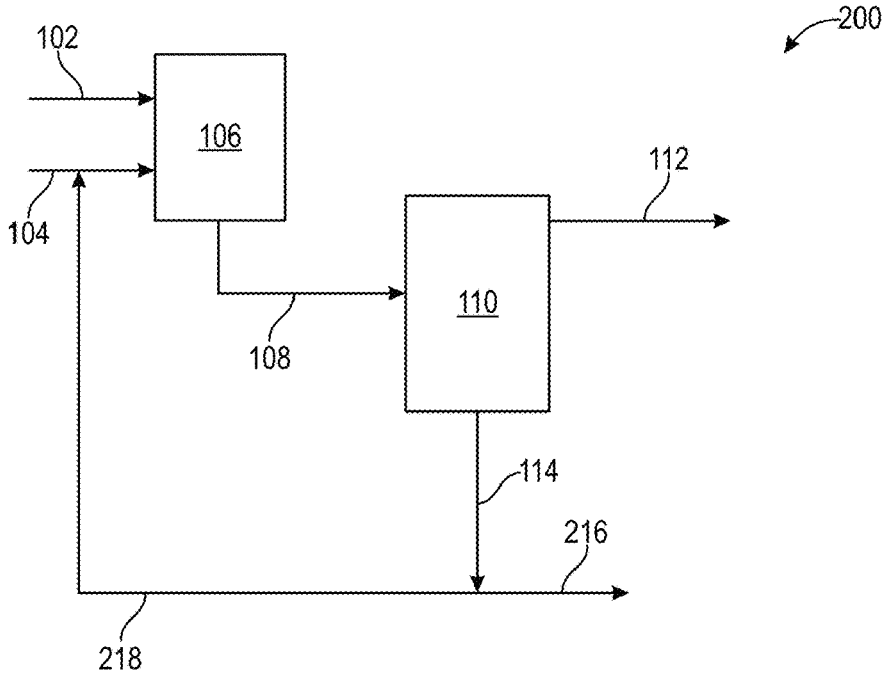
FIG. 2 is another non-limiting example flow diagram of a method 200 for enhancing mesophase growth rate to produce spinnable mesophase pitches of the present disclosure.

FIG. 2 is a non-limiting example flow diagram of a continuous process 200 for enhancing the growth rate of mesophase formation in pitch compositions derived from hydrocarbon feedstocks of the present disclosure. Process 200 in FIG. 2 differs from process 100 in FIG. 1 in that second mesophase pitch 114 is recycled back to the upstream of the reaction zone 106. In this process configuration, the second mesophase pitch 114 may serve as the seeding agent, if desired.

Generally, the methods according to the present disclosure may comprise: reacting (e.g., pyrolyzing) a blend comprising an isotropic feed 102 and a seeding agent 104, in a reaction zone 106 to produce a first mesophase pitch (also referred to as a reacted pitch) 108, wherein the blend has a content of the seeding agent 104 of about 0.5 wt % or greater, or about 1 wt % or greater, or about 5 wt % or greater, or about 10 wt % or greater, or about 12 wt % or greater, or about 14 wt % or greater, or about 16 wt % or greater, or about 18 wt % or greater, or about 20 wt % or greater, or about 22 wt % or greater, or about 24 wt % or greater, or about 26 wt % or greater, or about 28 wt % or greater, or about 30 wt % or greater), based on the total weight of the blend. The blend may have a content of the seeding agent 104 of about 0.5 wt % to about 40 wt % (or about 1 wt % to about 35 wt %, or about 1.5 wt % to about 30 wt %, or about 2 wt % to about 25 wt %, or about 2.5 wt % to about 20 wt %, or about 0.5 wt % to about 10 wt %, or about 0.5 wt % to about 5 wt %, or about 0.5 wt % to about 2.5 wt %), based on the total weight of the blend.

Seeding agent 104 may have a mesophase content of at least 0.01 vol %, based on the total volume of the seeding agent 104. For example, seeding agent 104 may have a mesophase content of about 0.01 vol % to about 100 vol %, such as seeding agent 104 has a mesophase content of about 60 vol % to 100 vol %, based on the total volume of seeding agent 104; separating first mesophase pitch 108 in a separation zone 110 to produce: an effluent of distillate products 112 comprising a mixture of gaseous products and liquid products; and second mesophase pitch 114 having a mesophase content of about 10 vol % or greater, based on the total volume of the second mesophase pitch 114, a softening point $T_{sp}$ below 400° C., wherein the second mesophase pitch 114 is suitable for spinning into carbon fiber; and recycling at least a portion of the bottoms product stream 218 back to the upstream of reaction zone 106, wherein the at least a portion of the bottoms product stream 218 can be used as a seeding agent. The other portion of the bottoms product stream 216 may be subjected to further processing, such as being spun directly into a fiber (as described above), used as binder pitch, graphitizable carbon microbeads, solid lubricants, activated carbon fiber, battery anodes, and carbon foams.

The present disclosure further provides a method for forming a composite material where a carbon fiber formed from a single pitch, such as first mesophase pitch 108 or second mesophase pitch 114, or a blend of two or more pitches, and a matrix. The matrix may be a thermoset matrix, a thermoplastic matrix, and any combination thereof.

Furthermore, methods of the present disclosure provide a carbon fiber composite comprising: a carbon fiber produced from a mesophase pitch, such as the second mesophase pitch 114 (or 216) having a softening point ($T_{sp}$) below 400° C., wherein the mesophase pitch (i.e., second mesophase pitch 114 or 216) can be produced from an isotropic feed (i.e., isotropic feed 102) and a seeding agent (i.e., a seeding agent 104) having a mesophase content of at least 0.01 vol %, based on the total volume of the seeding agent.

As described above, the isotropic feed 102 and the seeding agent 104 may be mixed to produce a blend, wherein the blend is reacted in a reaction zone (e.g., a slurry-phase hydrocracking, continuous stirred tank reactor, semi-batch reactor, tubular reactor, fixed-bed reactor, batch reactor), a steam pyrolysis process, pyrolysis, catalytic process, and any combination thereof) to produce the reacted blend at a mesophase growth rate enhancement of about 10% or greater. The manner of blending is important to effect efficient acceleration of mesophase production. It can be preferable to produce small droplets of suspended seeding agent 104 in the isotropic feed 102. The reaction zone 106 can be a fixed-bed reactor. Reaction zone 106 may be controlled catalytically, thermally, and any combination thereof. For example, reactions may be carried out under one or more of: a partial pressure of hydrogen of about 10 MPa or less, a temperature in the range of 200° C. to 600° C., a pressure in the range of 0.0005 MPa to 25 MPa, and a WHSV in the range of 0.1 $hr^{-1}$ to 4 $hr^{-1}$ if the reaction is being carried out in a fixed-bed reactor.

Isotropic feed 102 may be selected from the group consisting of: main-column-bottom (MCB), HDT-MCB, steam cracker tar, HDT-SCT, crude oils, hydrotreated crude oils, coal tar pitch, vacuum residue (VR), atmospheric residue, asphalt, asphaltenes, bitumen, reformate, distillation of cuts from thermal cracking reactions, and any combination thereof.

Seeding agent 104 may be a mesophase pitch produced from at least a portion of the isotropic feed, as described above. The blend may have a volume ratio isotropic pitch/seeding agent of about 50:50 to about 99.9:0.1 (or about 55:45 to about 99.9:0.1, or about 60:40 to about 99.9:0.1, or about 65:35 to about 99.9:0.1, to about 70:30 to about 99.9:0.1, or about 75:25 to about 99.9:0.1, or about 80:20 to about 99.9:0.1, or about 85:15 to about 99.9:0.1, or about 86:14 to about 99.5:0.5, or about 87:13 to about 99:1, or about 88:12 to about 98:2, or about 89:11 to about 97:3, or about 90:10 to about 95:5, or about 90:10 to about 99.9:0.1, or about 95:5 to about 99.9:0.1, or about 98:2 to about 99.9:0.1, or about 99:1 to about 99.5:0.5). The blend may comprise a seeding agent 104 content of about 15 vol % or less (or about 12 vol % or less, about 10 vol % or less, about 8 vol % or less, about 6 vol % or less, about 4 vol % or less, about 2 vol % or less, about 1 vol % or less, about 0.5 vol % or less), based on the total volume of the blend. The reaction blend may be separated in a separation zone to produce the mesophase pitch. Herein, separating the first mesophase pitch may be one or more of: distillation, deasphaltenation, chromatographic separation, centrifugation, membrane-filtration, and any combination thereof. The reaction blend may be characterized as being relatively free of impurities and ash.

The mesophase pitch obtained after separation may comprises a mesophase content ranging from about 0.1 vol % to 100 vol %, based on the total volume of the mesophase pitch, such as about 10 vol % to 100 vol %. The mesophase pitch may be spun at a spinning temperature greater than 200° C. The mesophase pitch may be spun with two or more pitches.

The carbon fiber composite may further comprise additional fillers. Suitable examples of additional fillers may be selected from the group consisting of: carbon fiber, boron fiber, carbon nanotube (CNT), carbon black, carbon nanotubes, and combinations thereof. Glass fiber and/or metal fiber may be used for fiber reinforced materials.

The carbon fiber may be combined with a matrix material to produce the carbon fiber composite. The matrix material may be a thermoset polymer, a thermoplastic polymer, cement, concrete, pitch, ceramic, metal, metal alloy, and any combination thereof. The thermoplastic polymer may be selected from the group consisting of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide, and any combination thereof.

The carbon fiber may be stabilized with an oxidizing gas containing oxygen at a temperature of less than or equal to $T_{sp}$ of the mesophase pitch, to produce a stabilized fiber. The stabilized fiber may be carbonized to produce a carbonized fiber. The carbonized fiber may be graphitized to produce a graphitized fiber. The mesophase pitch can be meltblown, or spunbond, into fibrous webs for nonwoven applications. The resulting fibrous web can further be stabilized, carbonized, or graphitized. Either of these fibers, or fibrous webs, can further be used in the production of composites wherein the fibers, or fibrous webs, can be combined with a matrix element to produce a composite product.

The matrix used herein can be produced from a thermoset polymer (e.g., cyclopentadiene, dicyclopentadiene, epoxy, pitch, phenolic resins, vinylester, polyimide and polyesters), a thermoplastic polymer (e.g., a thermoplastic polymer including one or more of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide), polythiophenes, cement, concrete, ceramic, metal, metal alloy, and any combination thereof. For example, a pitch itself can be used as a matrix and/or binder for a carbon fiber composite by impregnating a number of oxidized fiber, carbon fiber, or graphite fibers, or oxidized, carbonized, or graphitized fibrous webs with pitch and carbonizing the assemblage, thus enabling production of carbon-carbon composites. In such cases, the carbon fibers are laid into a desired form and then the fibers are impregnated, these materials are then carbonized at high temperatures to form a solid block of carbon, oftentimes the impregnation with pitch is repeated several times before the final carbon product is formed, this method is commonly employed when producing carbon brakes.

The present disclosure also relates to methods for making carbon fiber composites comprising: combining at least one composite filler comprising a carbon fiber produced from the forgoing mesophase pitch composition with at least one matrix, wherein the matrix is a thermoset matrix, a thermoplastic matrix, cement, concrete, ceramic, metal, metal alloy, pitch and any combination thereof. The composite filler may be used in the carbon fiber composite after the stabilization, carbonization, or graphitization processes. The composite filler can be either short, or continuous, mat, bundle, unidirectional or multidirectional, and woven or non-woven. The carbon fiber composite parts can be produced using conventional molding, roving, autoclave or pultrusion processes.

The described carbon fiber composites exhibit superior stiffness, strength, corrosion resistance, density, thermal and/or electrical conductivities, than similar composites that do not incorporate carbon fibers. In addition, composites reinforced with carbon fiber versus other strengthening agents tend to be lighter in weight and exhibit higher specific strengths (strength normalized relative to mass). Additionally, such carbon fiber composites exhibit a low coefficient of thermal expansion, particularly where a high graphitic content fiber is used. Such properties can be tailored by controlling the orientation of domains, hence the resulting texture of the carbon fibers.

Therefore, a process of the present disclosure include: reacting in a reaction zone a blend comprising an isotropic feed and a seeding agent, to produce a reacted pitch having a mesophase content of about 10 vol % to 100 vol %, based on the total volume of the reacted pitch, and a softening point ($T_{sp}$) below 400° C.; wherein the seeding agent is about 50 wt % or less, based on the total weight of the blend; wherein the seeding agent has a mesophase content of about 60 vol % to 100 vol %, based on the total volume of the seeding agent; separating the reacted pitch in a separation zone to produce: a first effluent comprising a mixture of gaseous products and liquid products; and a second effluent comprising a separated pitch having a mesophase content of about 10 vol % or greater, based on the total volume of the separated pitch, and a softening point $T_{sp}$ below 400° C. The isotropic feed may further comprise a nucleating agent that comprises heat treated isotropic pitch that has a mesophase content of 0 vol %, based on the total volume of the heat treated isotropic pitch. The isotropic feed may further comprise a nucleating agent that comprises heat treated isotropic pitch that has a mesophase content of 0 vol %, based on the total volume of the heat treated isotropic pitch.

Therefore, a process of the present disclosure include: reacting, in a batch, semi-batch or continuous mode, a blend comprising an isotropic feed and a seeding agent, to produce a reacted pitch having a mesophase content of about 10 vol % to 100 vol %, based on the total volume of the reacted pitch, and a softening point ($T_{sp}$) below 400° C.; wherein the seeding agent is about 50 wt % or less, based on the total weight of the blend; wherein the seeding agent has a mesophase content of about 60 vol % to 100 vol %, based on the total volume of the seeding agent; separating the reacted pitch in a separation zone to produce: a first effluent comprising a mixture of gaseous products and liquid products; and a second effluent comprising a separated pitch having a mesophase content of about 10 vol % or greater, based on the total volume of the separated pitch, and a softening point $T_{sp}$ below 400° C., wherein the first mesophase pitch and/or the second mesophase pitch are/is suitable for spinning into carbon fiber; and recycling at least a portion of the second effluent back to the reaction zone, wherein the second mesophase pitch is used as the seeding agent. The isotropic feed may further comprise a nucleating agent that comprises heat treated isotropic pitch that has a mesophase content of 0 vol %, based on the total volume of the heat treated isotropic pitch.

Therefore, the present disclosure include carbon fibers produced from a mesophase pitch having a softening point ($T_{sp}$) below 400° C.; wherein the mesophase pitch is produced in a reaction zone from a reaction blend comprising an isotropic feed and a seeding agent having a mesophase content of about 60 vol % to 100 vol %, based on the total volume of the seeding agent; and wherein the reaction blend comprises a seeding agent content of about 50 wt % or less, based on the total weight of the blend.

Therefore, the present disclosure include carbon fiber composites comprised of a matrix produced from a mesophase pitch having a softening point ($T_{sp}$) below 400° C.; wherein the mesophase pitch is produced in a reaction zone from a reaction blend comprising an isotropic feed and a seeding agent having a mesophase content of about 60 vol % to 100 vol %, based on the total volume of the seeding agent; and wherein the reaction blend comprises a seeding agent content of about 50 wt % or less, based on the total weight of the blend.

Method for Quantifying Mesophase from Optical Micrographs Using Image Segmentation Software The present disclosure further provides a method for quantifying mesophase from optical micrographs using a digital image segmentation workflow. Using image segmentation software, the mesophase and isotropic phases within an image can be identified and quantified. Image segmentation can be accomplished using thresholding of pixel intensities or by training a machine learning model on labeled regions of different images. The technique works well with images acquired using reflected cross-polarized light microscopy, but works with any mode digital imaging microscopy. With a sufficient number of images, which are each cross-sections of the bulk material, an area fraction of each phase can be quantified.

Methods of the present disclosure comprise: depositing a pitch onto a sample holder suitable for optical microscopy; heating the sample holder to a temperature above the softening point of the hydrocarbon-containing compound to form a heated hydrocarbon-containing compound; analyzing the heated hydrocarbon-containing compound with an optical microscope; recording at least three reference points; transferring the heated hydrocarbon-containing compound to a suitable mass spectrometer sample holder; tuning a laser to obtain a tuned laser spot of about 50 μm or less; acquiring a mass spectrum of a series of points by rastering across the surface of the heated hydrocarbon-containing compound; ionizing the heated hydrocarbon-containing compound by pulsing the laser to generate ions and further produce an ionized material; acquiring the mass spectrum of the ionized material; overlaying the mass spectra data of the ionized material with the optical microscopy data using the at least three reference points; obtaining a 2-dimensional molecular characterization of the hydrocarbon-containing compound; and tracking the distributions of single molecules within the hydrocarbon-containing compound.

The hydrocarbon-containing compound (e.g., pitch) may have a softening point of about 100° C. or greater (or about 150° C. or greater, or about 200° C. or greater, or about 250° C. or greater, or about 300° C. or greater, or about 400° C. or greater, or about 500° C. or greater, or about 600° C. or greater). Herein, a pitch sample (<10 μg) can be deposited onto a sample holder (e.g., a glass coverslip, a quartz crucible, or any appropriate sample holder) suitable for optical microscopy, put under an inert atmosphere (e.g., $N_2$ or Ar), and the sample holder may be heated at a temperature of about 100° C. or greater (or about 200° C. or greater, or about 300° C. or greater, or about 400° C. or greater, or about 500° C. or greater, such as about 550° C., such as about 600° C.), with the pitch gradually melting. When the heated pitch is an isotropic pitch heat treated at approximately 400° C. or greater, for a period of time of about 1 minute or greater (or about 5 minutes or greater, or about 10 minutes or greater, or about 15 minutes or greater, or about 30 minutes or greater, or about 1 hour or greater, or about 2 hours or greater, or about 3 hours or greater, or about 4 hours or greater, or about 5 hours or greater, or about 6 hours or greater, or about 8 hours or greater, or about 10 hours or greater), the heat treatment enables the conversion of the isotropic pitch molecules to planar aromatic structures that phase separate, thus forming a liquid crystalline mesophase. Quantification of the mesophase domains can be determined by using reflected polarized light microscopy, transmitted polarized light microscopy, or fluorescent microscopy. For example, once cooled and solidified, reflected polarized light microscopy images can be acquired using an optical microscope with reflected polarized light and multiple polarization angles to visualize and quantify the mesophase domains.

In some instances, the hydrocarbon-containing compound can be a pitch comprising both mesophase and isotropic phase. Characterization of both mesophase and isotropic phase can be achieved by spreading both phases out (e.g., exploiting the different melting temperatures and different densities between mesophase and isotropic pitches).

In some mesophase pitch samples, the isotropic and mesophase regions may not be separated sufficiently to permit unambiguous assignment of the mass spectra to each region. In these instances, the pitch may be subjected to conditions to segregate the isotropic and mesophase regions from one another. This increase in spatial separation permits the mass spectra to be definitively assigned to the mesophase and the isotropic phase. Representative separation methods include: high-temperature centrifugation; quiescently heating the sample to temperatures above the softening point, but below the temperature where volatiles form and/or chemical bond formation and breakage occur, and holding to permit an increase in phase separation due to density differences between the two phases; heating the pitch to temperatures where the pitch is fluid and inducing flow (e.g., squeezing the molten pitch between two angled slides); and heating the pitch to a temperature wherein the isotropic phase is fluid, but the mesophase is still solid, and forcing the isotropic phase to collect in one area, preferentially increasing the isotropic phase in one region and the mesophase in the other. These are to be taken as non-limiting examples, and other methods can be considered to selectively concentrate the two different phases to permit the spatial resolution for mass spectral analysis.

The pitch sample can then be transferred, for example, to an indium-tin-oxide (ITO slide) for mass spectrometry analysis. Additionally, by using a temperature-controlled stage, pyrolysis of the pitch can be performed on the ITO slide directly. For purposes of the present disclosure, laser desorption/ionization (LDI) may be used to generate ions in a gas phase for analysis. The matrix-assisted laser desorption/ionization (MALDI) analysis may also be suitable herein. In that case, the addition of a suitable matrix for ionization may be required. Suitable examples of matrices can include, but are not limited to: 7,7,8,8-tetracyanoquinodimethane, 2-mercaptobenzothiazole, 9-anthracenecarbonitrile, trans-2-[3-(4-tert-butylphenyl)-2-methyl-2-propenylidene] malononitrile. However, as pitch-containing compounds may contain a high concentration of polycyclic aromatic hydrocarbons (PAHs), LDI may be more suitable as ionization technique for analysis, when compared to MALDI.

LDI can be performed with either infrared or ultraviolet lasers. For example, an Nd:YAG laser model (wavelength λ=355 nm) from BRUKER DALTONICS may be employed to generate ions by irradiating the surface of the sample with low energy photons. Lower laser energy may be used to ensure that fragmentation of the parent species would not occur during ionization, and subsequent transmission and mass analysis. Advantageously, the generation of ion images through mass spectrometry analysis of the pitch sample (e.g., solid pitch) can enable tracking the two-dimensional distribution of PAHs across a droplet of pitch. In order to generate the images, the mass spectrometry data may be acquired in a systematic manner across the surface of the pitch sample by annotating a scanned image of the sample and annotating the regions of analysis using, for example, a software that can provide comprehensive visualization of spatial distributions for two-dimensional imaging, such as FLEXIMAGING™ software, available from BRUKER DALTONICS. Accordingly, experimental parameters of the analysis can be set, determining the spatial resolution of the image. After annotation of the scanned image, an arbitrary coordinate set can be created, which covers the region of interest (ROI) with intervals that define the spatial resolution of the resulting image. For example, when acquiring an image at a 30 μm spatial resolution, the laser spot can be tuned below a width of 15 μm, for example, and the instrument's sample stage can be set to move 30 μm after each laser emission (higher spatial resolution may imply more structural detail). The laser spot can be tuned at a defined width depending on the type/model of instrument used for the characterization. The laser can be fired at the pitch sample, generating ions for analysis, while the stage is moved to the next interval in the coordinate system. The foregoing process may be repeated for a certain number of times (e.g., about a thousands of times) to generate data across the ROI. From here, ions of interest can be selected and color maps can be further generated, detailing their locations and relative intensities.

Therefore, a process of the present disclosure include: depositing a mesophase pitch onto a sample holder suitable for optical microscopy, wherein the mesophase pitch is produced by reacting in a reaction zone a blend comprising an isotropic feed and about 50 wt % or less of a seeding agent, based on the total weight of the blend, wherein the seeding agent has a mesophase content of about 0.01 vol % to 100 vol %, based on the total volume of the seeding agent, to produce the mesophase pitch at a mesophase content of about 0.01 vol % to 100 vol %, based on the total volume of the mesophase pitch, and a softening point $T_{sp}$ below 400° C.; heating the sample holder to a temperature above the softening point of the mesophase pitch; obtaining a 2-dimensional molecular characterization of the mesophase pitch; and tracking the distributions of single molecules within the mesophase pitch.

End Uses

Non-limiting examples of carbon articles may include automotive body parts (e.g., deck lids, hoods, front end, bumpers, doors, chassis, suspension systems such as leaf springs, drive shafts), off-shore tethers and drilling risers, wind turbine blades, insulating and sealing materials used in construction and road building (e.g., concrete), aircraft and space systems, high-performance aquatic vessels, airplanes, sports equipment, flying drones, armor, armored vehicles, military aircraft, energy storage systems, fireproof materials, lightweight cylinders and pressure vessels, and medical devices. Furthermore, fibers of the present disclosure (e.g., fiber filaments or webs) may be used as insulation materials (e.g., thermal or acoustic), or as shielding materials (e.g., electromagnetic or radio frequency), or in friction control surfaces (e.g., brake pads, such as aircraft brake pads). Carbon fibers may be included with graphitic foams, and pitch compositions with the preceding properties may be used to produce graphitic foams, for protection against explosions, heat dissipation and the like.

To form the pitch compositions, and further the carbon fiber composites, in accordance with at least one embodiment of the present disclosure, the pitch compositions may be mixed according to any suitable mixing methods to produce the forgoing spinnable pitch composition, and spun into carbon fibers (e.g., green carbon fibers). The as-spun carbon fiber (e.g., green carbon fiber) may be subsequently oxidized to form a stabilized carbon fiber and may further undergo a carbonization and graphitization process under inert conditions to yield a carbon fiber filler. Stabilization, carbonization and graphitization conditions may be used according to methods apparent to those skilled in the art. The carbon fiber filler may comprise the stabilized, carbonized, or graphitized carbon fiber. The carbon fiber filler may then be used to form the carbon articles and/or otherwise incorporated in related pitch compositions.

The foregoing mesophase pitch may also be used as binder pitch, graphitizable carbon microbeads, solid lubricants, activated carbon fiber, battery anodes, and carbon foams.

Embodiments disclosed herein include:

A. Processes for enhancing the nucleation and/or the growth rate of mesophase in pitch compositions derived from hydrocarbon feedstocks. The processes comprise: reacting in a reaction zone a blend comprising an isotropic feed and a seeding agent, to produce a reacted pitch having a mesophase content of about 10 vol % to 100 vol %, based on the total volume of the reacted pitch, and a softening point ($T_{sp}$) below 400° C.; wherein the seeding agent is about 50 wt % or less, based on the total weight of the blend; wherein the seeding agent has a mesophase content of about 0.01 vol % to 100 vol %, based on the total volume of the seeding agent; separating the reacted pitch in a separation zone to produce: a first effluent comprising a mixture of gaseous products and liquid products; and a second effluent comprising a separated pitch having a mesophase content of about 10 vol % or greater, based on the total volume of the separated pitch, and a softening point $T_{sp}$ below 400° C.

B. Processes for enhancing the nucleation and/or the growth rate of mesophase in pitch compositions derived from hydrocarbon feedstocks. The processes comprise: reacting in a reaction zone, in a batch, semi-batch or continuous mode, a blend comprising an isotropic feed and a seeding agent, to produce a reacted pitch having a mesophase content of about 10 vol % to 100 vol %, based on the total volume of the reacted pitch, and a softening point $T_{sp}$ below 400° C.; wherein the seeding agent is about 50 wt % or less, based on the total weight of the blend; wherein the seeding agent has a mesophase content of about 0.01 vol % to 100 vol %, based on the total volume of the seeding agent; separating the reacted pitch in a separation zone to produce: a first effluent comprising a mixture of gaseous products and liquid products; and a second effluent comprising a separated pitch having a mesophase content of about 10 vol % or greater, based on the total volume of the separated pitch, a softening point $T_{sp}$ below 400° C., wherein the reacted pitch and/or the separated pitch are/is suitable for spinning into carbon fiber; and recycling at least a portion of the second effluent back to the reaction zone, wherein the separated pitch is used as the seeding agent.

C. Carbon fibers produced from a mesophase pitch having a softening point ($T_{sp}$) below 400° C.; wherein the mesophase pitch is produced in a reaction zone from a reaction blend comprising an isotropic feed and a seeding agent having a mesophase content of about 0.01 vol % to 100 vol %, based on the total volume of the seeding agent; and wherein the reaction blend comprises a seeding agent content of about 50 wt % or less, based on the total weight of the blend.

D. Carbon fiber composites comprised of a matrix produced from a mesophase pitch having a softening point ($T_{sp}$) below 400° C.; wherein the mesophase pitch is produced in a reaction zone from a reaction blend comprising an isotropic feed and a seeding agent having a mesophase content of about 0.01 vol % to 100 vol %, based on the total volume of the seeding agent; and wherein the reaction blend comprises a seeding agent content of about 50 wt % or less, based on the total weight of the blend.

E. Processes for 2-dimensional molecular characterization of mesophase pitches and tracking the distributions of single molecules within the mesophase pitches. The processes comprise: depositing a mesophase pitch onto a sample holder suitable for optical microscopy, wherein the mesophase pitch is produced by reacting in a reaction zone a blend comprising an isotropic feed and about 50 wt % or less of a seeding agent, based on the total weight of the blend, wherein the seeding agent has a mesophase content of about 0.01 vol % to 100 vol %, based on the total volume of the seeding agent, to produce the mesophase pitch at a mesophase content of about 0.01 vol % to 100 vol %, based on the total volume of the mesophase pitch, and a softening point $T_{sp}$ below 400° C.; heating the sample holder to a temperature above the softening point of the mesophase pitch; obtaining a 2-dimensional molecular characterization of the mesophase pitch; and tracking the distributions of single molecules within the mesophase pitch.

Each of embodiments A, B, C, D, and E may have one or more of the following additional elements in any combination:

Element 1: wherein the isotropic feed is selected from the group consisting of: main-column-bottom (MCB), hydrotreated main column bottom, steam cracker tar, hydrotreated steam cracker tar (HDT-SCT), crude oils, hydrotreated crude oils, coal tar pitch, petroleum pitch, vacuum residue (VR), atmospheric residue, asphalt, asphaltenes, bitumen, reformate, coker gas oil, heavy coker gas oil, thermal tar, thermal distillation cuts, and any combination thereof.

Element 2: wherein the seeding agent is a mesophase pitch produced from at least a portion of an isotropic pitch that is the same or different than the isotropic feed.

Element 3: wherein the blend has a volume ratio isotropic feed/seeding agent of about 50:50 to about 99.9:0.1.

Element 4: wherein the blend has a seeding agent content of about 0.5 wt % to about 40 wt %, based on the total weight of the blend.

Element 5: wherein the reaction zone consists of running a batch, semi-batch, continuous stirred-tank reactor, tubular, fixed-bed reactor, bubble column reactor, or a slurry reactor.

Element 6: wherein the reaction zone is selected from a group consisting of: a slurry-phase hydrocracking, a steam pyrolysis process, pyrolysis process, slurry-phase dealkylation process, and any combination thereof.

Element 7: wherein the reaction zone is a fixed-bed reactor.

Element 8: wherein the reaction zone is controlled catalytically, thermally, and any combination thereof.

Element 9: wherein reacting the blend is carried out under one or more of: a partial pressure of hydrogen of about 10 MPa or less, a temperature in the range of 200° C. to 600° C., a pressure in the range of 0.0005 MPa to 25 MPa, a residence time of 0.25 minutes to 24 hours, or a WHSV in the range of 0.1 $hr^{-1}$ to 4 $hr^{-1}$.

Element 10: wherein reacting the blend is selected from the group consisting of: pyrolyzing, slurry hydrocracking, acid-catalyzed reaction, and any combination thereof, wherein acid-catalyzed reaction comprise: hydrotreating and/or acid-catalyzed oligomerization.

Element 11: wherein reacting the blend is carried out in the presence of an acid catalyst.

Element 12: wherein the acid catalyst is selected from the group consisting of: HF, $HF/BF_3$, $H_2SO_4$, acidic ionic liquids, sulfated zirconia, chlorided alumina, or zeolites.

Element 13: wherein reacting the blend is carried out using a catalyst system comprising: one or more transition metal catalysts comprising a group 5, 6, 9, 10 transition metal; and one or more supports.

Element 14: wherein the one or more transition metal catalysts comprises a transition metal selected from the group consisting of: V, Mo, W, Co, Ni, Pt, Pd, and any combination thereof.

Element 15: wherein the one or more supports are selected from the group consisting of: alumina, silica, silica-alumina, porous carbons, zeolites, zirconia, titania, and refractory oxides.

Element 16: wherein reacting the blend is performed in presence of a hydrogen-donor solvent.

Element 17: wherein the hydrogen-donor solvent contains at least one single-ring aromatic compound.

Element 18: wherein the reacted pitch has a carbon residue content of from about 20 wt % to about 99 wt %, based on the total weight of the reacted pitch.

Element 19: wherein the reacted pitch has a T10 in the range of 200° C. to 650° C.

Element 20: wherein the reacted pitch has a hydrogen content of from about 3 wt % to about 12 wt %, a sulfur content of from 0 wt % to about 10 wt %, based on the total weight of the reacted pitch.

Element 21: wherein the reacted pitch has a "π-π stacking" or interlayer distance between molecules $d_{\pi-\pi}$ (Å) of about 3.3 Å to about 5 Å.

Element 22: wherein the reacted pitch has scattering peak location at a scattering vector q ($Å^{-1}$) of about 1.25 $Å^{-1}$ to about 1.9 $Å^{-1}$.

Element 23: wherein separating the reacted pitch is one or more of: distillation, deasphaltenation, chromatographic separation, centrifugation, membrane-filtration, and any combination thereof.

Element 24: wherein deasphaltenation is carried out in presence of a solvent to produce a first effluent comprising solvent, gaseous and liquid compounds, and a second effluent comprising a bottoms product stream, wherein the bottoms product stream comprises the separated pitch.

Element 25: wherein the solvent is selected from the group consisting of: ethane, propane, butanes, pentanes, hexanes, benzene, heptanes, toluene, octanes, dimethybenzenes, ethylbenzene, or any isomers therefrom, reformate, and any combination thereof.

Element 26: wherein the bottoms product stream is a deasphalted bottoms product stream.

Element 27: wherein the separated pitch has a mesophase content of about 10 vol % to about 100 vol %, based on the total volume of the separated pitch.

Element 28: wherein the separated pitch has softening point ($T_{sp}$) of about 100° C. to about 400° C.

Element 29: wherein the separated pitch has a glass transition temperature ($T_g$) of about 50° C. to about 315° C.

Element 30: wherein the separated pitch has a T10 in the range of 200° C. to 650° C.

Element 31: wherein the separated pitch has a carbon residue content of from 20 wt % to 99 wt %, based on the total weight of the separated pitch.

Element 32: wherein the separated pitch has a hydrogen content of from about 3 wt % to about 12 wt %, a sulfur content of from 0 wt % to about 10 wt %, based on the total weight of the separated pitch.

Element 33: recycling at least a portion of the bottoms product stream back to the reaction zone, wherein the bottoms product stream is used as the seeding agent.

Element 34: wherein the separated pitch is combined with a reinforcing agent for the production of a composite.

Element 35: wherein the separated pitch is used as a matrix material in the production of a composite.

Element 36: wherein the composite is comprised of the separated pitch as a matrix element, and a filler, wherein the filler is selected from the group consisting of: carbon fiber, glass fiber, metal fiber, boron fiber, pitch, carbon black, carbon nanotubes, and combinations thereof.

Element 37: wherein the matrix material is a thermoset polymer, a thermoplastic polymer, cement, concrete, pitch, ceramic, metal, metal alloy, and any combination thereof.

Element 38: wherein the thermoplastic polymer is selected from the group consisting of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide, and any combination thereof.

Element 39: a fiber, a carbon fiber, an oxidized fiber, carbonized fiber, graphitized fiber, fiber web, oxidized fiber web, carbonized fiber web, or graphitized fiber web prepared using the separated pitch.

Element 40: a binder pitch, graphitizable carbon microbeads, solid lubricants, activated carbon fiber, battery anodes, and carbon foams produced using the separated pitch.

Element 41: wherein the separated pitch is spun at a spinning temperature greater than 200° C.

Element 42: wherein the separated pitch is spun using an extensional strain rate between 0.1 $s^{-1}$ and 100 $s^{-1}$ during spinning.

Element 43: producing a carbon article comprising the carbon fiber.

Element 44: separating the reacted pitch in a separation zone to produce: a first effluent comprising a mixture of gaseous products and liquid products; and a second effluent comprising a separated pitch having a mesophase content of about 5 vol % or greater, based on the total volume of the separated pitch, a softening point $T_{sp}$ below 400° C., wherein the reacted pitch and/or the separated pitch are/is suitable for spinning into carbon fiber; and recycling at least a portion of the second effluent back to the reaction zone, wherein the separated pitch is used as the seeding agent.

Element 45: wherein the isotropic feed is selected from the group consisting of: main-column-bottom (MCB), hydrotreated main column bottom, steam cracker tar, hydrotreated steam cracker tar (HDT-SCT), crude oils, hydrotreated crude oils, coal tar pitch, petroleum pitch, vacuum residue (VR), atmospheric residue, asphalt, asphaltenes, bitumen, reformate, coker gas oil, heavy coker gas oil, thermal tar, thermal distillation cuts, and any combination thereof.

Element 46: wherein the blend has a volume ratio isotropic feed/seeding agent of about 50:50 to about 99.9:0.1.

Element 47: wherein the blend has a seeding agent content of about 15 vol % or less, based on the total volume of the blend.

Element 48: wherein the reaction zone is a fixed-bed reactor, batch, semi-batch, continuous stirred-tank reactor, tubular, fixed-bed reactor, bubble column reactor, or a slurry reactor e.

Element 49: wherein reacting the blend is heat treating controlled catalytically, thermally, and any combination thereof.

Element 50: wherein reacting the blend is carried out under one or more of: a partial pressure of hydrogen of about 10 MPa or less, a temperature in the range of 200° C. to 600° C., a pressure in the range of 0.0005 MPa to 25 MPa, a residence time of 0.25 minutes to 24 hours, or a WHSV in the range of 0.1 $hr^{-1}$ to 4 $hr^{-1}$.

Element 51: wherein reacting the blend is selected from the group consisting of: pyrolyzing, slurry hydrocracking, acid-catalyzed reaction, and any combination thereof, wherein acid-catalyzed reaction comprise: hydrotreating and/or acid-catalyzed oligomerization Element 52: wherein reacting the blend is carried out in presence of an acid catalyst.

Element 53: wherein the acid catalyst is selected from the group consisting of: HF, $HF/BF_3$, $H_2SO_4$, acidic ionic liquids, sulfated zirconia, chlorided alumina, or zeolites.

Element 54: wherein reacting the blend is carried out using a catalyst system comprising: one or more transition metal catalysts comprising a group 5, 6, 9, 10 transition metal; and one or more supports.

Element 55: wherein the one or more transition metal catalysts comprises a transition metal selected from the group consisting of: V, Mo, W, Co, Ni, Pt, Pd, and any combination thereof.

Element 56: wherein the one or more supports are selected from the group consisting of: alumina, silica, silica-alumina, porous carbons, zeolites, zirconia, titania, and refractory oxides.

Element 57: wherein reacting the blend is performed in the presence of a hydrogen-donor solvent.

Element 58: wherein the hydrogen-donor solvent contains at least one single-ring aromatic compound.

Element 59: wherein the reacted pitch has a carbon residue content of from about 20 wt % to about 99 wt %, based on the total weight of the reacted pitch.

Element 60: wherein the reacted pitch has a T10 in the range of 200° C. to 650° C.

Element 61: wherein the reacted pitch has a hydrogen content of from about 3 wt % to about 12 wt %, a sulfur content of from 0 wt % to about 10 wt %, based on the total weight of the reacted pitch.

Element 62: wherein the reacted pitch has a "π-π stacking" distance between molecules $d_{\pi-\pi}$ (Å) of about 3.3 Å to about 5.0 Å.

Element 63: wherein the reacted pitch presents a wide x-ray reflection with a peak maximum at a scattering vector q ($Å^{-1}$) of about 1.25 $Å^{-1}$ to about 1.9 $Å^{-1}$.

Element 64: wherein separating the reacted pitch is one or more of: distillation, deasphaltenation, chromatographic separation, membrane-filtration, centrifugation, and any combination thereof.

Element 65: wherein deasphaltenation is carried out in presence of a solvent to produce a first effluent comprising solvent, gaseous and liquid compounds, and a second effluent comprising a bottoms product stream, wherein the bottoms product stream comprises the separated pitch.

Element 66: wherein the solvent is selected from the group consisting of: ethane, propane, butanes, pentanes, hexanes, benzene, heptanes, toluene, octanes, dimethylbenzenes, ethylbenzene, or any isomers therefrom, reformate, and any combination thereof.

Element 67: wherein the separated pitch has a mesophase content of about 10 vol % to about 100 vol %, based on the total volume of the separated pitch.

Element 68: wherein the separated pitch has a mesophase content of about 10 vol % to about 100 vol %, based on the total volume of the separated pitch.

Element 69: wherein the separated pitch has softening point ($T_{sp}$) of about 100° C. to about 400° C.

Element 70: wherein the separated pitch has a glass transition temperature ($T_g$) of about 50° C. to about 315° C.

Element 71: wherein the separated pitch has a T10 in the range of 200° C. to 650° C.

Element 72: wherein the separated pitch has a carbon residue content of from 20 wt % to 99 wt %, based on the total weight of the separated pitch.

Element 73: wherein the separated pitch has a hydrogen content of from about 3 wt % to about 12 wt %, a sulfur content of from 0 wt % to about 10 wt %, based on the total weight of the separated pitch.

Element 74: a fiber, a carbon fiber, an oxidized fiber, carbonized fiber, graphitized fiber, fiber web, oxidized fiber web, carbonized fiber web, or graphitized fiber web prepared using the separated pitch.

Element 75: a binder pitch, graphitizable carbon microbeads, solid lubricants, activated carbon fiber, battery anodes, and carbon foams produced using the separated pitch.

Element 76: wherein the separated pitch is spun using an extensional strain rate between 0.1 $s^{-1}$ and 100 $s^{-1}$ during spinning.

Element 77: producing a carbon article comprising the carbon fiber.

Element 78: wherein the seeding agent is produced from an isotropic pitch comprised in the isotropic feed of the reaction blend or an isotropic pitch comprised in a different isotropic feed.

Element 79: wherein the isotropic feed is selected from the group consisting of: main-column-bottom (MCB), hydrotreated main column bottom, steam cracker tar, hydrotreated steam cracker tar (HDT-SCT), crude oils, hydrotreated crude oils, coal tar pitch, petroleum pitch, vacuum residue (VR), atmospheric residue, asphalt, asphaltenes, bitumen, reformate, coker gas oil, heavy coker gas oil, thermal tar, thermal distillation cuts, and any combination thereof.

Element 80: a composite prepared from the carbon fiber.

Element 81: wherein the seeding agent is produced from an isotropic pitch comprised in the isotropic feed of the reaction blend or an isotropic pitch comprised in a different isotropic feed.

Element 82: wherein the isotropic feed is selected from the group consisting of: main-column-bottom (MCB), hydrotreated main column bottom, steam cracker tar, hydrotreated steam cracker tar (HDT-SCT), crude oils, hydrotreated crude oils, coal tar pitch, petroleum pitch, vacuum residue (VR), atmospheric residue, asphalt, asphaltenes, bitumen, reformate, coker gas oil, heavy coker gas oil, thermal tar, thermal distillation cuts, and any combination thereof.

Element 83: wherein the seeding agent is a mesophase pitch produced from at least a portion of the isotropic feed of the reaction blend.

Element 84: wherein the reaction blend has a volume ratio isotropic feed/seeding agent of about 50:50 to about 99.9:0.1.

Element 85: wherein the reaction blend has a seeding content of about 0.5 wt % to about 40 wt %, based on the total weight of the blend.

Element 86: wherein the mesophase pitch is produced via a reactor process selected from the group consisting of: batch, semi-batch, continuous stirred-tank reactor, tubular, fixed-bed reactor, bubble column reactor, or a slurry reactor, and any combination thereof.

Element 87: wherein the reaction zone is a fixed-bed reactor.

Element 88: wherein the reaction zone is controlled catalytically, thermally, and any combination thereof.

Element 89: wherein the reaction process is carried out under one or more of: a partial pressure of hydrogen of about 10 MPa or less, a temperature in the range of 200° C. to 600° C., a pressure in the range of 0.0005 MPa to 25 MPa, a residence time of 0.25 minutes or greater, or a WHSV in the range of 0.1 $hr^{-1}$ to 4 $hr^{-1}$.

Element 90: wherein the reaction blend is separated in a separation zone to produce the mesophase pitch.

Element 91: wherein separation of the reaction blend is one or more of: distillation, deasphaltenation, chromatographic separation, membrane-filtration, centrifugation, and any combination thereof.

Element 92: wherein at least a portion of the mesophase pitch is recycled back to the upstream of the reaction zone, and wherein the mesophase pitch is used as the seeding agent.

Element 93: wherein the mesophase pitch is spun at a spinning temperature greater than 200° C.

Element 94: wherein the carbon fiber is combined with a matrix material to produce the carbon fiber composite.

Element 95: wherein the matrix material is a thermoset polymer, a thermoplastic polymer, pitch, cement, concrete, ceramic, metal, metal alloy, and any combination thereof.

Element 96: wherein the thermoplastic polymer is selected from the group consisting of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide, polythiophene and polyphenylene sulfide, and any combination thereof.

Element 97: wherein the carbon fiber composite further comprises a filler, and wherein the filler is selected from the group consisting of: carbon fiber, glass fiber, metal fiber, boron fiber, pitch, carbon black, and combinations thereof.

Element 98: wherein the carbon fiber is stabilized with an oxidizing gas containing oxygen at a temperature of less than or equal to $T_{sp}$ of the mesophase pitch, to produce a stabilized fiber.

Element 99: wherein the stabilized fiber is carbonized to produce a carbonized fiber.

Element 100: wherein the carbonized fiber is graphitized to produce a graphitized fiber.

Element 101: wherein the carbon fiber is produced in a melt blowing process.

Element 102: wherein the sample holder is heated at a temperature of about 350° C. or greater.

Element 103: wherein the mesophase pitch is a solid, a liquid, a slurry, and any combination thereof.

Element 104: wherein the mesophase pitch is derived from at least one process consisting of: fluid catalytic cracking, steam cracking, delayed coking, visbreaking, deasphaltenation, distillation, slurry hydrocracking.

Element 105: analyzing with an optical microscope using a reflected polarized light or a transmitted light.

Element 106: wherein ion generation is carried out using a laser desorption ionization (LDI) in a gas phase.

Element 107: wherein the mesophase pitch is ionized using a matrix-assisted laser desorption/ionization (MALDI), in presence of a matrix suitable for ionization.

Element 108: wherein the mesophase pitch has a stack height of about 4.5 nm.

Element 109: wherein molecular ordering of the mesophase pitch is improved when compared to a mesophase pitch produced from an isotropic feed without seeding agent.

Exemplary combinations applicable to A may include, but are not limited to, 1 and 2; 1 and 3; 1 and 4; 1 and 5; 1 and 6; 1 and 7; 1 and 8; 1 and 9; 1 and 10; 1 and 11; 1 and 12; 1 and 13, and 14; 1 and 13-15; 1 and 19; 1 and 20; 1 and 21; 1, 23, and 24; 1 and 26; 1 and 27; 1 and 28; 1, 3 and 4; 1 and 3-5; 1, 3 and 5; 1, 4 and 5; 1 and 3-6; 1, 3, 5 and 6; 1, 4, 5 and 6; 1 and 4; 1 and 5; 1 and 7; 1 and 3-7; 1, 3, 5 and 7; 1, 4, 5 and 7; 1 and 8; 1 and 9; 1 and 10; 1 and 11; 3 and 4; 3-5; 3 and 5; 3-6; 3-7; 3, 4 and 7; 3 and 8; 3 and 9; 3 and 10; 3 and 11; 4 and 5; 4 and 6; 4-6; 4-7; 4 and 8; 4 and 9; 4 and 10; 4 and 11; 5 and 6; 5-7; 5 and 8; 5 and 9; 5 and 10; 5 and 11; 7 and 8; 7 and 9; 7 and 10; 7 and 11; 8 and 9; 8 and 10; 8 and 11; 9 and 10; 9 and 11; and 10 and 11; 1, 36, and 37; 39 and 40; 41, 42, and 43. Exemplary combinations applicable to B may include, but are not limited to, 44 and 45; 44 and 47; 44 and 48; 44, and 49 or 51; 48, and 50 or 51; 52 and 53; 52 and 54-56; 61, 62, and 63. Exemplary combinations applicable to C may include, but are not limited to, 78 and 79.

Exemplary combinations applicable to D may include, but are not limited to, 81 and 82; 81 and 83; 81, 83 and 84; 81 and 83-85; 81, 83 and 85; 81, 84 and 85; 81 and 83-86; 81, 83, 85 and 86; 81, 84, 85 and 86; 81 and 84; 81 and 85; 81 and 87; 81 and 83-87; 81, 83, 85 and 87; 81, 84, 85 and 87; 81 and 88; 81 and 89; 81 and 90; 81 and 91; 81 and 99-101; 83 and 84; 83-85; 83 and 85; 83-86; 83-87; 83, 84 and 87; 83 and 88; 83 and 89; 83 and 90; 83 and 91; 84 and 85; 84 and 86; 84-86; 84-87; 84 and 88; 84 and 89; 84 and 90; 84 and 91; 85 and 86; 85-87; 85 and 88; 85 and 89; 85 and 90; 85 and 91; 87 and 88; 87 and 89; 87 and 90; 87 and 91; 88 and 89; 88 and 90; 88 and 91; 89 and 90; 89 and 91; and 97 and 98. Exemplary combinations applicable to E may include, but are not limited to, 102 and 103; 102 and 104; 102 and 105-109.

To facilitate a better understanding of the embodiments of the present disclosure, the following examples of preferred or representative embodiments are given. In no way should the following examples be read to limit, or to define, the scope of the present disclosure.

EXAMPLES

For purposes of the present disclosure, hydrotreated steam-cracker tar (HDT-SCT) and hydrotreated main-column-bottom (HDT-MCB) were used as starting feedstock materials. The HDT-MCB was prepared by blending an 80:20 mixture of main columns bottoms:steam cracked tar, and was subsequently hydrotreated. The resulting liquid product was vacuum distilled, and the non-distilling portion was deasphalted in pentane and cooled to −78.5° C. with dry ice. The insoluble material was filtered, collected and washed. The isolated insoluble fraction is an isotropic pitch with the following properties: a softening point of 158.3° C., an MCRT of 53.1 wt %, and a $T_g$ of 98° C.

The HDT-SCT was prepared by hydrotreating a steam cracker tar produced from steam cracking crude oil. The resulting liquid product was vacuum distilled, and the non-distilling portion was isolated. The resulting hydrocarbon had the following properties: a softening point of 170° C., an MCRT of 38.6 wt %, an elemental analysis of 92.09 wt % C, 7.41 wt % H, 0.00 wt % N, and 0.51 wt % S.

Representative Conditions for Heat Treating:

A glass vial was loaded with about 2 grams of a feed, and placed in a PAC Micro Carbon Residue Tester (MCRT). The sample was heated to 100° C. within 10 minutes under a flow of nitrogen (600 mL/min). Immediately afterwards, the sample was heated to 400° C. using a 30° C./min ramp rate and 600 mL/min nitrogen flow rate. Once at 400° C., the flow rate was decreased to 150 mL/min. The sample was held at 400° C. for a specified period of time (see Tables 1-8), under a continuous nitrogen flow of 150 mL/min. After heat soaking at 400° C., the sample was cooled to ambient temperature under nitrogen atmosphere, at a 600 mL/min flow rate over the course of several hours. Typically, after about 15 minutes, the temperature was about 350° C.; after about 25 minutes, the temperature was about 300° C.; and after about 66 min, the temperature was about 200° C.; and after about 157 min, the temperature was about 100° C. For the 12 h sample listed in Table 2, the above heat treating procedure was carried out twice, once for 8 h, and another for 4 h. For the 24 h sample listed in Table 2, the above heat treating procedure was carried out three times, each for 8 h. For both the 12 h and 24 h samples, they were held under nitrogen in between heat treatments. The mesophase content was measured by embedding the pitch samples in epoxy, solidifying the sample, polishing the samples until the surface of said pitch samples were highly reflective and acquiring a series of images to quantify the anisotropic content. The properties of the heat treated pitches are shown in Tables 1 and 2.

TABLE 1

| Sample | Feed | Seed (wt %) | Mesophase in the Seed (vol %) | Temperature (° C.) | Time (h) | Yield (%) |
|---|---|---|---|---|---|---|
| 1 | HDT-SCT | 0 | N/D | N/A | 0 | N/A |
| 2 | HDT-SCT | 0 | N/D | 400 | 1 | 74.38 |
| 3 | HDT-SCT | 0 | N/D | 400 | 2 | 62.84 |
| 4 | HDT-SCT | 0 | N/D | 400 | 3 | 58.58 |
| 5 | HDT-SCT | 0 | N/D | 400 | 4 | 55.25 |
| 6 | HDT-SCT | 0 | N/D | 400 | 5 | 52.03 |
| 7 | HDT-SCT | 0 | N/D | 400 | 5 | 53.83 |
| 8 | HDT-SCT | 0 | N/D | 400 | 6 | 52.38 |
| 9 | HDT-SCT | 0 | N/D | 400 | 6.5 | 52.09 |
| 10 | HDT-SCT | 0 | N/D | 400 | 7 | 50.83 |

TABLE 1-continued

| | | | | | | |
|---|---|---|---|---|---|---|
| 11 | HDT-SCT | 0 | N/D | 400 | 8 | 49.37 |
| 12 | HDT-SCT | 5 | 39 | N/A | 0 | 100 |
| 13 | HDT-SCT | 5 | 39 | 400 | 1 | 74.49 |
| 14 | HDT-SCT | 5 | 39 | 400 | 2 | 63.72 |
| 15 | HDT-SCT | 5 | 39 | 400 | 3 | 59.97 |
| 16 | HDT-SCT | 5 | 39 | 400 | 4 | 56.54 |
| 17 | HDT-SCT | 5 | 39 | 400 | 5 | 53.78 |
| 18 | HDT-SCT | 5 | 39 | 400 | 6 | 53.98 |

| Sample | Mesophase (vol %) | Softening Point (° C.) | MCRT (wt %) | C (wt %) | H (wt %) | N (wt %) | S (wt %) |
|---|---|---|---|---|---|---|---|
| 1 | 0.0 | 170 | 38.7 | 92.09 | 7.41 | 0 | 0.51 |
| 2 | 0.0 | 153.3 | 53.5 | 92.65 | 6.5 | 0.25 | 0.54 |
| 3 | 0.0 | 175.8 | 67.7 | 93.62 | 5.65 | 0.24 | 0.42 |
| 4 | 0.9 | 200.8 | 74.0 | 93.95 | 5.25 | 0.23 | 0.48 |
| 5 | 12.6 | 228.9 | 79.2 | 94.21 | 5.01 | 0.24 | 0.43 |
| 6 | 29.3 | N/D | 81.9 | 94.24 | 4.85 | 0.26 | 0.45 |
| 7 | N/D | 248.6 | N/D | N/D | N/D | N/D | N/D |
| 8 | 39.0 | 313.2 | 86.3 | 94.32 | 4.7 | 0.24 | 0.42 |
| 9 | 66.0 | 347.8 | 88.9 | N/A | N/A | N/A | N/A |
| 10 | 66.0 | 350.3 | 89.1 | N/A | N/A | N/A | N/A |
| 11 | 85.0 | 354.7 | 89.5 | N/A | N/A | N/A | N/A |
| 12 | 0.0 | 171.9 | 40.1 | 92.02 | 7.37 | 0.24 | 0.47 |
| 13 | 0.2 | 163.2 | 62.3 | 92.86 | 6.35 | 0.23 | 0.4 |
| 14 | 1.2 | 183.9 | 69.1 | 93.84 | 5.54 | 0.23 | 0.45 |
| 15 | 4.2 | 206.8 | 75.9 | 94.01 | 5.19 | 0.24 | 0.47 |
| 16 | 15.2 | 240.2 | 80.7 | 94.26 | 4.93 | 0.23 | 0.36 |
| 17 | 37.5 | N/A | 85.1 | 94.26 | 4.78 | 0.25 | 0.41 |
| 18 | 53.8 | 323.2 | 86.9 | 94.48 | 4.51 | 0.23 | 0.45 |

TABLE 2

| Sample | Feed | Seed (wt %) | Mesophase in the Seed (vol %) | Temperature (° C.) | Time (h) | Yield (%) |
|---|---|---|---|---|---|---|
| 19 | HDT-MCB | 0 | N/A | N/A | 0 | 100 |
| 20 | HDT-MCB | 0 | N/A | 400 | 2 | 77.8 |
| 21 | HDT-MCB | 0 | N/A | 400 | 3 | 70.5 |
| 22 | HDT-MCB | 0 | N/A | 400 | 3 | 74.7 |
| 23 | HDT-MCB | 0 | N/A | 400 | 3 | 72.9 |
| 24 | HDT-MCB | 0 | N/A | 400 | 4 | 68.1 |
| 25 | HDT-MCB | 0 | N/A | 400 | 4 | 70.9 |
| 26 | HDT-MCB | 0 | N/A | 400 | 4.5 | N/D |
| 27 | HDT-MCB | 0 | N/A | 400 | 4.5 | 67.6 |
| 28 | HDT-MCB | 0 | N/A | 400 | 5 | 71.6 |
| 29 | HDT-MCB | 0 | N/A | 400 | 5 | 68.0 |
| 30 | HDT-MCB | 0 | N/A | 400 | 6 | N/D |
| 31 | HDT-MCB | 0 | N/A | 400 | 6 | 66.3 |
| 32 | HDT-MCB | 0 | N/A | 400 | 6 | 64.7 |
| 33 | HDT-MCB | 0 | N/A | 400 | 12 | 59.4 |
| 34 | HDT-MCB | 0 | N/A | 400 | 24 | 58.7 |
| 35 | HDT-MCB | 5.29 | 58.0 | 400 | 3 | 75.5 |
| 36 | HDT-MCB | 1.19 | 58.0 | 400 | 3 | 74.4 |
| 37 | HDT-MCB | 5.9 | 98.6 | 400 | 3 | 76.0 |
| 38 | HDT-MCB | 1.77 | 98.6 | 400 | 3 | 75.0 |
| 39 | HDT-MCB | 1.55 | 58.0 | 400 | 0.5 | 91.3 |
| 40 | HDT-MCB | 1.55 | 58.0 | 400 | 1 | 85.6 |
| 41 | HDT-MCB | 1.55 | 58.0 | 400 | 3 | N/D |
| 42 | HDT-MCB | 1.55 | 58.0 | 400 | 4 | 68.3 |
| 43 | HDT-MCB | 1.55 | 58.0 | 400 | 5 | 65.1 |

| Sample | Mesophase (vol %) | Softening Point (° C.) | MCRT (wt %) | C (wt %) | H (wt %) | N (wt %) | S (wt %) |
|---|---|---|---|---|---|---|---|
| 19 | 0.0 | 158.3 | 53.1 | 91.91 | 7.35 | 0 | 0 |
| 20 | 0.9 | N/D | N/D | N/D | N/D | N/D | N/D |
| 21 | 0.5 | N/D | N/D | N/D | N/D | N/D | N/D |
| 22 | 42.0 | N/D | N/D | N/D | N/D | N/D | N/D |
| 23 | 0.5 | N/D | 76.7 | N/D | N/D | N/D | N/D |
| 24 | 12.0 | N/D | 80.0 | N/D | N/D | N/D | N/D |
| 25 | 39.0 | N/D | 84.9 | N/D | N/D | N/D | N/D |
| 26 | 24.0 | 199 | 83.1 | 95.13 | 4.78 | 0 | 0 |
| 27 | 19.0 | N/D | N/D | N/D | N/D | N/D | N/D |
| 28 | 41.0 | N/D | 89.7 | N/D | N/D | N/D | N/D |
| 29 | 75.0 | N/D | N/D | N/D | N/D | N/D | N/D |
| 30 | 58.0 | N/D | 93.0 | N/D | N/D | N/D | N/D |
| 31 | 35.0 | N/D | N/D | 95.34 | 4.57 | 0.00 | 0.00 |
| 32 | 35.0 | 278.8 | N/D | N/D | N/D | N/D | N/D |
| 33 | 67.0 | N/D | 93.9 | N/D | N/D | N/D | N/D |
| 34 | 98.6 | >350 | 96.5 | N/D | N/D | N/D | N/D |
| 35 | 40.0 | N/D | N/D | N/D | N/D | N/D | N/D |
| 36 | 38.0 | N/D | N/D | N/D | N/D | N/D | N/D |
| 37 | 60.0 | N/D | N/D | N/D | N/D | N/D | N/D |
| 38 | 26.0 | N/D | N/D | N/D | N/D | N/D | N/D |
| 39 | N/D | N/D | N/D | N/D | N/D | N/D | N/D |
| 40 | 2.0 | N/D | N/D | N/D | N/D | N/D | N/D |
| 41 | 14.0 | N/D | N/D | N/D | N/D | N/D | N/D |
| 42 | 59.0 | N/D | N/D | N/D | N/D | N/D | N/D |
| 43 | 31.0 | N/D | N/D | N/D | N/D | N/D | N/D |

The kinetics of mesophase formation were monitored using x-ray scattering techniques, and polarized light microscopy. The kinetics of mesophase formation from the isotropic feed were determined from a series of heat treatments at different times at 400° C. The mesophase pitch sample was selected to act as a seeding agent for subsequent studies. The mesophase content in the seeding agent was varied between 25 wt % to 100 wt %. The seeding agent was added at different amounts to the isotropic feed and thoroughly mixed by grinding with a mortar and pestle to form a blend. The blend was then subject to the same heat treatment conditions as the control, and comparison was made between the kinetics of mesophase formation. The addition of the seed greatly accelerated the rate of mesophase formation, and potentially had significant consequences in increasing product throughput and reducing the energy costs (e.g., residence time at the pyrolysis temperature) associated with mesophase pitch formation.

Structural Characterization of Isotropic and Mesophase Pitches.

X-ray scattering measurements were done on a custom-made instrument that covers a broad range of scattering angles covering the length scales of interest. In addition some measurements were performed at a synchrotron source (Advanced Photon Source 12-ID beamline). Typical acquisition time was 5 minutes for the in-house X-ray machine, while 1 s was used for the synchrotron source. Samples were about 1 mm thick and sandwiched between kapton sheets. Kapton background scattering was subtracted from the data to determine the true sample scattering.

Characterization of the mesophase formation of the pitch samples was carried out using X-ray scattering techniques and polarized light microscopy (PLM). Scattered X-ray intensity was plotted against scattering angle or scattering vector. Two primary length scales were revealed in these measurements. The scattering contrast for the larger length scale arose from the condensed aromatic rings (high electron density part) and low electron density side groups, or small aromatic flexible groups. The smaller length scale contrast resulted from the ordering of disc-like molecules in the mesophase domains due to π-molecular or other electrostatic interactions due to their anisotropic shape. The scattering peak positions at smaller angles determined the intermolecular spacing (or average molecular dimensions for highly aromatic systems with relatively small side chains) while high angle peaks provided intermolecular stacking (ordering). When observed under polarized light microscope, the mesophase domains displayed optical anisotropy (birefringence). The mesophase content was determined from the area fraction of the birefringent areas in the PLM images.

Figures 3A, 3B:
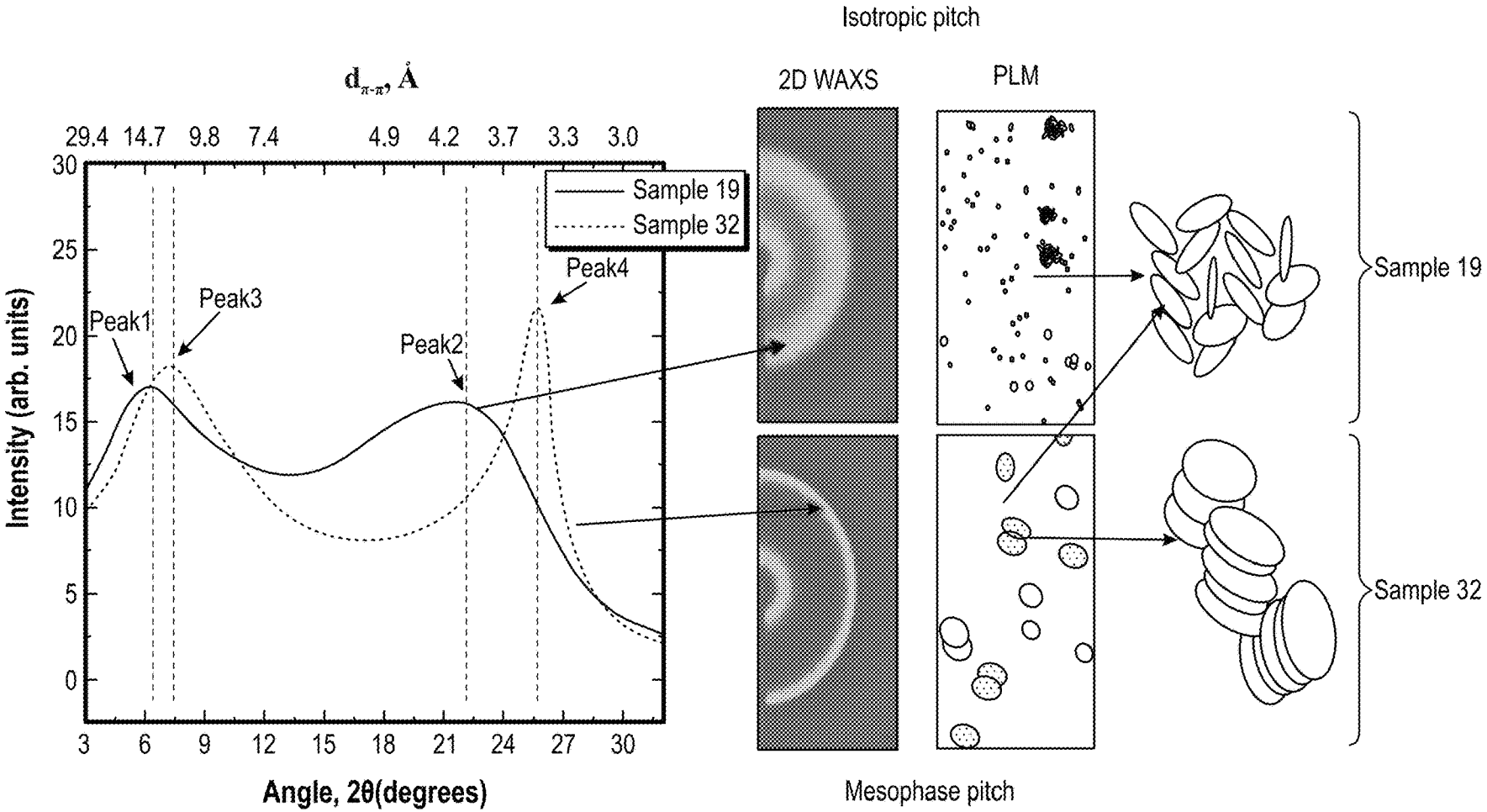
FIG. 3A is a graph depicting the X-ray scattering data of a hydrotreated main column bottom (HDT-MCB) isotropic pitch and its corresponding mesophase illustrated by the scattering intensities (arb. units) versus the scattering angle 2θ (degrees)
FIG. 3B is a reflected polarized light micrograph of the HDT-MCB isotropic pitch and the mesophase pitch produced from the material.

FIG. 3A is a graph depicting the room temperature X-ray scattering data of a hydrotreated main column bottom (HDT-MCB) isotropic pitch (Sample 19) and its corresponding mesophase (Sample 32) obtained by pyrolysis of Sample 19 at 400° C. for 6 h then subsequently cooling to room temperature, wherein the scattering intensities (arb. units) were recorded as a function of the scattering angle 2θ (degrees). FIG. 3A illustrates the scattered intensities (arb. units) recorded as a function of the angle 2θ (degrees). FIG. 3B is a reflected polarized light micrograph of the HDT-MCB isotropic pitch (Sample 19) and the mesophase pitch produced from the material (Sample 32). The corresponding two-dimensional wide-angle X-ray scattering (2D-WAXS) patterns and polarized light microscopy (PLM) images of Samples 19 and 32 are shown in FIG. 3B. The PLM images clearly indicated the presence of birefringent liquid crystal phase (spherules) in the pyrolyzed material (Sample 32). As shown in FIG. 3A, X-ray scattering profiles of Sample 19 were generally broad, reflecting poor structural correlations in the material. The diffuse peak around 6 degrees (2θ) (Peak 1, also referred to as the small angle peak) was indicative of weak lateral spatial correlations between aromatic molecules (electron density variations) a measure of average spacing between the molecules. Larger peak widths and low intensity could also be due to broader molecular size distribution and weaker electron density variations of aromatics (poor ordering), and any combination of both in these materials. While for Sample 19, the liquid-like scattering peak location at around 21 degrees (2θ) (Peak 2) was due to the electron density correlations of the molecules arising from the Van der Waals separation. After undergoing pyrolysis, the relative intensities of the peaks (Peaks 3 and 4) observed in Sample 32 increased and shifted to higher angles, due to improved ordering, and consequently due to the mesophase formation. The wide angle peak d(002) reflection (Peak 2) shifted from its original peak intensity maximum to higher values (21 degrees (2θ)) to about 26 degrees (2θ) (Peak 4). Whereas the width of Peak 4 decreased substantially while its intensity increased during the conversion of Sample 19 to mesophase Sample 32, indicating better ordering and larger spatial correlations in the system due to the π-π stacking of the disc-like molecules in the mesophase domains. The diffracted intensities were recorded as a function of the scattering vector q ($Å^{-1}$), which is related to the scattering angle 2θ and wavelength λ by the relation $q=(4\pi \sin \theta)/\lambda$. When coherently scattered X-rays from atoms in neighboring planes interfere with each other, then Bragg's law holds the following formula $d=2\pi/q$, wherein d is the distance between the atomic planes (also referred to as domain spacing or d-spacing).

The low angle peak was displayed at about q=0.505 $Å^{-1}$, at a d-spacing d=12.4 Å, and a wide angle peak d(002)=3.49 Å, with a corresponding q=1.8 $Å^{-1}$; where the latter is considered as the incipient-structure to the graphitic domains seen in carbon fibers. Therefore, a peak position approaching the scattering vector q of about 1.8 Å was indicative of the formation of mesophase, which can be observed on the PLM images (see FIG. 3B) as large birefringent droplets (spherules). As a reference, the typical graphitic inter-planar spacing was observed to be around 3.35 Å.

Mesophase Formation: Kinetics of Nucleation, Growth and Seeding Effects.

Phase separation of disc-like molecules from an isotropic medium in a petroleum feedstock was carried out under isothermal conditions, forming a discotic nematic liquid crystalline phase. Such an isotropic to nematic transition is a complex problem when compared to single component liquid crystal systems, wherein the phase separation (isotropic-nematic transition) is driven when the system goes through isotropic-nematic transition temperature. Such complexity is primarily due to the heterogeneity of the pitch, as well as the concurrent chemical transformations occurring within the pitch during the phase separation. FIGS. 4A, 4B, 4C, 5A, 5C, and 5D are non-limiting examples of the incipient stages of nucleation and growth kinetics of mesophase domains in various isotropic pitches, such as HDT-MCB pitches (FIGS. 4A, 4B, and 4C; Sample 19 (at 0 h), Sample 21 (at 3 h), Sample 25 (at 4 h), Sample 29 (at 5 h), Sample 32 (at 6 h), Sample 33 (at 12 h), and Sample 34 (at 24 h)), and HDT-SCT pitches (FIGS. 5A, 5C, and 5D; Sample 1 (at 0 h), Sample 2 (at 1 h), Sample 3 (at 2 h), Sample 4 (at 3 h), Sample 5 (at 4 h), Sample 6 (at 5 h), and Sample 8 (at 6 h)).

Figure 4A:
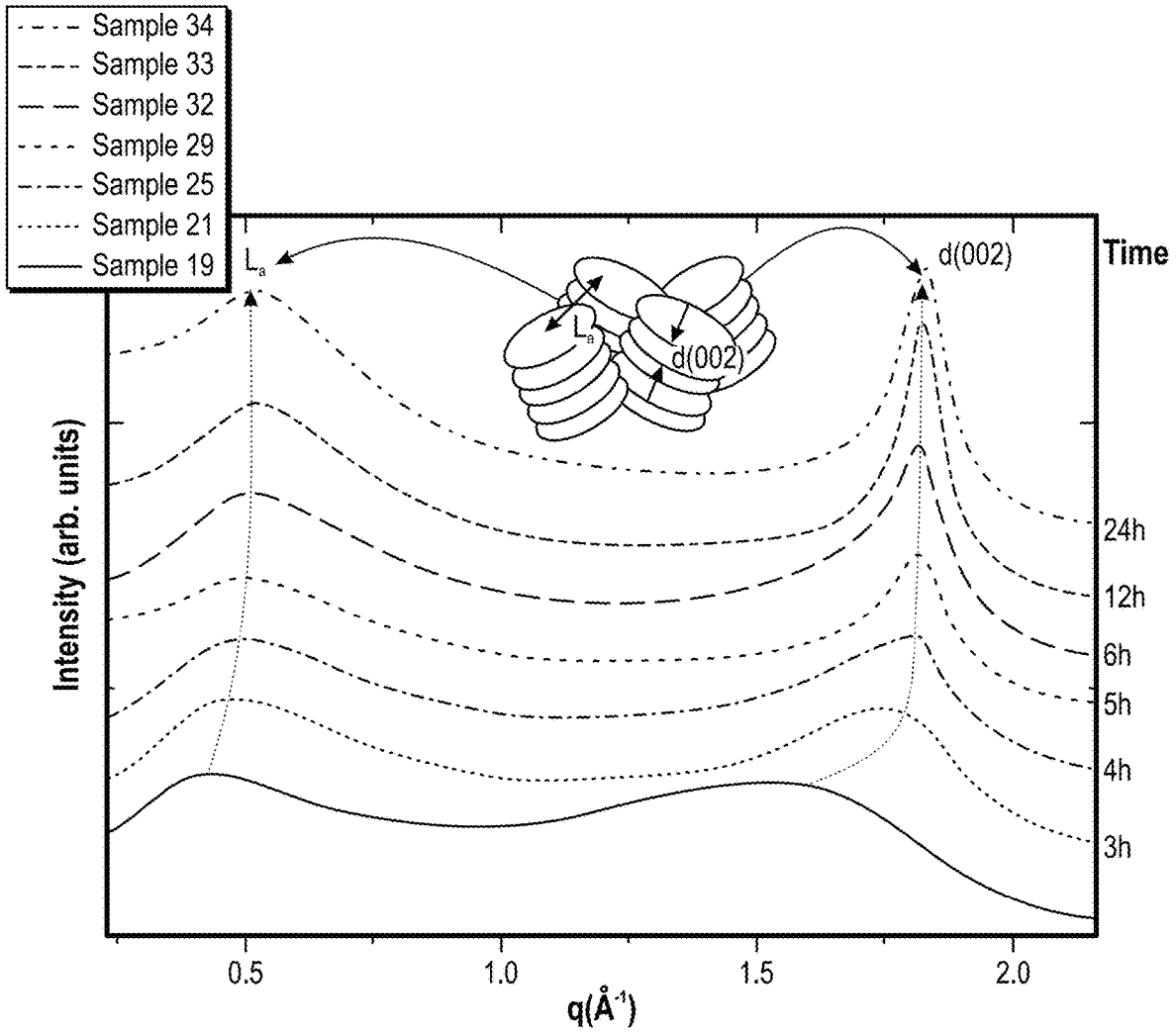
FIG. 4A is a graph depicting the X-ray scattering data of an isotropic HDT-MCB pitch at various pyrolysis times.
Figure 4B:
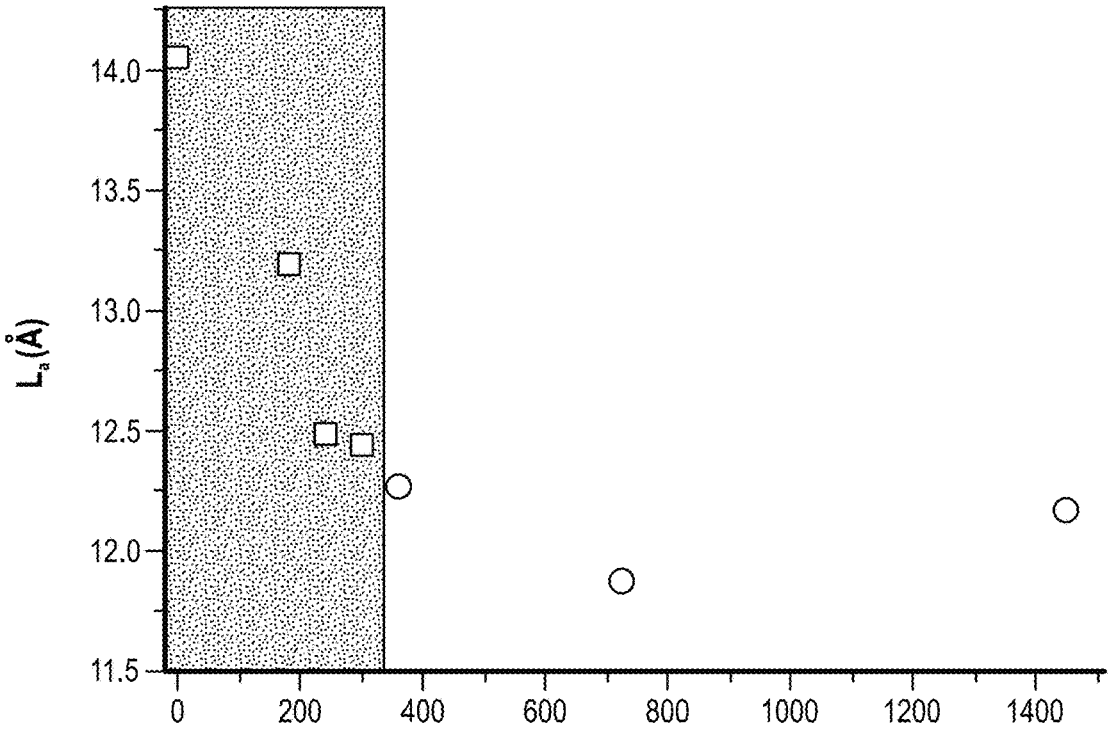
FIG. 4B is a graph depicting the average spacing of the molecules $L_a$ (Å) as a function of the time (minutes)
Figure 4C:
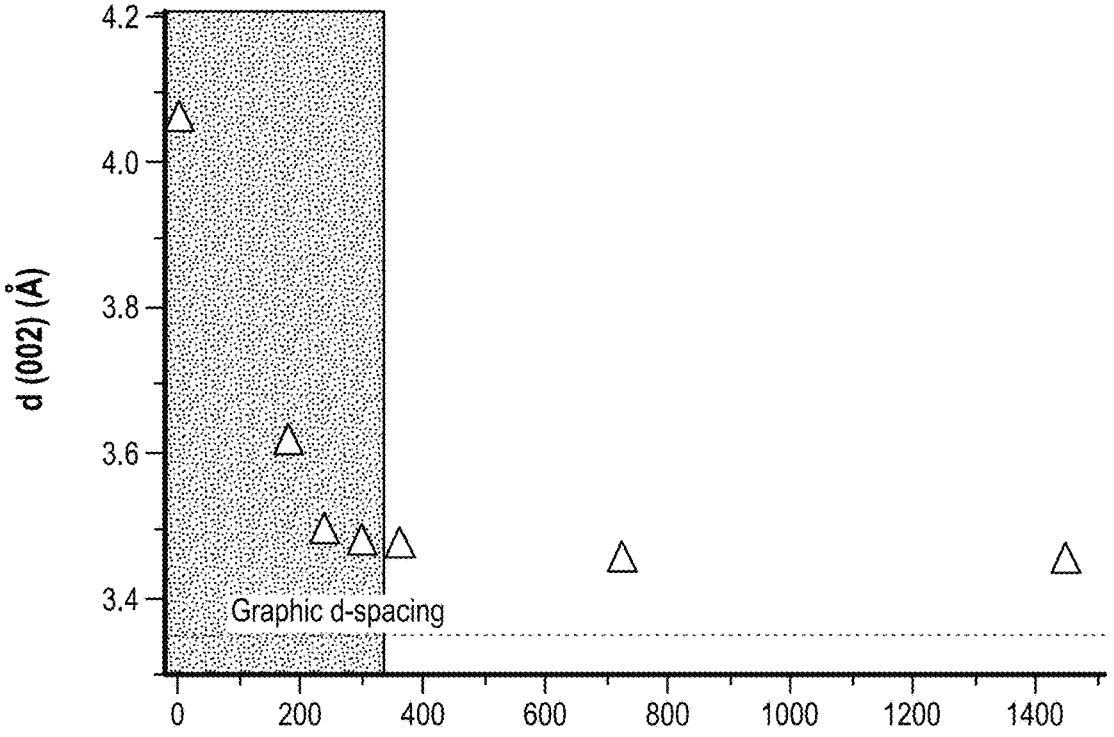
FIG. 4C is a graph depicting the "π-π stacking" (interlayer) distance between the molecules $d_{\pi-\pi}$ (Å) as a function of the time (minutes).

FIG. 4A is a graph depicting the X-ray scattering data of an isotropic HDT-MCB pitch (Sample 19) converted into its corresponding mesophase. Herein, the scattered intensities (arb. units) were recorded as a function of the scattering vector q ($Å^{-1}$) at room temperature. Sample 19 was pyrolyzed at 400° C. for various period of time (e.g., pyrolysis for 0, 3, 4, 5, 6, 12, and 24 hour(s), and subsequently cooled back to room temperature. The progression of the scattering peak positions observed at room temperature are reflective of the phase separation within the material during pyrolysis. FIG. 4B illustrates the average "center-to-center" distance between the molecules $L_a$ (Å) as a function of pyrolysis time (minutes) of Sample 19. FIG. 4C illustrates the interplanar spacing (π-π stacking distance) obtained from the wide angle peak intensity maximum between the molecules, $d_{\pi-\pi}$ (Å), as a function of the time (minutes) for the pyrolysis of Sample 19. Accordingly, the resulting time dependent pyrolysis data suggests a notable reduction in the average spacing (or average dimension of the molecules) of the molecules as the pyrolysis time increased, in addition to the increase of mesophase content.

The X-ray scattering data of Sample 19 displayed two broad reflections with peak maximums located at a scattering vector q of about 0.5 $Å^{-1}$ and a scattering vector q of about 1.6 $Å^{-1}$. As shown in FIG. 4A, as the pyrolysis time of the isotropic pitch Sample 19 increased, the width of the peaks representing the $L_a$ (Å) and the $d_{\pi-\pi}$ (Å) of Sample 19 decreased. On the other hand, as the pyrolysis time of Sample 19 increased, the heights of the peaks representing the $L_a$ (Å) and the $d_{\pi-\pi}$ (Å) of Sample 19 increased, as well as their corresponding q ($Å^{-1}$) value of the peak intensity maximum. For example, after heating Sample 19 for 3 hours, the corresponding mesophase pitch (Sample 21) formed therefrom exhibited the wide angle reflection with an intensity maximum at a scattering vector q of about 1.75 $Å^{-1}$, closer to the peak position of the ordered discotic mesophase, located at 1.8 $Å^{-1}$. After heating Sample 19 for 4 hours, the X-ray data of the resulting mesophase pitch (Sample 25) showed the formation of a "shoulder" at the scattering vector q of about 1.8 $Å^{-1}$, suggestive of the growth of mesophase spherules, which was confirmed by mesophase content estimated from PLM measurements at room temperature (see FIGS. 8A-8C). As the pyrolysis time increased, the scattering intensity of both peaks increased, indicative of an enhancement of ordering and mesophase content with pyrolysis time. As shown in FIG. 4B, for up to 12 hours (720 minutes) of pyrolysis, the small angle peak associated with the average molecular spacing $L_a$ (Å) of the pitch displayed a shift from 14 Å to 12 Å. Without being bound by any theory or mechanism, the cracking off of alkyl side groups from the pitch may be resulting in an effective decrease in the average distance between molecules.

As shown in FIG. 4C, as the pyrolysis time of Sample 19 increased, the $d_{\pi-\pi}$ (Å) of Sample 19 decreased. Without being bound by any theory or mechanism, the cyclization, dealkylation, and dehydrogenation reactions occurring during pyrolysis may enable the decrease in intermolecular distance between the aromatic rings due to the increasingly planar and condensed ring structure of the molecules. Consequently, the high angle reflection gradually shifted to higher q-region. After a pyrolysis period of 4 hours (Sample 25), a wide angle peak d(002) reflection at 3.5 Å was observed. Thus, the time scale needed to reach the onset of nucleation was observed to be greater than 3 hours and the subsequent data (e.g., X-ray scattering data obtained after 4 hours of pyrolysis of Sample 19) specified that mesophase continued to grow fast thereafter.

Figure 5A:
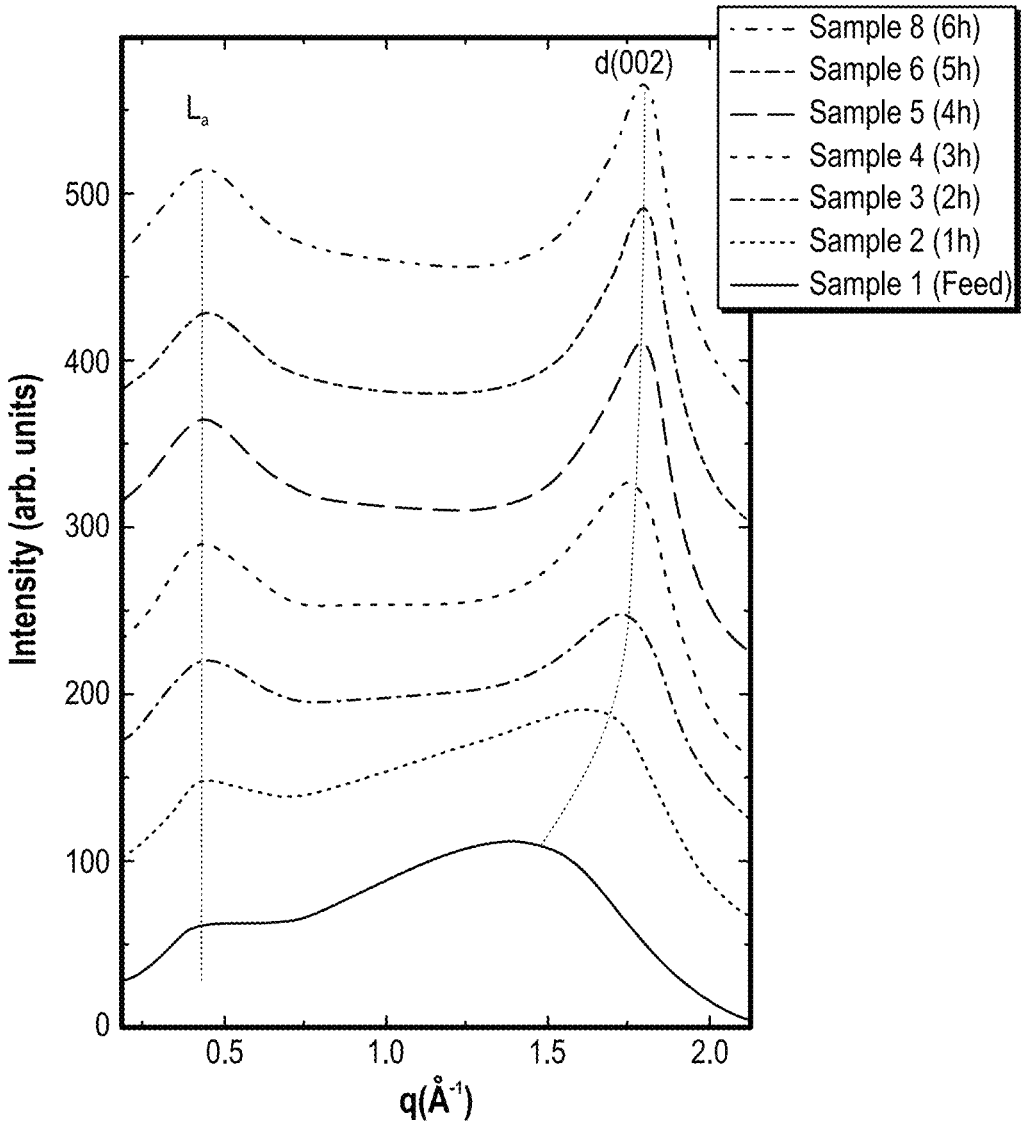
FIG. 5A is a graph depicting the X-ray scattering data of an unseeded hydrotreated steam cracker tar (HDT-SCT) isotropic pitch at various pyrolysis times.
Figure 5B:
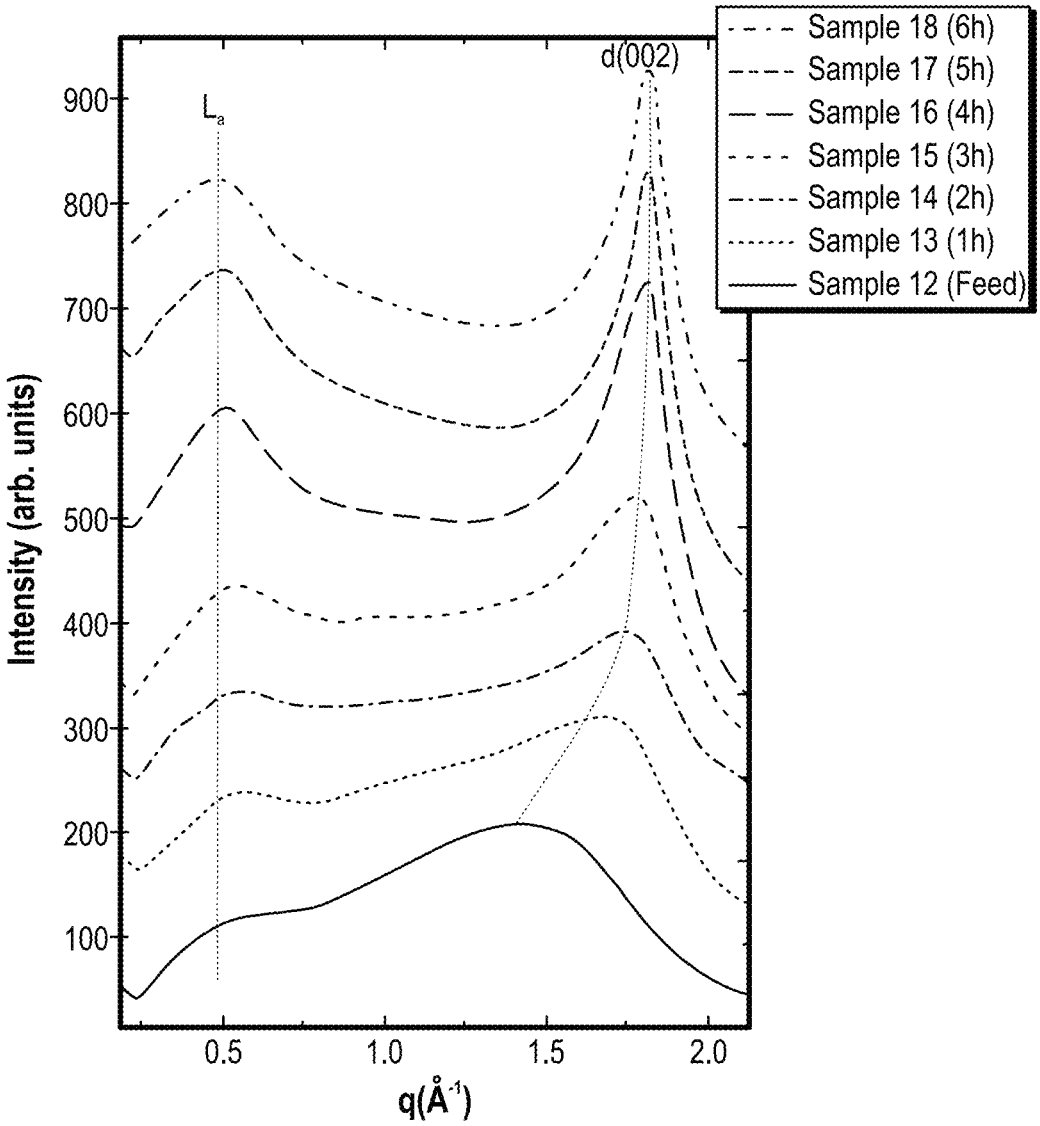
FIG. 5B is a graph depicting the X-ray scattering data of a seeded hydrotreated steam cracker tar (HDT-SCT) isotropic pitch at various pyrolysis times.
Figure 5C:
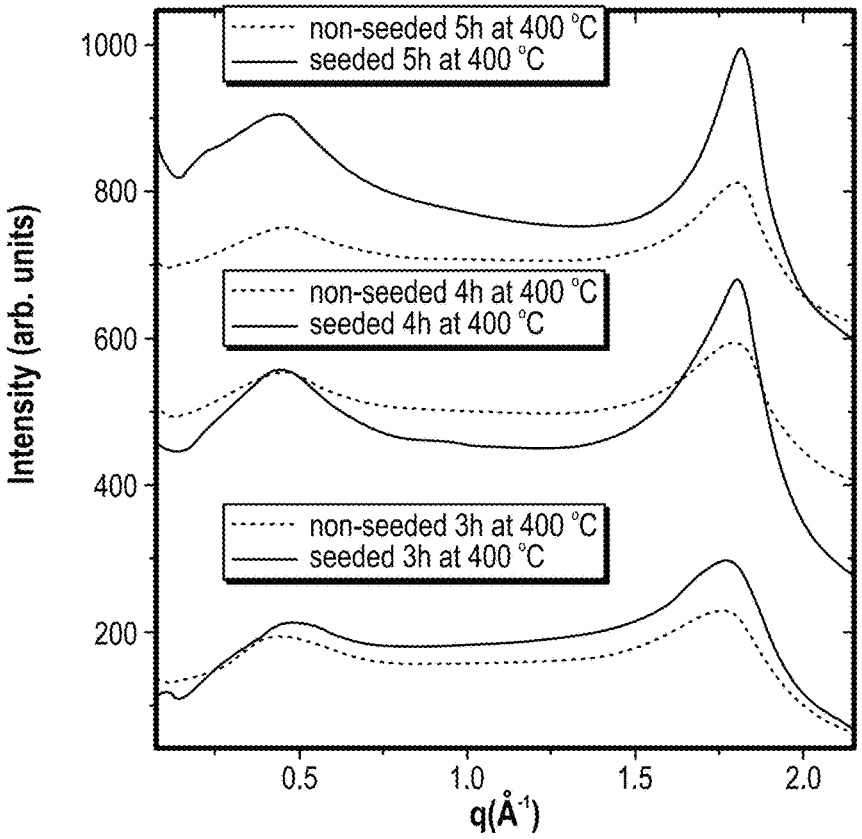
FIG. 5C is a graph comparing the pyrolyzed unseeded and seeded hydrotreated steam cracker tar (HDT-SCT) pitch at 3 h, 4 h, and 5 h.
Figure 5D:
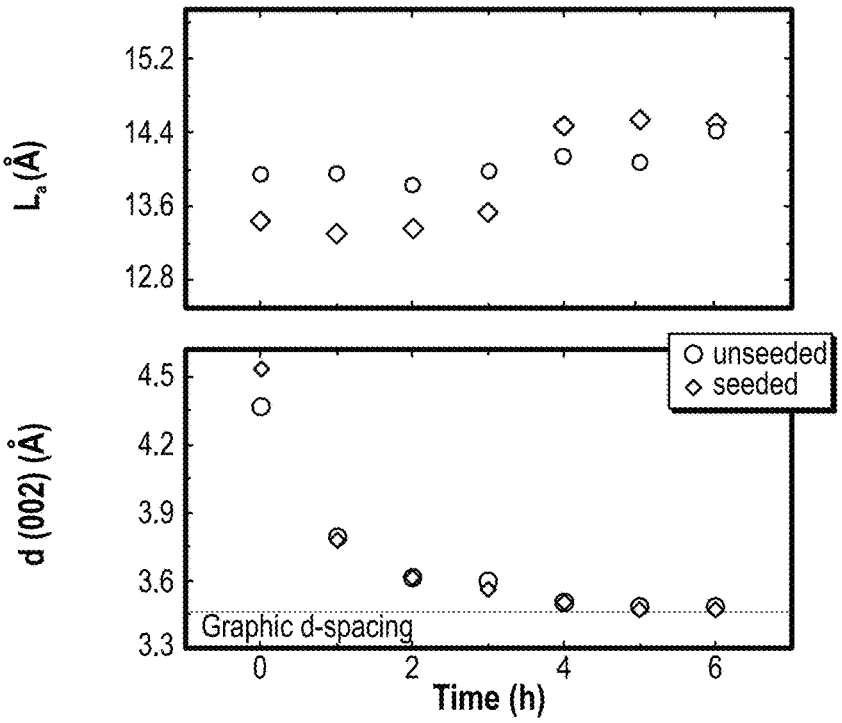
FIG. 5D is a graph depicting the change in d-spacing observed for the unseeded and seeded hydrotreated steam cracker tar (HDT-SCT)
Figure 6:
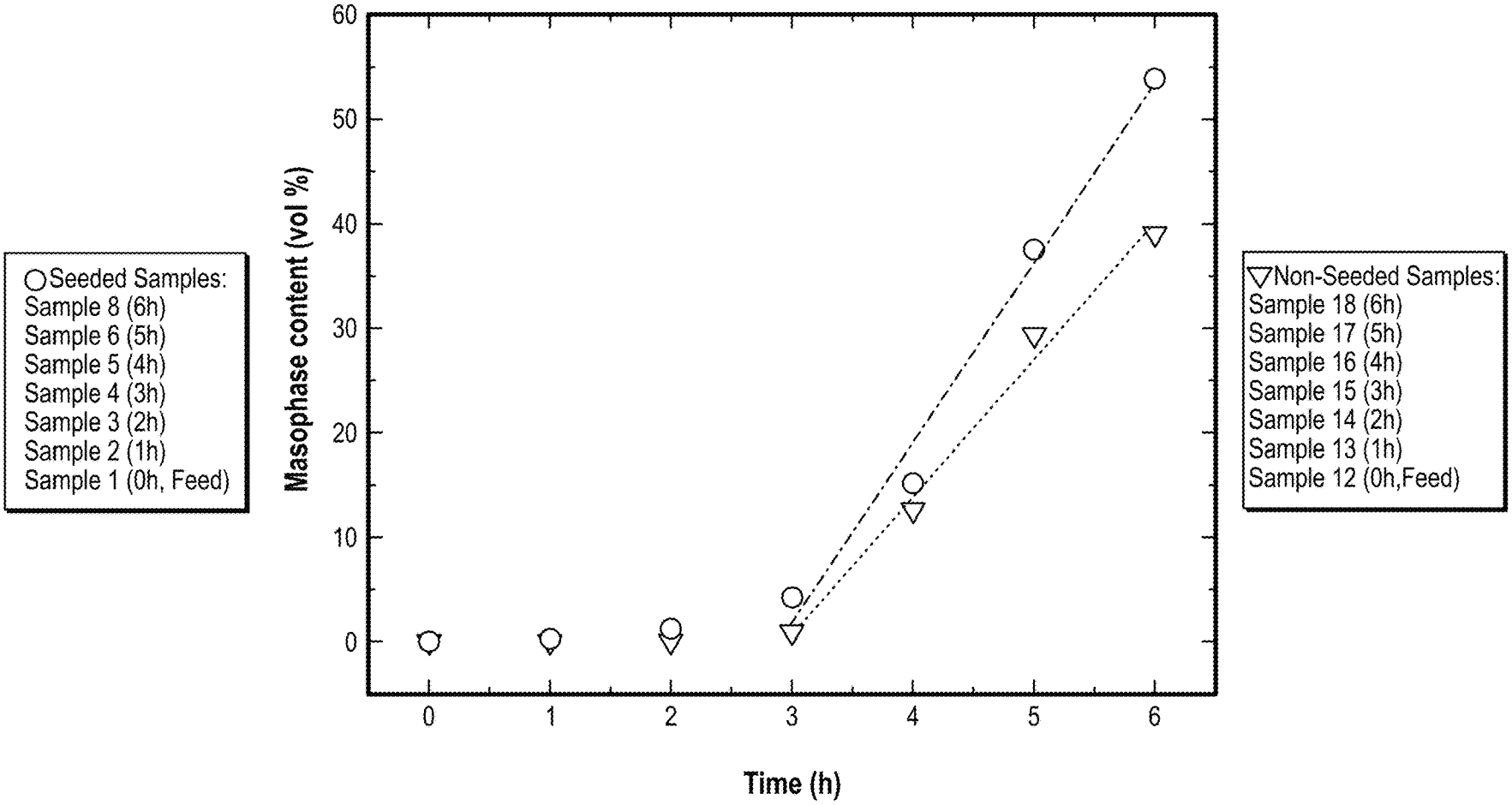
FIG. 6 is a graph depicting the increase in mesophase content (vol %) during the pyrolysis of an unseeded and seeded HDT-SCT pitch at 400° C. as a function of time (hour).

FIG. 5A is a graph depicting the room temperature X-ray scattering data of hydrotreated steam cracker tar (HDT-SCT) isotropic pitch (Sample 1) at various pyrolysis times (Sample 2 (at 1 h), Sample 3 (at 2 h), Sample 4 (at 3 h), Sample 5 (at 4 h), Sample 6 (at 5 h), and Sample 8 (at 6 h)); FIG. 5B is a graph depicting the X-ray scattering data of a seeded hydrotreated steam cracker tar (HDT-SCT) isotropic pitch produced from Sample 4 in the presence of a seeding agent (Sample 12, produced from a portion of Sample 4 via pyrolysis for 5 hours at 400° C.), at various pyrolysis times (e.g., Sample 13 (at 1 h), Sample 14 (at 2 h), Sample 15 (at 3 h), Sample 16 (at 4 h), Sample 17 (at 5 h), and Sample 18 (at 6 h)); FIG. 5C is a graph illustrating the comparison of the scattering profiles between the unseeded (Sample 4, 5, and 6) and seeded hydrotreated steam cracker tar (HDT-SCT) materials (Sample 7, Table 1). FIG. 5D (top panel) is a graph depicting the average spacing between the molecules $L_a$ (Å) as a function of the time (minutes) of the unseeded (Sample 1) and the seeded hydrotreated steam cracker tar (HDT-SCT) isotropic pitch (Sample 7, Table 1); FIG. 5D (bottom panel) is a graph depicting the "π-π stacking" or interlayer distance between the molecules $d_{\pi-\pi}$ (Å) as a function of the time (minutes) of the unseeded (Sample 1) and the seeded hydrotreated steam cracker tar (HDT-SCT) isotropic pitch (Sample 7, Table 1). Sample 1 was heated at 400° C. for 1, 2, 3, 4, 5, and 6 hour(s), and subsequently cooled back to room temperature. The mesophase content was estimated by PLM measurements carried out at room temperature. The mesophase content of Sample 1 was determined to be at 0 vol % after 1 hour of pyrolysis (Sample 2), 0 vol % after 2 hours of pyrolysis (Sample 3), about 0.9 vol % after 3 hours of pyrolysis (Sample 4), 12.6 vol % after 4 hours of pyrolysis (Sample 5), about 29.3 vol % after 5 hours of pyrolysis (Sample 6), and about 39 vol % after 6 hours of pyrolysis (Sample 8), based on the total volume of the pitch (see FIG. 6 and Table 1). Regarding the X-ray scattering data of Sample 1, FIG. 5A displayed two broad peaks centered at a scattering vector q of about 0.4 $Å^{-1}$ and a scattering vector q of about 1.5 $Å^{-1}$. As the pyrolysis time of Sample 1 increased, the width of the peaks representing the $L_a$ (Å) and the $d_{\pi-\pi}$ (Å) of Sample 1 decreased (peak maximum shifted to higher q), while the heights of both $L_a$ (Å) and $d_{\pi-\pi}$ (Å) peaks increased, suggesting a progressive ordering of the material. FIG. 5C showed that when seeded, Sample 4 was converted into corresponding mesophase faster than when Sample 4 was not seeded. This trend is clear in the data comparison, FIG. 5C, where higher intensity small and high angle peaks were observed for seeded sample indicative of better ordering and higher mesophase content in comparison to unseeded sample. This data is supported by PLM measurements which showed higher mesophase content for the seeded samples in comparison to unseeded samples prepared under identical conditions. FIG. 5D (top) illustrates that the average spacing between the molecules $L_a$ (Å) as a function of pyrolysis time (minutes) did not show a systematic change of $L_a$ (Å) values during the mesophase conversion process. FIG. 5D (bottom) reveals that the interlayer distance between the molecules, $d_{\pi-\pi}$ (Å), decreased as a function of pyrolysis time (hours) for Sample 1. After a relatively rapid initial decrease in the $d_{\pi-\pi}$ (Å) distance with time, the rate of change markedly decreased as the mesophase begun to form. This observation is similar to what was observed with the HDT-MCB pitch (Sample 19).

For HDT-SCT materials, Sample 4 (at 3 hours), a stack height (LC) of about 3.6 nm was obtained, which corresponds to N~11 molecules in the stack. Further heating to 4 hours (Sample 5), a stack height, $L_C$ of about 4.4 nm (N~13.5 molecules) was obtained. For 5 hours (Sample 6), an $L_C$ of about 4.5 nm (N~14 molecules) was obtained. However, in the presence of a seeding agent (Sample 12, produced from a portion of Sample 7 via pyrolysis for 5 hours at 400° C.) notable change in stack height was not observed (3 hours, $L_C$ of about 3.6 nm; 4 hours, $L_C$ of about 4.8 nm; 5 hours, $L_C$ of about 4.5 nm) in comparison to the unseeded materials. The observed increase in peak intensity of the seeded materials was due to higher mesophase content in comparison to the unseeded materials.

Growth of mesophase domains in petroleum pitch compositions was initiated using a mesophase seed-based seeding agent.

Figure 7:
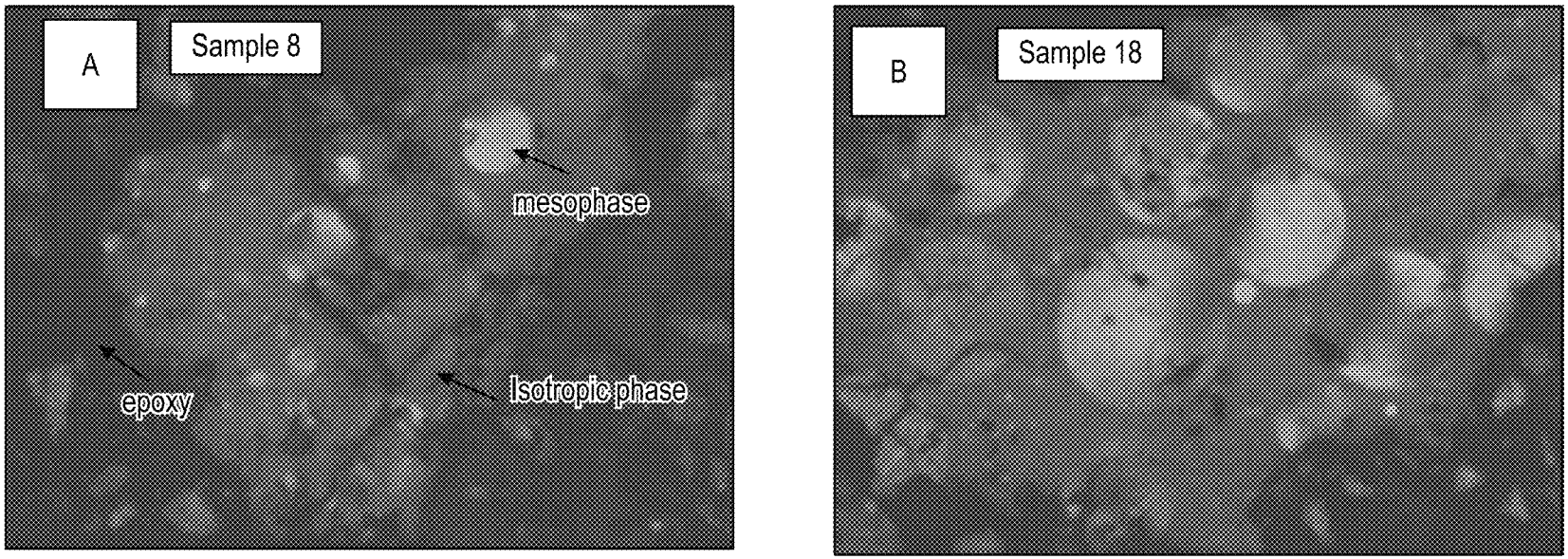
FIG. 7A is a polarized light microscopy image of HDT-SCT unseeded pitch material pyrolyzed at 400° C. for 6 h.
FIG. 7B is a polarized light micrograph of a HDT-SCT seeded pitch material pyrolyzed at 400° C. for 6 h.

FIGS. 7A and 7B illustrate PLM images of the HDT-SCT unseeded material (FIG. 7A, Sample 1) and the HDT-SCT seeded material (Sample 18) (FIG. 7B, blend composition comprising Sample 1 and a mesophase seed produced from a portion of Sample 1, which was pyrolyzed for 6 hours at 400° C.; seen Table 1). Seeding showed higher mesophase fraction (birefringent droplets) relative to the unseeded sample (Sample 1). Both HDT-SCT unseeded material (Sample 1) and seeded material (Sample 18) were embedded in epoxy, the uniformly dark regions in the micrographs, before being polished until mirror-smooth for reflected light microscopy. For maximum clarity, reflected light microscopy required a highly reflective surface which was achieved by polishing Sample 1 and Sample 18 with successively finer abrasives. Epoxy, formed by curing a mixture of a resin and a complimentary hardener, was used as a hard and homogeneous substrate and used to embed and stabilize the pitch particles of the samples during the lengthy polishing process.

Figure 8A:
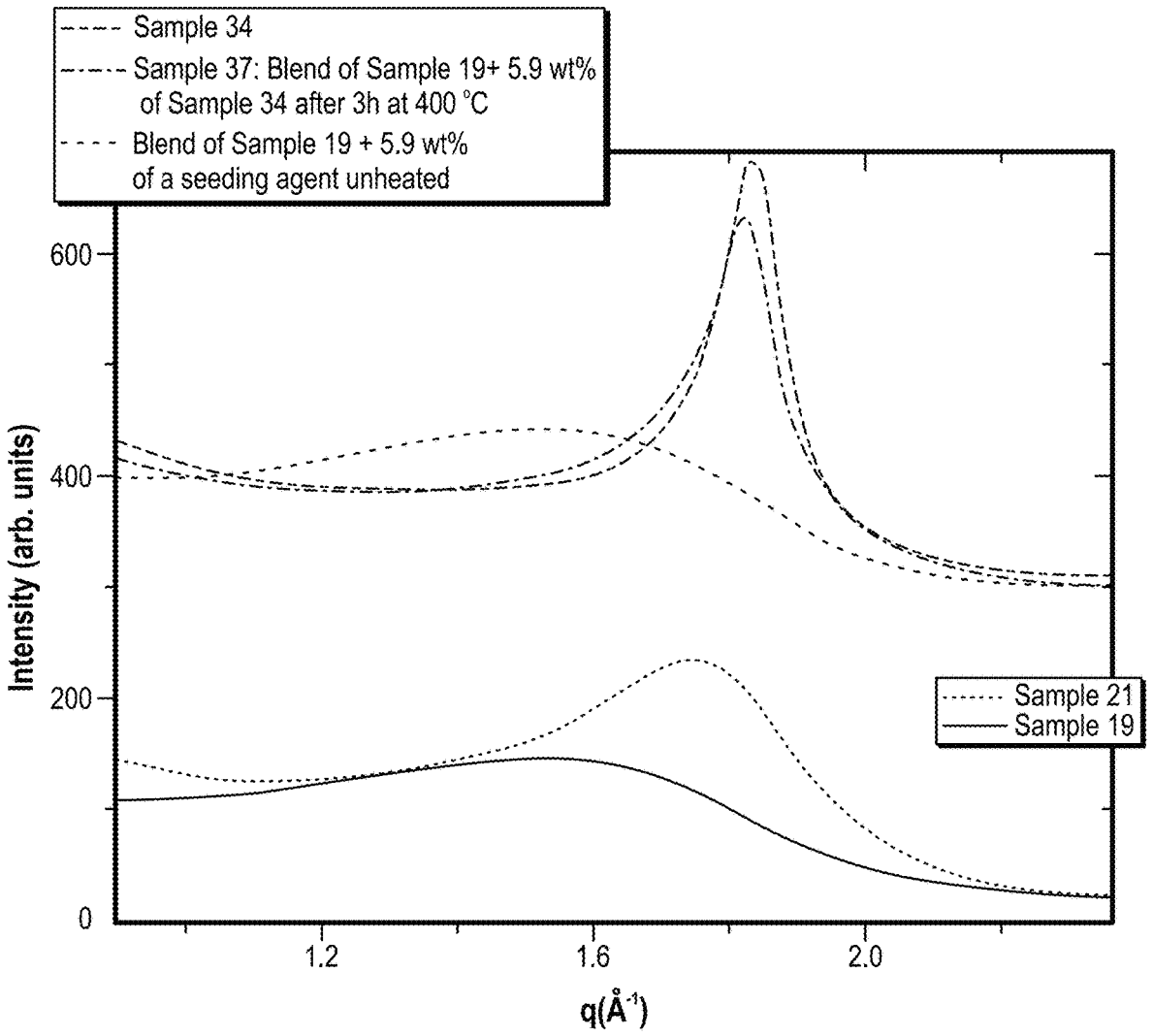
FIG. 8A is a graph comparing the X-ray scattering data of a hydrotreated MCB isotropic pitch, the mesophase pitch produced after pyrolysis in the presence or absence of a seeding agent of various composition, and the pure seeding agent.

FIG. 8A is a graph depicting the X-ray scattering results of an isotropic HDT-MCB pitch (Sample 19) pyrolyzed for 3 hours at 400° C. (Sample 21) in the presence and in the absence of a seed. After the pyrolysis, the samples were cooled back to room temperature and the X-ray measurements were conducted. The samples included in FIG. 8 are: Samples 19, 30, 34, 37, and the blend comprising Sample 19 and the seeding agent (Sample 34, produced after pyrolysis of Sample 19 for 24 hours, see Table 2), used for the production of Sample 37. FIG. 8A (top) compares the scattering profiles for the seeding agent (Sample 34), the heat treated seeded product (Sample 37), and the seeded feed. FIG. 8A (bottom) compares the scattering profiles of the heat treated HDT-MCB sample (Sample 32) and its corresponding feed (Sample 19).

A blend composition comprising Sample 19 and 5.9 wt % of the seeding agent (Sample 34), based on the total weight of the blend composition was prepared. In order to thoroughly mix and increase the surface to volume ratio between the unseeded HDT-MCB isotropic pitch (Sample 19) and the seeding agent (Sample 34), Sample 34 and Sample 19 were crushed and thoroughly blended with a mortar and pestle. X-ray scattering data indicates that the seeding had a strong effect on the conversion process from isotropic to mesophase. After 3 hours of pyrolysis at 400° C., the blend composition (Sample 37) displayed a narrower high angle scattering (002) reflection, when compared to the corresponding scattering peak location of Sample 19 in the absence of the seeding agent (Sample 34). Additionally, the peak maximum of (002) reflection increased from a q value of about 1.7 $Å^{-1}$ to a q value of about 1.8 $Å^{-1}$ upon seeding, indicating enhanced mesophase ordering (π-π stacking). Moreover, the peak shapes significantly differed. Heat treated Sample 19 (Sample 21) yielded a broad peak, whereas a sharper peak was obtained in the seeded material (Sample 37), indicating better ordering and higher mesophase content. PLM measurements confirmed more mesophase in the seeded materials (Sample 37) in comparison to the non-seeded case (Sample 19).

Figure 8B:
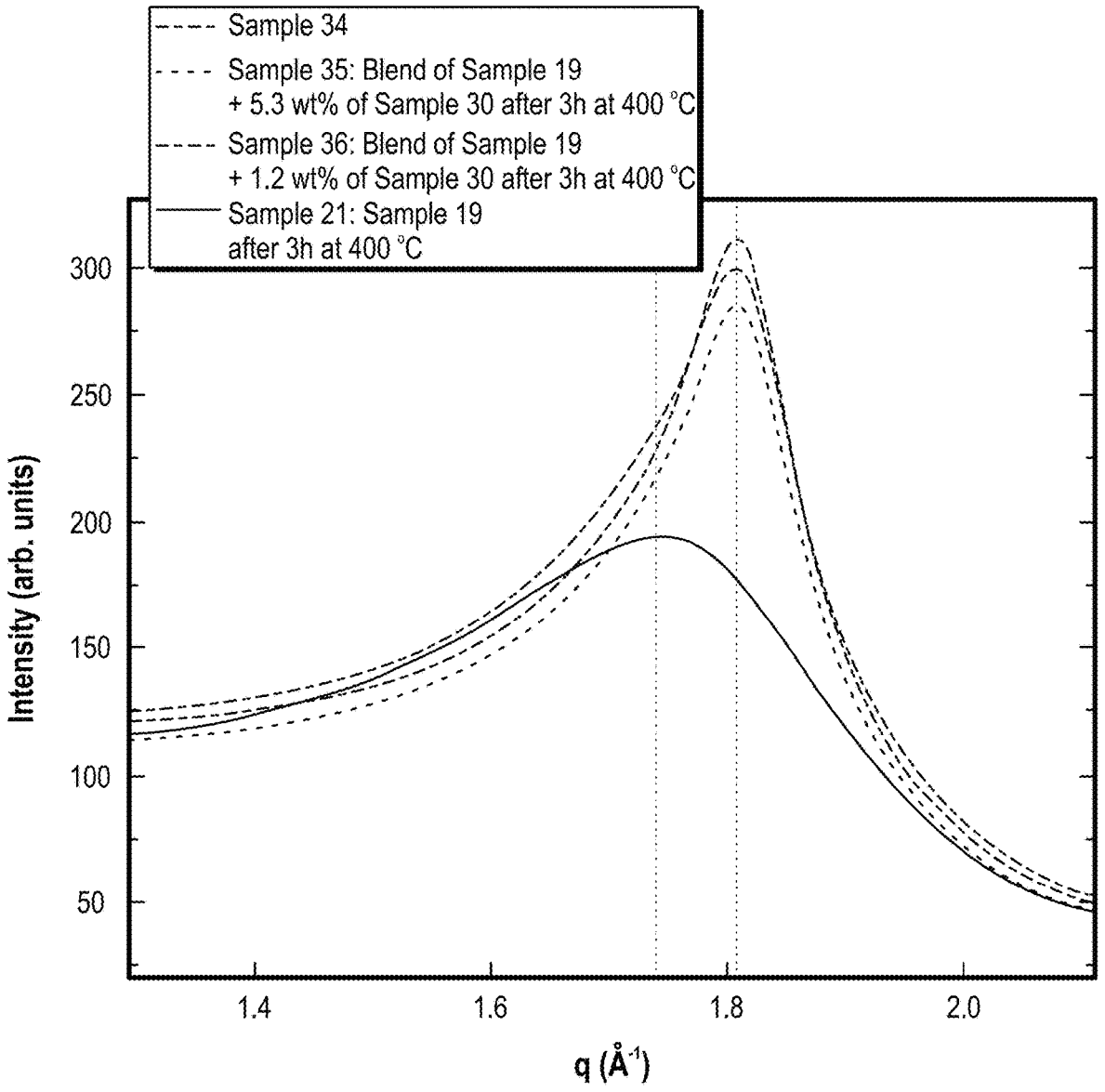
FIG. 8B is a graph comparing the scattering profiles of the seeding agent, its effect on the resulting mesophase pitch at different concentrations, and the mesophase pitch produced in its absence.

FIG. 8B is a graph comparing the room temperature scattering profiles of the mesophase materials produced in the presence and absence of the seeding agent (Samples 35, 36, and 21), and the scattering profile of a near 100% mesophase sample (Sample 34). Two different loadings were used when preparing the seeded blend, which are illustrated in FIG. 8B. FIG. 8B reveals narrow peak width and greater peak height for the seeded samples (Samples 35, produced from the blend comprising Sample 19 and 5.3 wt % of seeding agent Sample 30; and 36, produced from the blend comprising Sample 19 and 1.2 wt % of seeding agent Sample 30), in comparison to the non-seeded Sample 21, for which both Samples 35 and 36 were heat treated under identical conditions, indicating better (improved) ordering and higher mesophase content.

Figure 8C:
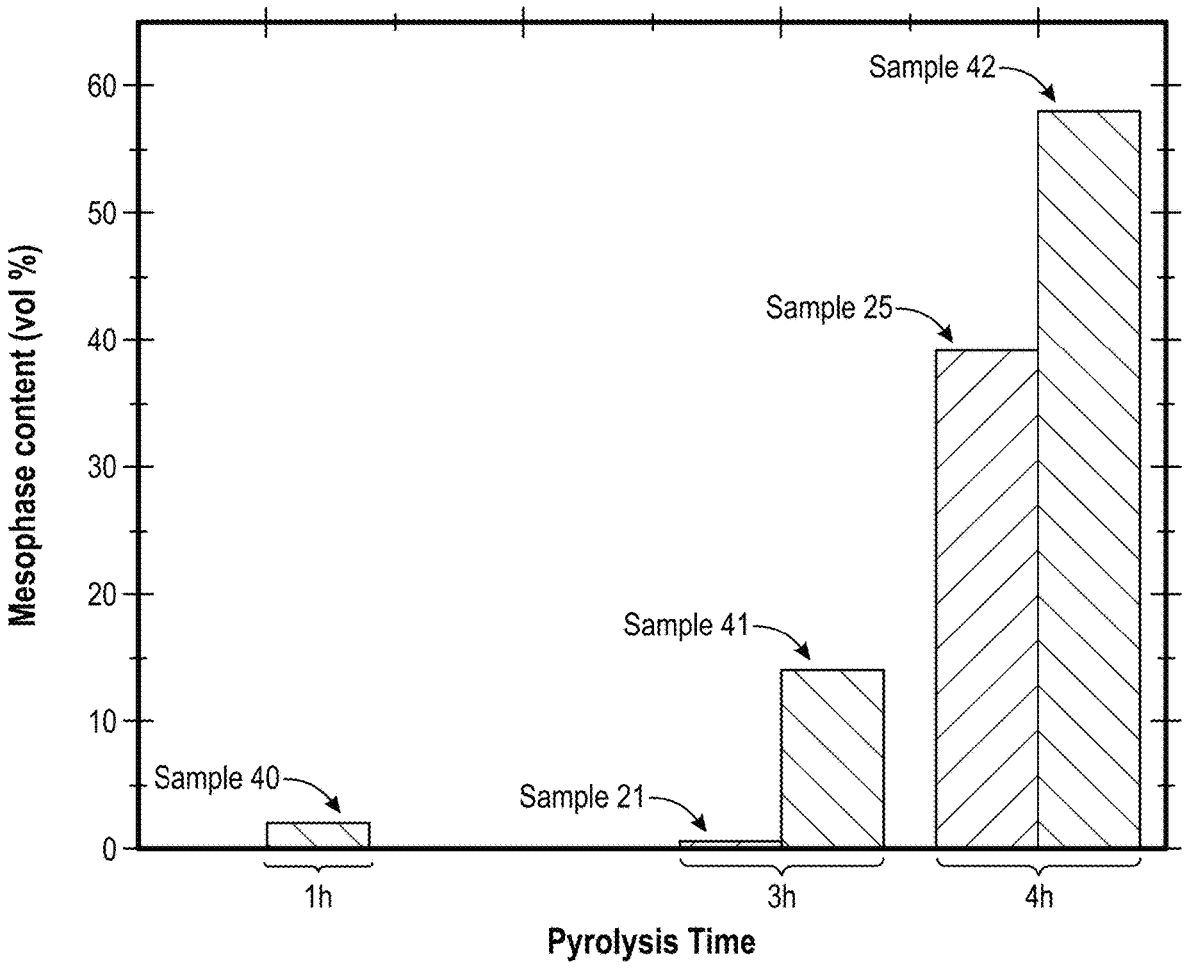
FIG. 8C is the comparison of the mesophase content of the seeded and unseeded samples at different pyrolysis times measured using polarized light microscopy.
Figure 8F:
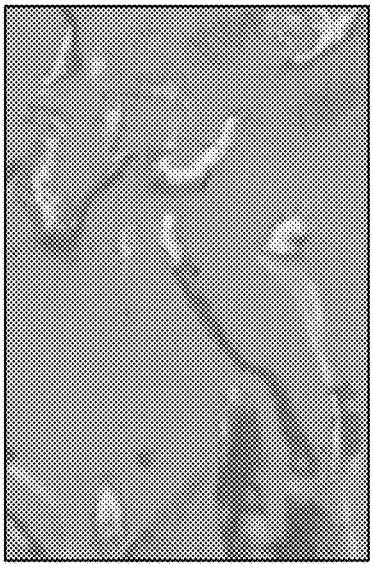
FIGS. 8D-F are representative examples of reflected polarized light micrographs of seeded and unseeded pitch materials.
Figure 8E:
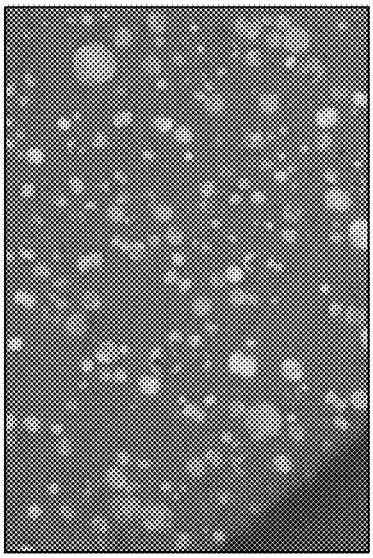
Figure 8D:
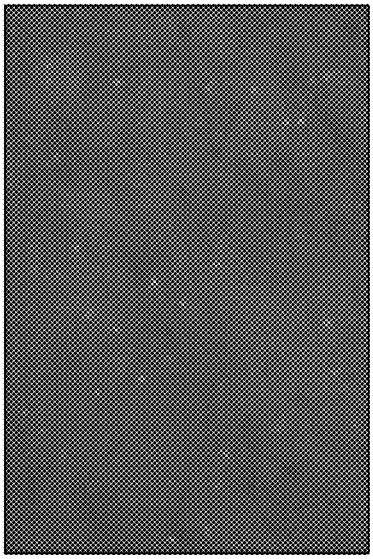

FIG. 8C compares the increase in mesophase content (vol %) measured by polarized light microscopy (PLM) for seeded samples (Samples 40, 41, and 42), and non-seeded samples (Sample 21 and 25). The seeded blend comprises Sample 19 and 1.55 wt % of the seeding agent Sample 30 (see Table 2), based on the total weight of the blend composition, as a function of pyrolysis time. FIGS. 8D and 8E are micrographs comparing the amounts of mesophase formed from a non-seeded and seeded material heat treated for 3 hours at 400° C., Sample 21 and Sample 36, respectively. FIG. 8F is the PLM micrograph of Sample 19 heated for 24 hours at 400° C. (Sample 34). FIGS. 8D and 8E shows a significantly larger mesophase content upon seeding. These results confirm greater mesophase transformation rate by seeding the isotropic pitch (Sample 19).

Figure 9:
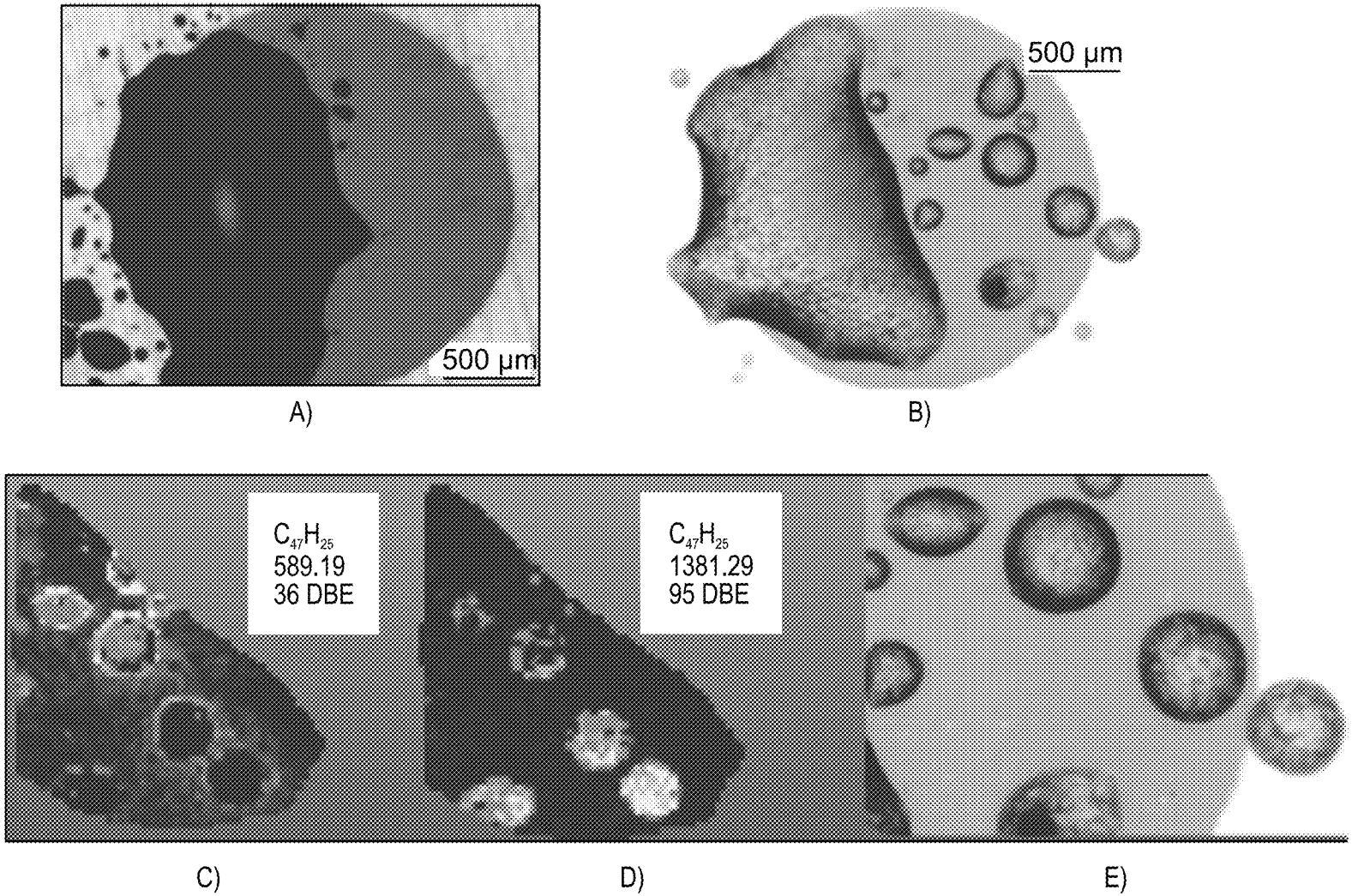
FIG. 9A is a reflected polarized light micrograph of a melted petroleum pitch on a glass slide, acquired just prior to pyrolysis.
FIG. 9B is a reflected polarized light micrograph of the same petroleum pitch sample shown in (A) but after pyrolyzing for 1 hour at 400° C., which is subsequently subjected to mass spectrometry imaging (MSI).
FIGS. 9C-D illustrate a mass spectrometry imaging (MSI) of a mesophase pitch.
FIG. 9E is a reflected polarized light microscopy image of the corresponding sample region analyzed by MSI.

FIGS. 9A-6E illustrate the mass spectrometry imaging (MSI) methodology of a material derived from FCC (Fluid Catalytic Cracking) main column bottoms, an isotropic petroleum pitch (Sample 44) with the following properties: a T10=402° C., a T50=569° C., and a T87=750° C., an MCR of 52.5 wt %, 93.45 wt % C, 5.50 wt % H, 0.23 wt % N, 0.51 wt % S, based on the total weight of the pitch (Sample 44), and a softening point of 127° C., enabling a 2-dimensional analysis of the material. Sample 44 was deposited on the surface of a glass substrate: a small amount of the petroleum pitch (<10 μg) was deposited onto a glass coverslip and, under an inert atmosphere, was gradually melted. Heat treatment of Sample 44 at approximately 400° C. at a defined period of time (depending on the targeted mesophase content), allowed conversion of the corresponding isotropic pitch molecules to planar aromatic structures that phase separated, forming a liquid crystalline mesophase. Once cooled and solidified, reflected polarized light microscopy images were acquired in order to visualize and quantify the mesophase domains. The sample was then transferred to an indium-tin-oxide (ITO slide) for mass spectrometry analysis. A laser desorption ionization (LDI) was used to generate ions in the gas phase for analysis. Notwithstanding, a matrix-assisted laser desorption/ionization (MALDI) analysis was also suitable herein, requiring the addition of a suitable matrix for ionization. However, as pitch samples contained a high concentration of polycyclic aromatic hydrocarbons (PAHs), LDI was the most suitable ionization technique for analysis. LDI was performed with either infrared or ultraviolet lasers. An Nd:YAG laser model (wavelength λ=355 nm), from BRUKER DALTONICS, was employed to generate ions by irradiating the surface of the sample with low energy photons. Lower laser energy was used to ensure that fragmentation of the parent species did not occur during ionization, and subsequent transmission and mass analysis. The generation of ion images through mass spectrometry analysis from the pitch sample enabled tracking the 2D distribution of PAHs across a droplet of the solid pitch. In order to generate the images, the mass spectrometry data must be acquired in a systematic manner across the surface of the pitch sample, thus by annotating a scanned image of the sample and annotating the regions of analysis using the FLEXIMAGING™ software from BRUKER DALTONICS. The ion beam performed a raster scan of the sample surface, producing a mass spectrum at each raster point. The resulting data was mapped over the optical micrographs, corresponding the mass spectra with the locations of the mesophase pitch on the substrate (or 'sample holder'). The sample was spatially heterogeneous, which confirmed the importance of producing spatially specific mass spectra that correspond with optical micrographs. Accordingly, experimental parameters of the analysis were set, thus dictating the spatial resolution of the image. After annotation of the scanned image, an arbitrary coordinate set was created which covered the region of interest (ROI) with intervals that defines the spatial resolution of the resulting image. For example, when acquiring an image at a 30 μm spatial resolution, the laser spot was tuned below a width of 15 μm, and the instrument's sample stage was set to move 30 μm after each laser emission (higher spatial resolution equates to more structural detail). The laser was fired at the pitch sample, and ions were generated and analyzed while the stage moved to the next interval in the coordinate system. The foregoing process was repeated (e.g., repetition for about a thousands of times), thus generating data across the ROI. From here, ions of interest were selected and color maps were generated, detailing their locations and relative intensities. Examples of the appearance of the petroleum pitch sample before and after heat treatment are described in FIG. 9A and FIG. 9B, respectively.

FIG. 9A and FIG. 9B illustrate the reflected polarized light micrographs of a melted petroleum pitch on a glass slid (Sample 44) acquired just prior to pyrolysis and after 1 hour of pyrolysis at a temperature of 400° C., where FIG. 9B highlights the appearance of significant quantities of liquid crystalline mesophase pitch in the previously isotropic material. The polarized light highlights the mesophase, which is not present in (A). Due to the total lack of mesophase in the material, the material appears fully black in FIG. 9A, while an hour of pyrolysis resulted in the production of a significant amount of liquid crystalline mesophase throughout.

FIG. 9C-9D illustrates a mass spectrometry imaging of the mesophase pitch formed from Sample 44, wherein varying states of mesophase development are observed from droplet to droplet (FIG. 9E). The MSI of the mesophase pitch depicted higher mass, more aromatic species localizing to the droplets with larger mesophase domains. Smaller, less condensed species, i.e., lower molecular weight compounds that haven't undergone as many condensation, cyclization and dehydrogenation reactions, were found to localize more to the outer edges of the heated mesophase pitch droplets. As the heat treatment was maintained, steady growth of mesophase was observed, due to both molecular condensation and an increase of intermolecular interactions, resulting in larger molecules throughout the droplet volume.

Figure 10:
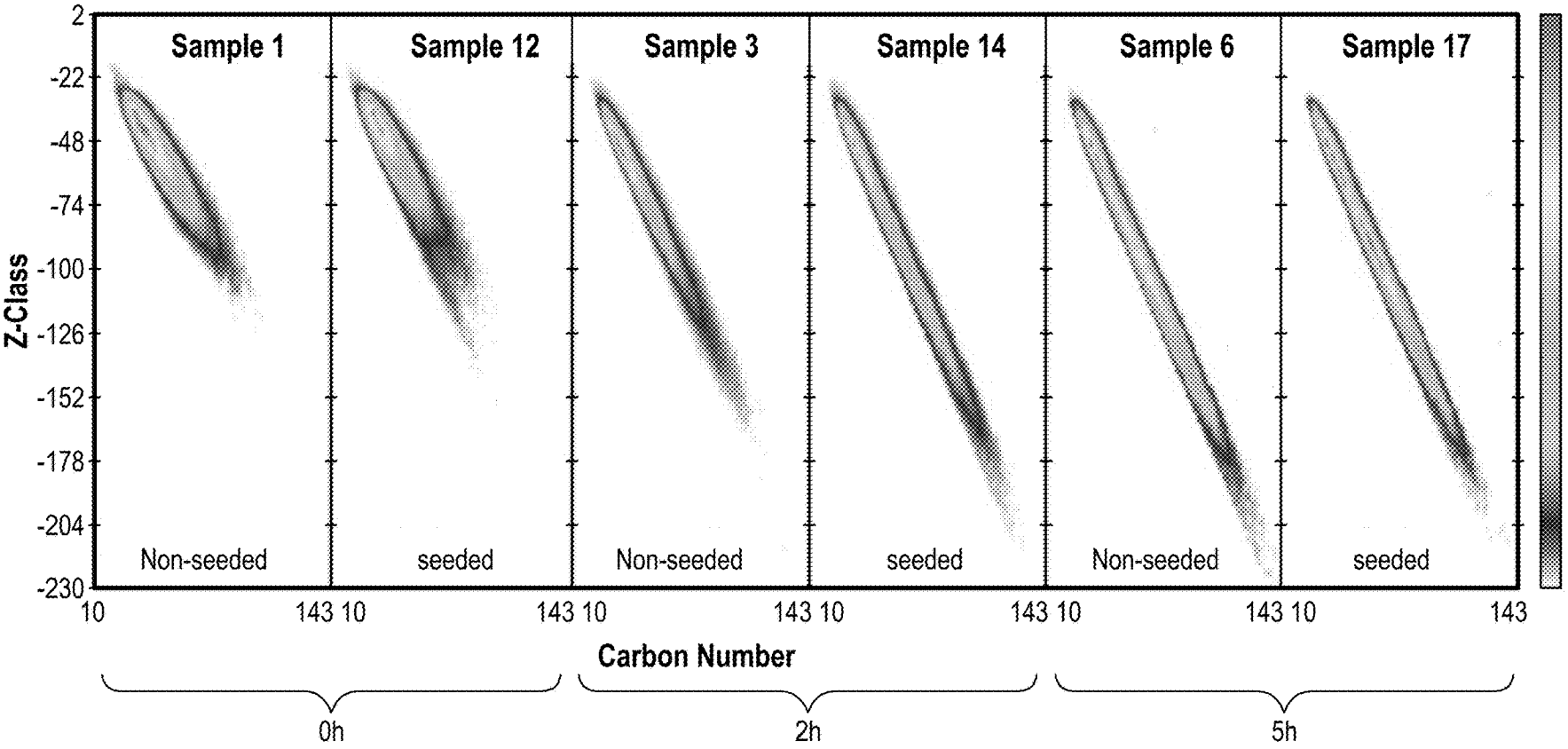
FIG. 10 illustrates the mass spectrometry imaging of various pitch materials, seeded and non-seeded, obtained from HDT-SCT materials.

FIG. 10 illustrates the mass spectrometry imaging of various non-seeded pitch materials (Sample 1, Sample 3, and Sample 6), and seeded pitch materials (Sample 12, Sample 14, and Sample 17) obtained from HDT-SCT materials. The mass spectrometry was completed on a 15T Fourier transform ion cyclotron resonance mass spectrometer (FT-ICR MS). Each pitch sample was prepared by dissolving the pitch sample in THE at a concentration ranging from 2,000 ppm to 5,000 ppm. A few microliters of the pitch solution was then dispensed on a MALDI target and allowed to dry. The data was acquired using a 2 kHz Smartbeam II™ UV MALDI laser, frequency tripled Nd:YAG (355 nm) laser and each mass spectrum was the sum of 2 to 25 laser shots, adjusted for response, with a laser power of 12% relative to effectible maximum. The data was collected from 150 m/z to 3,000 m/z with a time-domain file size of 8M (i.e., a resolving power of 800,000 at m/z 400). As shown in FIG. 10, faster reaction kinetics was observed at the early stages (2 hours) of the heat treatment of Samples 1 and 12, resulting in faster molecular weight growth for the seeded sample (i.e., Sample 12). The seeding agent enabled faster mesophase growth via nucleation and/or growth enhancement but also increases the chemical reactivity to form larger mesogenic molecules. The mass spectrometry imaging shows that, within the first 2 hours of heat treatment, the seeded pitch sample (Sample 12) reacted faster than the non-seeded pitch sample (Sample 1). Without being bond by any theory, it is believed that, along with the seeding agent, the presence of free radicals formed during the heat treatment contributed to the conversion process into mesophase, thus by initiating faster reactivity of the pitch, enabling more chemical reactions (e.g., formation of more condensed aromatic molecules) within the pitch, and contributing to the acceleration of the rate of the reaction. Consequently, upon heat treatment the molecular weight and size distributions, as well as the aromaticity, of the seeded pitch samples rapidly increased as a function of time, when compared to the non-seeded pitch samples, remarkably at the early stage of the heat treatment.

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby. For example, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Whenever a numerical range with a lower limit and an upper limit is disclosed, any number and any included range falling within the range is specifically disclosed, including the lower limit and upper limit. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to one having ordinary skill in the art and having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein.

What is claimed is:

1. A process comprising:

mixing an isotropic feed and a seeding agent to make a blend and reacting in a reaction zone the blend comprising the isotropic feed and the seeding agent, to produce a reacted pitch having a mesophase content of about 10 vol % to 100 vol %, based on the total volume of the reacted pitch, and a softening point (Tsp) below 400° C.;

wherein the seeding agent is about 50 wt % or less, based on the total weight of the blend;

wherein the seeding agent is a mesophase pitch having a mesophase content of about 60 vol % to 100 vol %, based on the total volume of the seeding agent; and separating the reacted pitch in a separation zone to produce:

a first effluent comprising a mixture of gaseous products and liquid products; and a second effluent comprising a separated pitch having a mesophase content of about 10 vol % or greater, based on the total volume of the separated pitch, and a softening point Tsp below 400° C.

2. The process of claim 1, wherein the seeding agent is a mesophase pitch produced from at least a portion of an isotropic pitch that is the same or different than the isotropic feed.

3. The process of claim 1, wherein the blend has a volume ratio isotropic feed/seeding agent of about 50:50 to about 99.9:0.1.

4. The process of claim 1, wherein the blend has a seeding agent content of about 0.5 wt % to about 40 wt %, based on the total weight of the blend.

5. The process of claim 1, wherein reacting the blend is carried out under one or more of: a partial pressure of hydrogen of about 10 MPa or less, a temperature in the range of 200° C. to 600° C., a pressure in the range of 0.0005 MPa to 25 MPa, a residence time of 0.25 minutes to 24 hours, or a WHSV in the range of 0.1 hr-1 to 4 hr-1.

6. The process of claim 1, wherein reacting the blend is selected from the group consisting of: pyrolyzing, slurry hydrocracking, acid-catalyzed reaction, and any combination thereof, wherein acid-catalyzed reaction comprise: hydrotreating and/or acid-catalyzed oligomerization; and wherein reacting the blend is carried out in the presence of an acid catalyst.

7. The process of claim 1, wherein reacting the blend is performed in presence of a hydrogen-donor solvent.

8. The process of claim 1, wherein the reacted pitch has a carbon residue content of from about 20 wt % to about 99 wt %, based on the total weight of the reacted pitch and/or wherein the reacted pitch has a hydrogen content of from about 3 wt % to about 12 wt %, a sulfur content of from 0 wt % to about 10 wt %, based on the total weight of the reacted pitch.

9. The process of claim 1, wherein the reacted pitch has a T10 in the range of 200° C. to 650° C.

10. The process of claim 1, wherein the separated pitch has a mesophase content of about 10 vol % to about 100 vol %, based on the total volume of the separated pitch.

11. The process of claim 1, wherein the separated pitch has softening point (Tsp) of about 100° C. to about 400° C.

12. The process of claim 1, wherein the separated pitch has a carbon residue content of from 20 wt % to 99 wt %, based on the total weight of the separated pitch and/or wherein the separated pitch has a hydrogen content of from about 3 wt % to about 12 wt %, a sulfur content of from 0 wt % to about 10 wt %, based on the total weight of the separated pitch.

13. The process of claim 1, further comprising:

recycling at least a portion of the second effluent back to the reaction zone, wherein the second effluent is used as the seeding agent.

14. The process of claim 1, wherein the separated pitch is combined with a reinforcing agent for the production of a composite.

15. The process of claim 1, wherein the separated pitch is used as a matrix material in the production of a composite.

16. The process of claim 1, wherein the separated pitch is spun at a spinning temperature greater than 200° C.

17. A process comprising:

mixing an isotropic feed and a seeding agent to make a blend and reacting in a reaction zone, in a batch, semi-batch or continuous mode, the blend comprising the isotropic feed and the seeding agent, to produce a reacted pitch having a mesophase content of about 10 vol % to 100 vol %, based on the total volume of the reacted pitch, and a softening point Tsp below 400° C.;

wherein the seeding agent is about 50 wt % or less, based on the total weight of the blend;

wherein the seeding agent is a mesophase pitch having a mesophase content of about 60 vol % to 100 vol %, based on the total volume of the seeding agent;

separating the reacted pitch in a separation zone to produce:

a first effluent comprising a mixture of gaseous products and liquid products; and a second effluent comprising a separated pitch having a mesophase content of about 10 vol % or greater, based on the total volume of the separated pitch, a softening point Tsp below 400° C., wherein the reacted pitch and/or the separated pitch are/is suitable for spinning into carbon fiber; and recycling at least a portion of the second effluent back to the reaction zone, wherein the separated pitch is used as the seeding agent.

* * * * *